US008857299B2

(12) United States Patent
Huttula et al.

(10) Patent No.: US 8,857,299 B2
(45) Date of Patent: Oct. 14, 2014

(54) HAND TOOL

(75) Inventors: Justin Michael Huttula, Portland, OR (US); Curt Matthew Kemper, Salem, OR (US); Benjamin C. Rivera, Lake Oswego, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 284 days.

(21) Appl. No.: 13/350,756

(22) Filed: Jan. 14, 2012

(65) Prior Publication Data

US 2013/0180054 A1 Jul. 18, 2013

(51) Int. Cl.
*B25B 7/22* (2006.01)
*B25B 7/06* (2006.01)

(52) U.S. Cl.
USPC ..... 81/427.5; 7/128

(58) Field of Classification Search
USPC ..... 81/427.5, 177.4, 177.6; 7/118, 127, 7/128, 131, 162, 167, 158, 168
See application file for complete search history.

(56) References Cited

U.S. PATENT DOCUMENTS

| | | | | |
|---|---|---|---|---|
| 4,502,220 | A * | 3/1985 | Aoki | 30/154 |
| 5,142,721 | A | 9/1992 | Sessions et al. | |
| 5,212,844 | A | 5/1993 | Sessions et al. | |
| 5,743,582 | A * | 4/1998 | Rivera | 294/99.2 |
| 5,957,013 | A * | 9/1999 | Frazer | 81/427.5 |
| 5,963,999 | A * | 10/1999 | Gardiner et al. | 7/128 |
| 6,003,180 | A * | 12/1999 | Frazer | 7/128 |
| 6,065,213 | A * | 5/2000 | Rivera | 30/155 |
| 6,185,771 | B1 * | 2/2001 | Trusty, Sr. | 7/128 |
| 6,282,997 | B1 * | 9/2001 | Frazer | 81/427.5 |
| 6,305,041 | B1 * | 10/2001 | Montague et al. | 7/128 |
| 6,523,203 | B2 * | 2/2003 | Harrison | 7/128 |
| 6,721,983 | B2 * | 4/2004 | Dallas et al. | 7/128 |
| 6,721,984 | B1 * | 4/2004 | Harrison | 7/128 |
| 7,028,591 | B2 * | 4/2006 | Dallas et al. | 81/300 |
| 7,146,668 | B2 * | 12/2006 | Rivera | 7/128 |
| 7,654,004 | B2 | 2/2010 | Tsuda | |
| 7,712,399 | B2 | 5/2010 | Nenadic | |
| 7,908,944 | B2 * | 3/2011 | Nason et al. | 81/367 |
| 8,161,653 | B2 | 4/2012 | Nenadic | |
| 2004/0003472 | A1 * | 1/2004 | Dallas et al. | 7/128 |
| 2009/0113721 | A1 | 5/2009 | Robinson et al. | |
| 2010/0122420 | A1 * | 5/2010 | Nason et al. | 7/128 |
| 2010/0151681 | A1 | 6/2010 | Knapp et al. | |

OTHER PUBLICATIONS

[Online ][retrieved Jan. 9, 2012]. Retrieved from internet: URL:http://www.plumbersurplus.com/images/prod/5/Gerber-22-41545-rw-1800072-275682.jpg p. 1.

(Continued)

*Primary Examiner* — David B Thomas
(74) *Attorney, Agent, or Firm* — Alston & Bird LLP

(57) ABSTRACT

A hand tool is provided that is configured to provide ready access to individual tool members. In this regard, the hand tool may provide improved features for facilitating storage and operation of the tool members. One example hand tool includes first and second jaws capable of translating between an extended position and a retracted position. Such a hand tool provides a locking member configured to lock to prevent translation of the first and second jaws from the retracted position. Another example hand tool includes a tool member carried by a handle and rotatable between an open position and a stowed position. Such a hand tool provides a ramp defined on the tool member to facilitate easy rotation of the tool member to the stowed position.

30 Claims, 46 Drawing Sheets

(56) References Cited

OTHER PUBLICATIONS

[Online][retrieved Jan. 9, 2012]. Retrieved from internet: URL:http://www.plumbersurplus.com/images/prod/5/Gerber-22-41545-rw-180072-275684.jpg p. 1.

Fiskars Garden Shears (8"); dated Jun. 26, 2013; retrieved on May 16, 2014 from <http://web.archive.org/web/20130626195040/http://www2.fiskars.com/Gardening-and-Yard-are/Products/Garden-Snips-and-Shears/Garden-Shears-8>.

Gerber Excalibur Set; ebay.com; retrieved on May 19, 2014 from <http://www.ebay.com/ itm/Gerber-egendary-Blades-Balmung-Ron-Carving-Knife-Serving-Fork-Excalibur-Set-/121344124185?pt=LH_DefaultDomain_0&hash=item I c40ac6519#ht_741wt_1137>.

Gerber FliK Multi-Plier—Needlenose, Stainless; retrieved on May 16, 2014 from <http://www. gerbergear.com/Industrial/Tools/FIik-Multi-Plier_22-41054>.

Gerber Freehand Multi-Plier Needlenose, Black; retrieved on May 16, 2014 from <http://www.gerbergear.com/Tactical/Tools/Free-hand-Multi-Plier_22-41513>.

Gerber Multi-Plier 600—Bluntnose Stainless w/ Carbide Insert Cutters, Sheath; dated Oct. 19, 2011; retrieved on May 16, 2014 from <http://web.archive.org/web/20111019221315/http://www.gerbergear.com/Military/Tools/MP600_07500G>.

Gerber Octane Multi Plier—Gray; retrieved on May 16, 2014 from <http://www.gerbergear.com/Essentials/Tools/Octane-Multi-plier_31-000373>.

Gerber Recoil Auto-Plier; dated Apr. 22, 2008; retrieved on May 16, 2014 from <http://web.archive.org/web/20080422082712/http://www.gerber-tools.com/Gerber-Recoil-Auto-Plier-8474.htm>.

Leathernan Wave; dated Sep. 22, 2013; retrieved on May 16, 2014 from <http://web.archive.org/web/20130922155005/http://www.leatherman.com/10.html>.

Office Action for Canadian Application No. 2,794,904; dated Jan. 7, 2014.

Office Action for Australian Application No. 2012247033 dated Jun. 13, 2014.

* cited by examiner

HAND TOOL

FIELD

Embodiments of the present invention relate generally to tools and, more particularly, to a hand tool, such as a multipurpose tool configured to facilitate access to individual tool members.

BACKGROUND

Hand tools are widely popular for their utility in a substantial number of different applications. A hand tool, such as multipurpose tool, includes a number of tool members carried by common frame. A hand tool may include different combinations of tool members depending upon its intended application. For example, hand tools that are designed for a more universal or generic application can include pliers, a wire cutter, a bit driver, one or more knife blades, a saw blade, a bottle opener or the like. Other hand tools are designed to service more specific applications or niche markets and correspondingly include tool members that are useful for the intended application. For example, hand tools may be specifically designed for automobile repairs, hunting, fishing or other outdoor applications, gardening, and the like.

One reason for the popularity of hand tools is the capability provided by a hand tool to provide a wide range of functionality with a single tool, thereby reducing the need to carry a number of different tools to perform those same functions. For example, a single hand tool may be carried instead of a pair of pliers, one or more screwdrivers, a knife and a bottle opener. As such, the burden upon a user is reduced since the user need only carry a single hand tool.

As hand tools are frequently carried by users in the field, it is desirable for the hand tools to be relatively small and lightweight while remaining rugged so as to resist damage. In many circumstances, it is desirable for a hand tool to be small enough for use by the hands of one user. Moreover, it is even more desirable to provide a hand tool usable by only one hand of a user, as often, the other hand of the user may be otherwise occupied.

A hand tool may include one or more handles designed such that one or more tool members are disposed within the handles when not in use. By being stored within the handles, the form factor of the hand tool may be relatively small in comparison to the number of tool members carried by the hand tool. As such, the hand tool may have substantial utility and versatility, albeit in a relatively small tool. Often, the tool members stowed inside the handles of the tools may be rotatable or retractable between a stowed position and an operable (e.g., open) position. Safety is always a concern with hand tools and, thus, it is desirable for the tool member to be safely secured, whether in the stowed position or in the operation position so as to prevent accidental opening or closing of the tool member. As such, improved techniques for presenting a safe and compact hand tool are needed.

BRIEF SUMMARY

Embodiments of the present invention provide a hand tool that is configured to provide improved access to individual tool members. Such example hand tools provide improved features for facilitating storage and operation of the tool members.

In an example embodiment, a hand tool is provided. The hand tool comprises first and second handles defining respective distal and proximal ends. The hand tool further comprises first and second jaws slidably connected to the first and second handles and configured to translate between a retracted position and an extended position. The first and second jaws being disposed forward of the proximal end of the first and second handles in the extended position and being disposed within the first and second handles in the retracted position. The hand tool further comprises a locking member configured to translate with the first and second jaws within a slot defined in at least one of the first or second handles. The locking member is configured to rotate within the slot to a locked position to prevent translation of the first and second jaws. In some embodiments, the locking member may be configured to rotate within the slot when the first and second jaws are disposed in the refracted position.

In some embodiments, the slot may define a longitudinal axis extending parallel to the length of the at least one first or second handle. The slot may define a locking portion configured to enable the locking member to rotate between an unlocked position and the locked position. The locking member may define a width and a length greater than the width. The width of the locking member is perpendicular to the longitudinal axis of the slot when the locking member is in the unlocked position. The length of the locking member is perpendicular to the longitudinal axis of the slot when the locking member is in the locked position. The slot may define a width greater than the width of the locking member to facilitate translation of the locking member when the locking member is in the unlocked position. The width of the slot may be less than the length of the locking member such that translation of the locking member is prevented when the locking member is the locked position.

In some embodiments, the locking portion may define a locking track and a notch. The locking track may enable the locking member to rotate approximately 90 degrees between the unlocked position and the locked position. The notch may be configured to engage at least a portion of the locking member to prevent translation of the locking member when the locking member is in the locked position.

In some embodiments, the hand tool may further comprise a clip configured to at least partially surround the locking member. The clip may be configured to translate with the locking member and may comprise a clip locking portion that corresponds to the locking portion of the slot. The clip may be biased to surround the locking member such that the locking member is biased toward the locked position when disposed in the locked position and biased toward the unlocked position when disposed in the unlocked position.

In some embodiments, the first and second jaws may be fully disposed within the first and second handles in the retracted position. In some embodiments, the first and second handles may be pivotably connected and the first and second jaws may be pivotably connected. The first and second jaws may be capable of relative pivotal movement in response to convergence and divergence of the first and second handles when disposed in the extended position. In some embodiments, the hand tool may further comprise a spring biased to oppose convergence of the first and second handles. The pivotable connection of the first and second jaws may be distinct from the pivotable connection of the first and second handles such that force exerted on the first and second handles to overcome the bias of the spring transfers substantially through the pivotable connection of the first and second jaws without transferring substantially through the pivotable connection of the first and second handles.

In some embodiments, the first and second handles may each define an internal U-shaped channel. The first and second jaws may each define a distal portion corresponding to at least a portion of the U-shaped channel and configured to fit within the U-shaped channel to reduce lateral movement of the first and second jaws within the U-shaped channel during movement of the hand tool.

In some embodiments, the first and second handles may each define an external side and an internal side, wherein the internal side of the first handle faces the internal side of the second handle. The hand tool may further comprise a plurality of tool members with each of the plurality of tool members being carried by one of the first or second handles. Each of the plurality of tools may be disposed on the external side of the respective one of the first or second handles such that each tool member is configured to fold into and out of the external side of the respective one of the first or second handles. Thus, none of the plurality of tool members may be disposed on either of the internal sides of the first or second handles.

In some embodiments, the first or second handles may define a pocket with opposing sidewalls and a floor. At least one of the sidewalls of the pocket may define a protrusion. The hand tool may further comprise at least one tool member carried by at least one of the first or second handle and rotatable between a stowed position and an open position. The at least one tool member may define a first surface and a second surface and be configured to rotate into the pocket of the at least one first or second handle with the second surface disposed proximate to the floor of the pocket to define the stowed position. The at least one tool member may define a recess configured to engage with the protrusion of the sidewall in the stowed position. The at least one tool member may further define a ramp. The ramp may define an upward slope leading from the second surface of the at least one tool member toward the recess. The ramp may be configured to engage the protrusion proximate the second surface when the at least one tool member is rotated from the open position to the stowed position. In some embodiments, the ramp does not extend to the recess.

In some embodiments, the first and second handles may each define a U-shape with opposing sidewalls and a bottom wall connecting the sidewalls. The bottom wall of first and second handles may each define an extended portion at the distal end of the first and second handles. The extended portion may be positioned at an angle relative to another portion of the bottom wall and be positioned between the opposing sidewalls to prevent the sidewalls from being squeezed together.

In another embodiment, a hand tool is provided. The hand tool comprises at least one handle defining a pocket with opposing sidewalls and a floor. At least one of the sidewalls defines a protrusion. The hand tool further comprises at least one tool member defining a first surface and a second surface. The at least one tool member is carried by the at least one handle and configured to rotate between an open position and a stowed position. The at least one tool member is configured to rotate into the pocket of the at least one handle with the second surface disposed proximate to the floor of the pocket to define the stowed position. The at least one tool member defines a recess configured to engage with the protrusion of the sidewall in the stowed position. The at least one tool member further defines a ramp. The ramp defines an upward slope leading from the second surface of the at least one tool member toward the recess. The ramp is configured to engage the protrusion proximate the second surface when the at least one tool member is rotated from the open position to the stowed position. In some embodiments, the ramp may not extend to the recess. In some embodiments, the ramp may define a length of approximately half of the distance between the second surface and the recess.

In some embodiments, the at least one tool member may be rotatably connected to the at least one handle and define a base portion proximate the rotatable connection. The ramp may be defined within the base portion of the at least one tool member.

In some embodiments, the at least one tool member may be rotatably connected to the at least one handle. The ramp may define a radial path leading from the second surface toward the recess. The radial path may correspond to the axis of rotation between the at least one tool member and the at least one handle.

In some embodiments, the ramp may define a rectangular path leading from the second surface toward the recess.

In some embodiments, the sidewall with the protrusion may be biased toward the recess to resist rotation of the at least one tool member from the stowed position to the open position when the protrusion is engaged with the recess.

In yet another embodiment, a hand tool is provided. The hand tool comprises at least one handle defining a pocket with opposing sidewalls and a floor. The hand tool further comprises at least one tool member defining a protrusion. The at least one tool member is carried by the at least one handle and configured to rotate between an open position and a stowed position. The at least one tool member is configured to rotate into the pocket of the at least one handle. The at least one of the sidewalls defines a first surface facing outwardly from the floor and a recess configured to engage with the protrusion of the at least one tool member in the stowed position to resist rotation of the at least one tool member from the stowed position to the open position. The at least one sidewall further defines a ramp. The ramp defines an upward slope leading from the first surface of the at least one sidewall toward the recess. The ramp is configured to engage the protrusion proximate the first surface when the at least one tool member is rotated from the open position to the stowed position. In some embodiments, the ramp does not extend to the recess.

In yet another embodiment, a hand tool is provided. The hand tool comprises first and second handles defining respective distal and proximal ends. The hand tool further comprises first and second jaws slidably connected to the first and second handles and configured to translate between a retracted position and an extended position. The first and second jaws are disposed forward of the proximal end of the first and second handles in the extended position. The first and second jaws are disposed within the first and second handles in the retracted position. The hand tool further comprises a plurality of tool members, with each of the plurality of tool members being carried by one of the first or second handles. Each of the plurality of tool members is configured to rotate into and out of the respective one of the first or second handles. At least one of the tool members is rotatable around an axis of the first or second handle defined proximate the distal end of the respective first or second handle. At least another one of the tool members is rotatable around an axis of the first or second handle defined proximate the proximal end of the respective first or second handle.

In another embodiment, a hand tool is provided. The hand tool comprises first and second handles defining respective distal and proximal ends. The first handle comprises a first internal channel and the second handle comprises a second internal channel. The hand tool further comprises first and second bars positioned within the first and second internal channels respectively. The hand tool further comprises first and second jaws slidably connected to the first and second handles and configured to translate within the first and second internal channels between a retracted position and an extended position. The first and second jaws are disposed forward of the proximal end of the first and second handles in the extended position. The first and second jaws are disposed within the first and second handles in the retracted position. The first and second jaws each define a slot configured to interact with the first or second bars in the extended position.

In some embodiments, the hand tool may further comprise a plurality of tool members, with each of the plurality of tool members being carried by one of the first or second handles. Each of the plurality of tool members may be configured to rotate into and out of the respective one of the first or second handles around an axis. At least one of the tool members may rotatable around an axis defined by one of the first or second bars.

In some embodiments, the first and second handles may be pivotably connected and the first and second jaws may be pivotably connected. The first and second jaws may be capable of relative pivotal movement in response to convergence and divergence of the first and second handles when disposed in the extended position. In some embodiments, the hand tool may further comprise a spring biased to oppose convergence of the first and second handles. The pivotable connection of the first and second jaws may be distinct from the pivotable connection of the first and second handles such that force exerted on the first and second handles to overcome the bias of the spring transfers substantially through the first and second bars without transferring substantially through the pivotable connection of the first and second handles.

In another embodiment a hand tool is provided. The hand tool comprises first and second handles defining respective distal and proximal ends. The first and second jaws are pivotably connected. The hand tool further comprises first and second jaws slidably connected to the first and second handles and configured to translate between a retracted position and an extended position. The first and second jaws are disposed forward of the proximal end of the first and second handles in the extended position. The first and second jaws are disposed within the first and second handles in the retracted position. The first and second jaws are configured for relative pivotal movement in response to convergence and divergence of the first and second handles when disposed in the extended position. The first and second handles are pivotably connected. The pivotable connection of the first and second jaws is disposed forward of the pivotable connection of the first and second handles.

In some embodiments, the first handle defines a first extension with a first elongated slot and the second handle defines a second extension with a second elongated slot. The pivotable connection of the first and second handles may be defined by a connection between the first elongated slot and the second elongated slot. The first and second elongated slots may be configured to enable the first and second handles to converge inside the first and second elongated slots when the first and second jaws converge and diverge inside the first and second elongated slots when the first and second jaws diverge.

In yet another embodiment, a hand tool is provided. The hand tool comprises first and second handles defining respective distal and proximal ends. The first handle comprises a first internal channel and the second handle comprises a second internal channel. The hand tool further comprises first and second bars positioned within the first and second internal channels respectively. The hand tool further comprises first and second jaws slidably connected to the first and second handles and configured to translate within the first and second internal channels between a retracted position and an extended position. The first and second jaws are disposed forward of the proximal end of the first and second handles in the extended position. The first and second jaws are disposed within the first and second handles in the retracted position. The first and second jaws are capable of relative pivotal movement in response to convergence and divergence of the first and second handles when disposed in the extended position. The hand tool further comprises a spring biased to oppose convergence of the first and second handles. The first and second bars are configured to engage the first and second jaws in the retracted position against the bias of the spring so as to prevent divergence of the first and second jaws when the first and second jaws are disposed in the retracted position.

In another embodiment, a hand tool is provided. The hand tool comprises first and second handles defining respective distal and proximal ends. The first handle comprises a first internal channel and the second handle comprises a second internal channel. The hand tool further comprises first and second jaws slidably connected to the first and second handles and configured to translate within the first and second internal channels between a retracted position and an extended position. The first and second jaws are disposed forward of the proximal end of the first and second handles in the extended position. The first and second jaws are disposed within the first and second handles in the retracted position. The first and second jaws are configured for relative pivotal movement in response to convergence and divergence of the first and second handles when disposed in the extended position. The first jaw defines a first flared portion and the second jaw defines a second flared portion. The hand tool further comprises a spring biased to oppose convergence of the first and second handles. The first internal channel defines a first flange configured to engage the first flared portion of the first jaw in the retracted position. The second internal channel defines a second flange configured to engage the second flared portion of the second jaw in the retracted position. The first and second flanges are configured to engage the first and second flared portions in the retracted position against the bias of the spring so as to prevent divergence of the first and second jaws when the first and second jaws are disposed in the retracted position.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1-29, a hand tool 10, such as a multipurpose tool, according to one embodiment of the present invention is depicted. While the tool will be described in the context of a hand tool, other types of tools may readily employ embodiments of the present invention including knives and other tools that are not considered hand tools. Additionally, while the tool described below includes two handles, other tools with one handle are contemplated and useful with embodiments of the present invention. Likewise, tools with more than two handles are also envisioned and useful with embodiments of the present invention. For purposes of illustration, but not of limitation, a hand tool employing an embodiment of the present invention will now be described.

Figure 1:
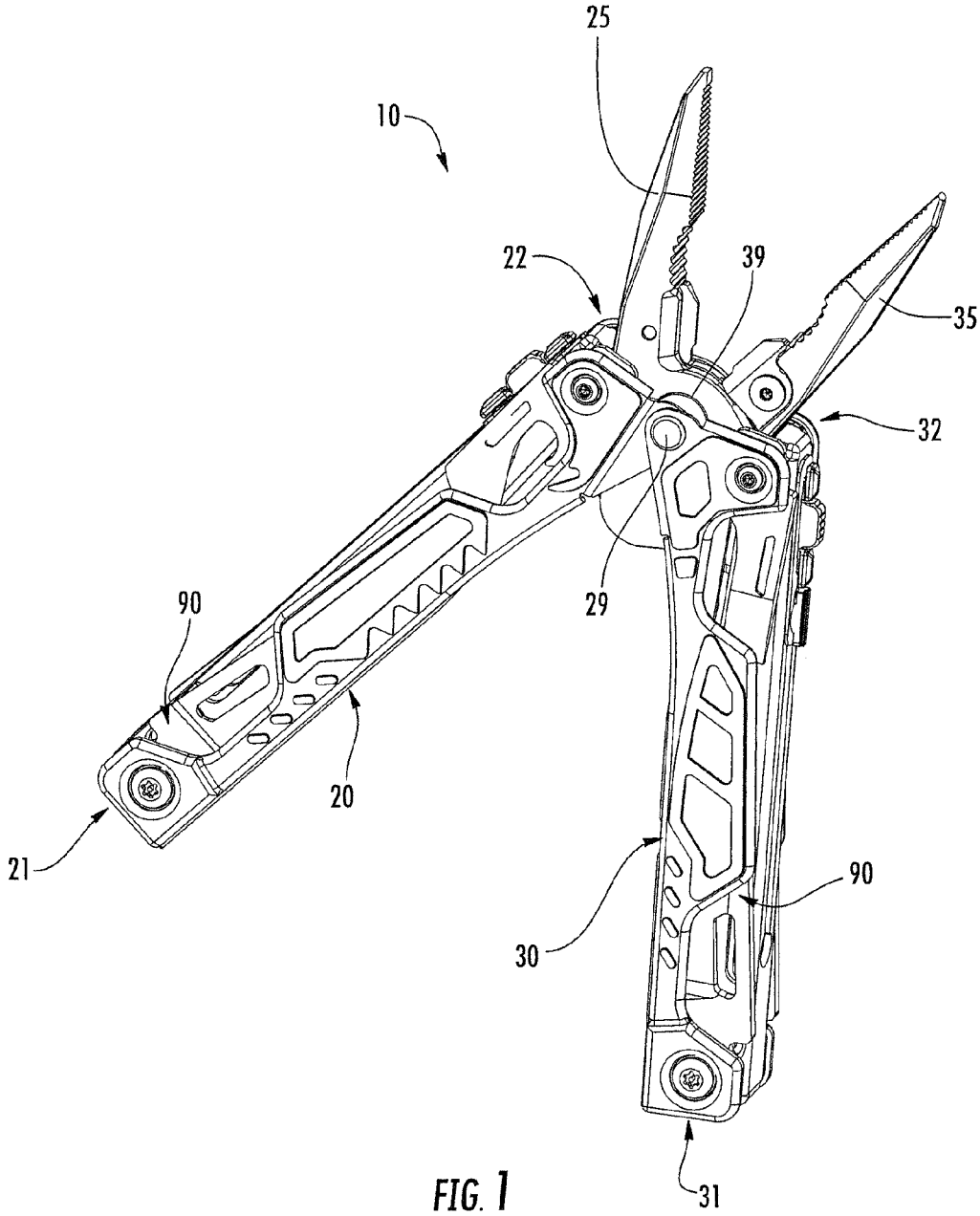
FIG. 1 is a perspective view of a hand tool, wherein first and second jaws of the hand tool are shown in the extended position, in accordance with some embodiments discussed herein.

Hand tools often include one or more handles that are configured to provide a user access to one or more tool members stored within. FIG. 1 shows a hand tool 10 with a pair of generally elongate handles that are configured to store and/or provide access to one or more tool members (e.g., knife, saw, pliers, etc.). Such access may be provided through folding and unfolding (e.g., rotation) of tool members (e.g., tool members 90) or retraction and extension of tool members (e.g., first and second jaws 25, 35).

In the depicted embodiment of FIG. 1, the hand tool 10 comprises a first handle 20 and a second handle 30. The first handle 20 defines a distal end 21 and a proximal end 22. Likewise, the second handle 30 defines a distal end 31 and a proximal end 32. The first and second handles 20, 30 are pivotably connected 29 near their respective proximal ends 22, 32.

In some embodiments, the hand tool 10 may comprise a tool member with a first jaw 25 and a second jaw 35. The first and second jaws 25, 35 may be pivotably connected 39 and capable of squeezing together, such as is common for operation of a pair of pliers. Although not heretofore described, the tool member having pivotable first and second jaws 25, 35 can also include wire cutters and/or wire strippers, or scissors, if desired. Though some of the embodiments described herein may include connected handles, embodiments of the present invention contemplate hand tools with separate handles such that the handles are not connected.

As will be described in greater detail herein, some embodiments of the present invention provide a hand tool with first and second jaws capable of translation between an extended position and a retracted position (e.g., open position and stowed position, respectively). FIG. 1 illustrates the hand tool 10 with first and second jaws 25, 35 disposed in the extended position. In the depicted embodiment, the first and second jaws 25, 35 are disposed forward of the proximal ends 22, 32 of the first and second handles 20, 30. In some embodiments, the first and second jaws 25, 35 are configured to operate (e.g., squeeze together, separate, etc.), such as through interaction with a user, when disposed in the extended position. In some embodiments, the first and second jaws 25, 35 may define a retracted position when disposed within the first and second handles 20, 30 (shown in FIG. 6).

Figure 2:
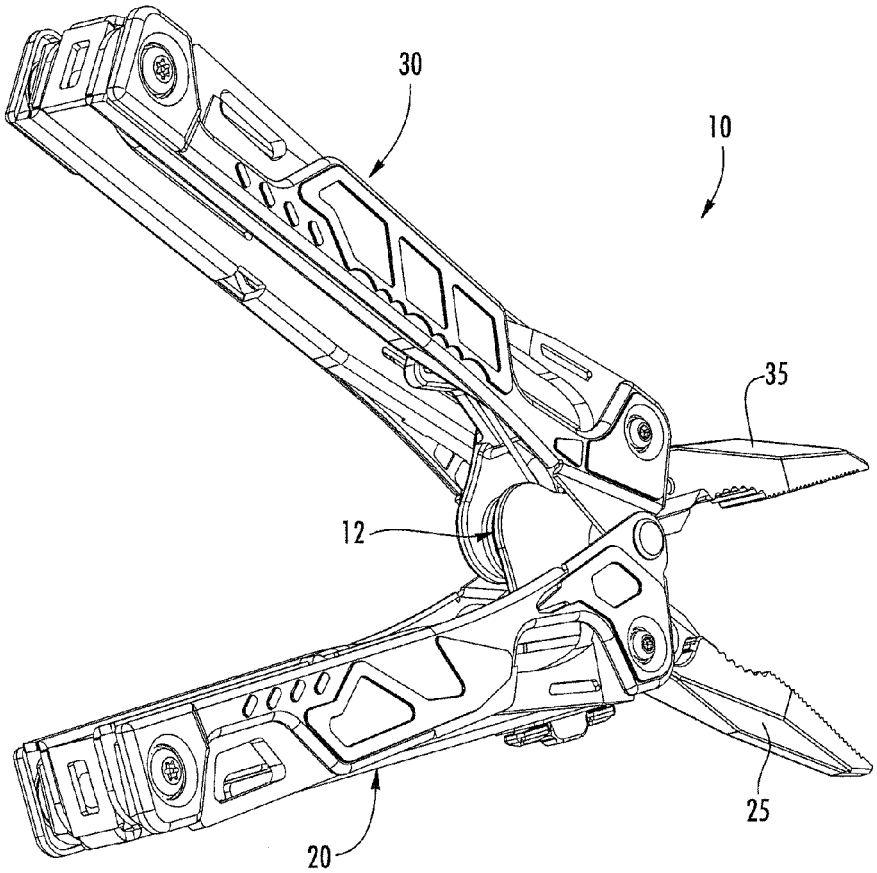
FIG. 2 is rear perspective view of the hand tool of FIG. 1, in accordance with some embodiments discussed herein.
Figure 3:
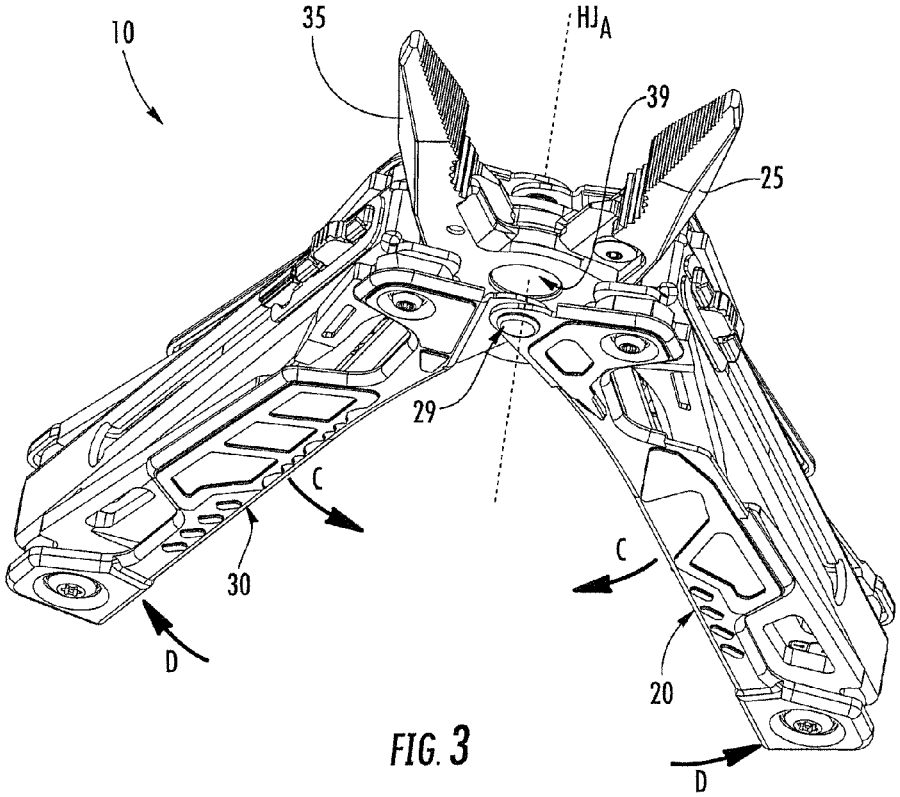
FIG. 3 is front perspective view of the hand tool of FIG. 1, wherein convergence (arrow C) and divergence (arrow D) of the handles is illustrated, in accordance with some embodiments discussed herein.

With reference to FIGS. 2 and 3, in some embodiments, the hand tool 10 may comprise a spring 12 configured to bias the first and second jaws 25, 35 apart. The spring 12 may interact with the first and second handles 20, 30, such that the first and second handles 20, 30 are also biased apart. In some embodiments, the bias of the spring 12 may aid in deployment of the first and second jaws 25, 35 into the extended position.

As noted above, when disposed in the extended position, the first and second jaws 25 are configured to pivot around connection 39 and the first and second handles 20, 30 are configured to pivot around connection 29. In some embodiments, the first and second jaws 25, 35 and first and second handles 20, 30 may be configured to pivot around the same axis (e.g., axis $HJ_A$). As such, in some embodiments, the first and second jaws 25, 35 may be configured to pivot with the first and second handles 20, 30. In particular, as the first and second handles 20, 30 converge (e.g., come together as illustrated by arrow C) the first and second jaws 25, 35 may be configured to converge together. Likewise, as the first and second handles 20, 30 diverge (e.g., spread apart as illustrated by arrow D) the first and second jaws 25, 35 may be configured to spread apart (e.g., diverge). Additionally, in some embodiments, the spring 12 may be biased to cause the first and second jaws 25, 35 and the first and second handles 20, 30 to diverge. As such, the first and second jaws 25, 35 of the hand tool 10 may be capable of relative pivotal movement in response to convergence and divergence of the first and second handles in the extended position.

Figure 4:
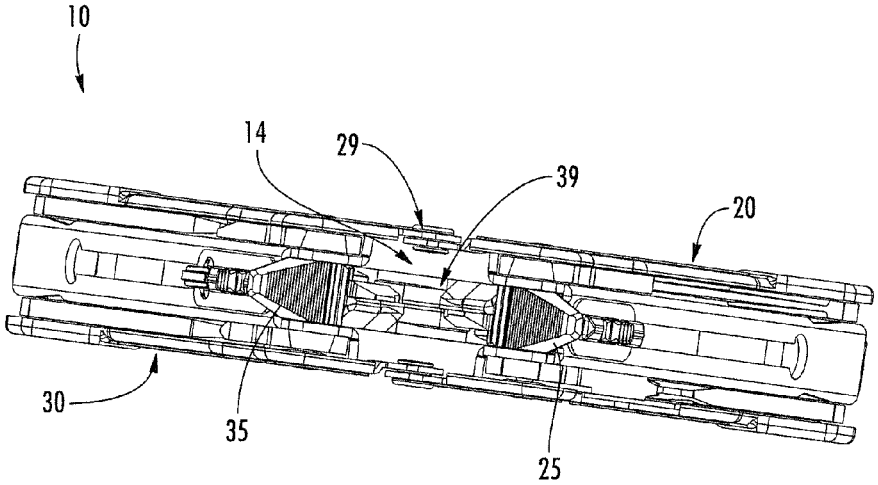
FIG. 4 is front view of the hand tool of FIG. 1, in accordance with some embodiments discussed herein.

In some embodiments, a user may interact with the first and second handles 20, 30 of the hand tool 10 to operate the first and second jaws 25, 35. However, with a spring 12 configured to oppose convergence of the first and second handles 20, 30, a user may need to provide enough force to overcome the biasing force of the spring 12. This force provides stress and strain on the pivotable connection, and with constant use, can create undesirable effects, such as breakage. As such, to avoid such unwanted effects, in some embodiments, such as shown in FIGS. 3 and 4, the pivotable connection 39 between the first and second jaws 25, 35 may be distinct from the pivotable connection 29 of the first and second handles 20, 30. For example, with reference to FIG. 4, a gap 14 can be seen between the connection 39 for the first and second jaws 25, 35 and the connection 29 of the first and second handles 20, 30. In such an embodiment, the force exerted on the first and second handles 20, 30 to overcome the bias of the spring transfers substantially through the pivotable connection 39 of the first and second jaws 25, 35 without transferring substantially through the pivotable connection 29 of the first and second handles 20, 30.

Figure 5:
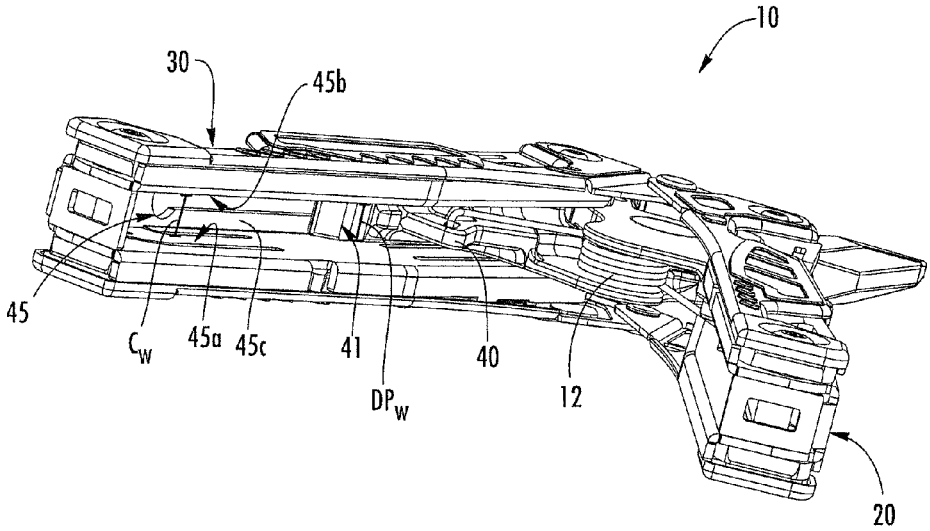
FIG. 5 is rear perspective view of the hand tool of FIG. 1, in accordance with some embodiments discussed herein.
Figure 6:
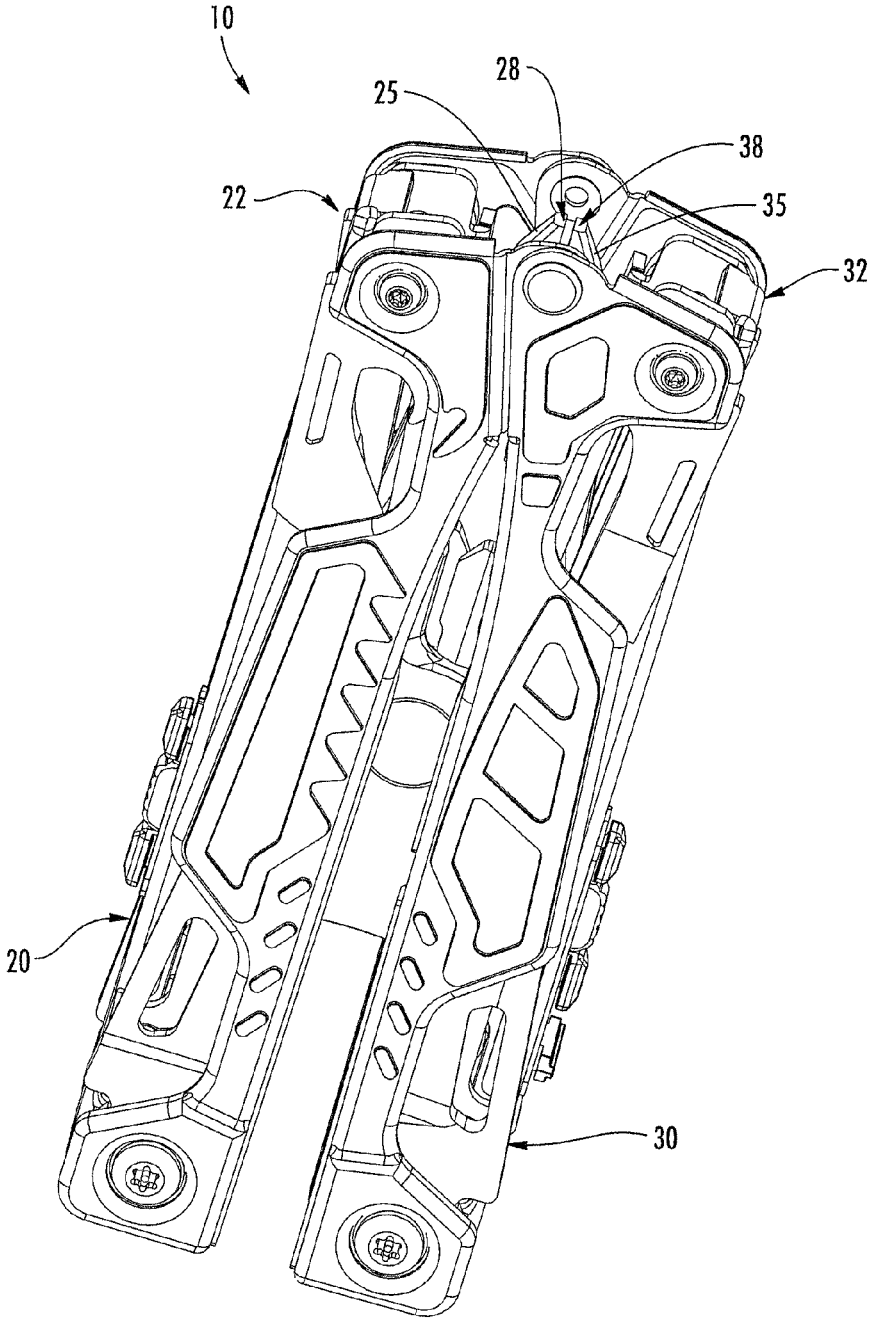
FIG. 6 is perspective view of the hand tool of FIG. 1, wherein first and second jaws of the hand tool are shown in the retracted position, in accordance with some embodiments discussed herein.

As noted above, in some embodiments, the first and second jaws of the hand tool are configured to translate between an extended position (shown in FIG. 1) and a retracted position (shown in FIG. 6). In some embodiments, the first and second jaws are slidably connected to the first and second handles to facilitate translation. As such, the first and second handles 20, 30 may each define an internal channel for slidable connection with the first and second jaws 25, 35. With reference to FIG. 5, in the depicted embodiment, the first and second handles 20, 30 may define an internal U-shaped channel 45. The U-shaped channel 45 may define opposing sidewalls 45*a*, 45*b* and a floor 45*c*. To facilitate translation, the first and second jaws 25, 35 may each define a slide member 40 with a distal portion 41 configured to slidably fit within the U-shaped channel 45.

An improper fitting between the first and second jaws 25, 35 and the first and second handles 20, 30 may result in the creation of an undesirable rattling noise whenever the hand tool is moved. To prevent such a rattling noise, some embodiments may provide a distal portion 41 of a slide member 40 of the first or second jaws 25, 35 with a width ($DP_W$) that closely corresponds to the width ($C_W$) of the U-shaped channel 45 such that the distal portion 41 fits snugly into the U-shaped channel 45 reducing unnecessary space between the distal portion 41 and the opposing sidewalls 45*a*, 45*b* of the U-shaped channel 45. Such a snug connection reduces rattling noise created when the hand tool 10 is moved (e.g., shaken). In particular, in order to maintain a snug connection that reduces rattling noise, some embodiments may provide a maximum tolerant distance of 0.10 inches between one of the sidewalls of the U-shaped channel and the corresponding edge of the distal portion. Thus, in some embodiments, the distal portion 41 of the slide member 40 may correspond to at least a portion of the U-shaped channel 45 and be configured to fit within the U-shaped channel 45 to reduce lateral movement of the first and second jaws 25, 35 within the U-shaped channel 45 during movement of the hand tool 10.

Figure 30A:
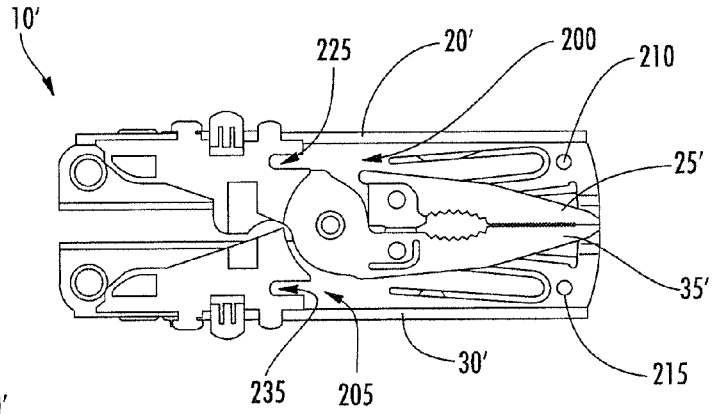
FIG. 30A shows a partially transparent side view of another embodiment of a hand tool, wherein first and second jaws of the hand tool are shown in the retracted position, in accordance with some embodiments discussed herein.
Figure 30B:
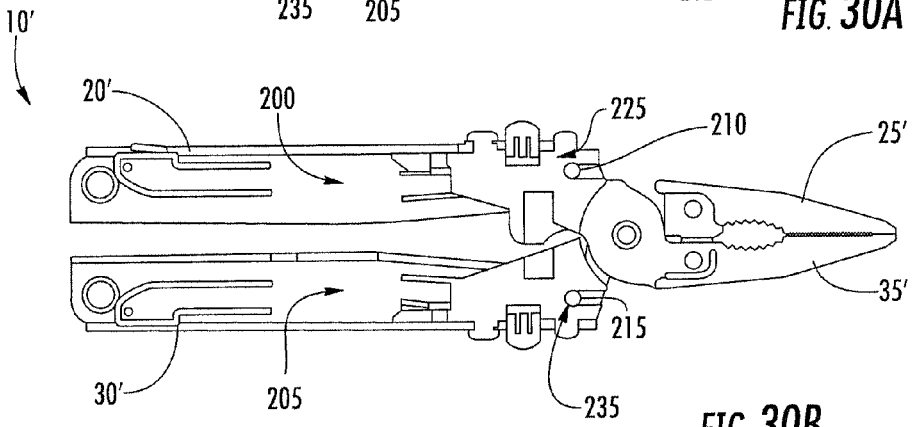
FIG. 30B shows a partially transparent side view of the hand tool shown in FIG. 30A, wherein first and second jaws of the hand tool are shown in the extended position with the first and second jaws converged, in accordance with some embodiments discussed herein.

In some embodiments, an example hand tool may comprise bars within the internal channel of the first and second handles to facilitate positioning and operation of the first and second jaws in the extended position. For example, with reference to FIG. 30A, a hand tool 10' (which may include any embodiments of the invention described herein) may include a first handles 20' with a first internal channel 200 and a second handle 30' with a second channel 205. First and second jaws 25', 35' may be configured to translate within the first and second internal channels 200, 205 between a retracted position (FIG. 30A) and an extended position (FIG. 30B).

In some embodiments, the hand tool 10' may comprise a first bar 210 positioned within the first internal channel 200 (e.g., within the path of the first jaw 25') and a second bar 215 positioned within the second internal channel 205 (e.g., within the path of the second jaw 35'). Additionally, in some embodiments, the first and second jaws 25', 35' may define first and second slots 225, 235, respectively. In some embodiments, the first slot 225 may be configured to interact with/receive the first bar 210 and the second slot 235 may be configured to interact with/receive the second bar 215 when the first and second jaws 25', 35' are disposed in the extended position. Thus, with reference to FIG. 30B, as the first and second jaws 25', 35' translate within the internal channels 200, 205, to the extended position, the first slot 225 receives the first bar 210 and the second slot 235 receives the second bar 215.

In some embodiments, the first and second bars 210, 215 may extend within the respective first and second internal channels 200, 205 between sides of the first or second handles 20', 30'. Additionally, as will be described in greater detail herein with respect to FIGS. 18-26A, some embodiments of the present invention provide a hand tool with a plurality of tool members stored within at least one of the handles. Similarly, in some embodiments, the hand tool 10' may include a plurality of tool members, with each of the plurality of tool members being carried by one of the first or second handles 20' 30' (shown in FIG. 18). Additionally, each of the plurality of tool members may be configured to rotate into and out of the respective one of the first or second handles 20', 30' around an axis (shown in FIG. 19). In some embodiments, at least one of the tool members may be rotatable around an axis defined by one of the first or second bars 210, 215. In such a manner, the bars provide a dual function of enabling the stored tool members to rotate into and out of the handle and provide support for the first and second jaws when disposed in the extended position.

As noted above, in some embodiments, a user may interact with the first and second handles 20', 30' of the hand tool 10' to operate the first and second jaws 25', 35' when disposed in the extended position. However, with a spring 12 (shown in FIG. 2) configured to oppose convergence of the first and second handles 20', 30', a user may need to provide enough force to overcome the biasing force of the spring 12. This force provides stress and strain on the pivotable connection, and with constant use, can create undesirable effects, such as breakage. As such, in some embodiments, to avoid such unwanted effects, as shown in FIGS. 3 and 4, the pivotable connection 39 between the first and second jaws 25, 35 may be distinct from the pivotable connection 29 of the first and second handles 20', 30'.

Figure 30C:
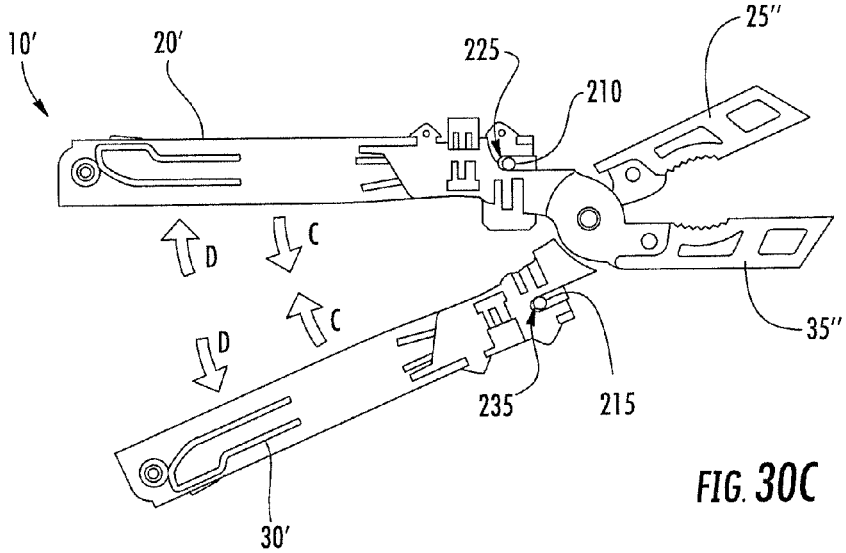
FIG. 30C shows a partially transparent side view of the hand tool shown in FIG. 30A, wherein first and second jaws of the hand tool are shown in the extended position with the first and second jaws diverged, in accordance with some embodiments discussed herein.

In some embodiments, with reference to FIGS. 30B and 30C, the force a user exerts on the first and second handles 20', 30' to overcome the bias of the spring may transfer substantially through the first and second bars 210, 215 of the first and second jaws 25', 35'. This prevents the force from transferring substantially through the pivotable connection 29 of the first and second handles 20', 30', thereby reducing the wear on the connection between the first and second handles 20', 30'. As noted above, embodiments of the present invention envision other types of tool members, such as other types of first and second jaws (e.g., first and second jaws 25", 35" shown in FIG. 30C).

Figure 31A:
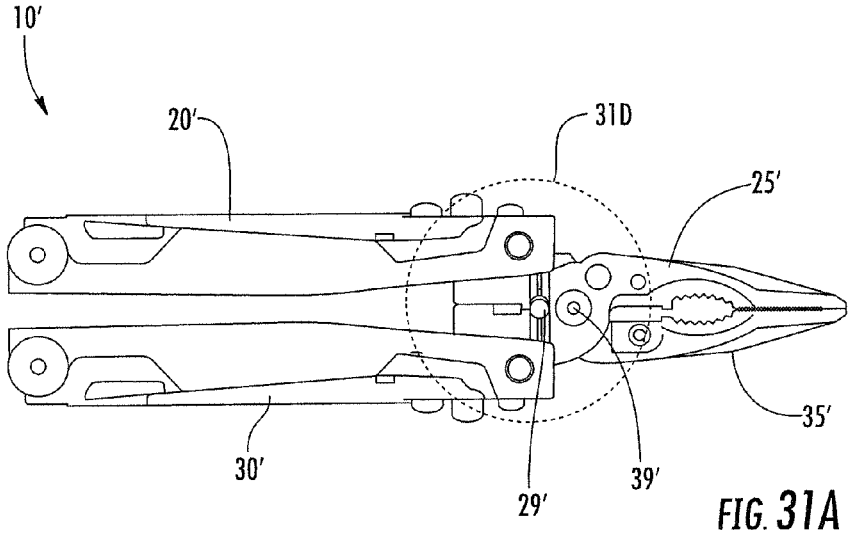
FIG. 31A shows a side view of the hand tool shown in FIG. 30A, wherein first and second jaws of the hand tool are shown in the extended position with the first and second jaws converged, in accordance with some embodiments discussed herein.
Figure 31B:
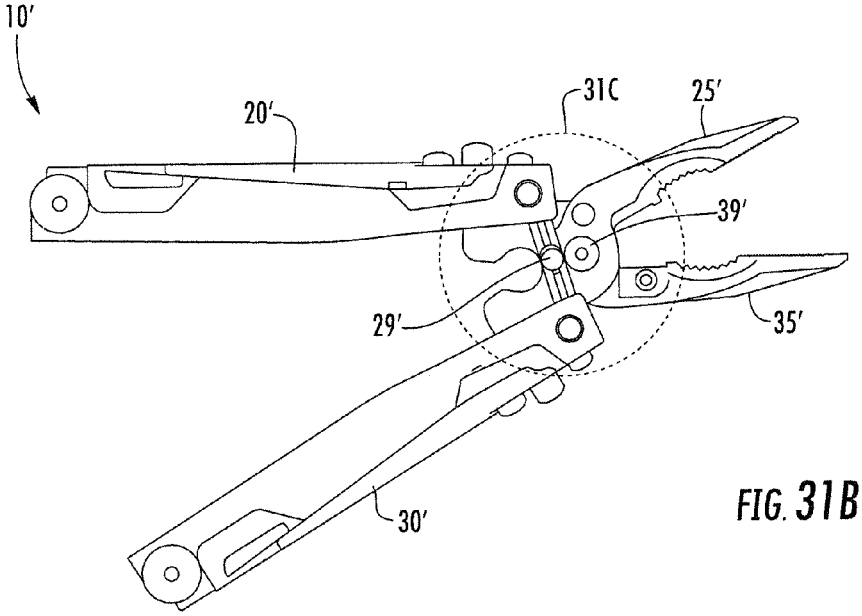
FIG. 31B shows a side view of the hand tool shown in FIG. 31A, wherein first and second jaws of the hand tool are shown in the extended position with the first and second jaws diverged, in accordance with some embodiments discussed herein.

In some embodiments, the hand tool may be configured such that the first and second jaws are configured to extend even further beyond the proximal ends of the first and second handles in the extended position. In particular, the first and second jaws may define a pivotable connection that extends beyond the pivotable connection of the first and second handles. For example, with reference to FIGS. 31A and 31B, the first and second jaws 25', 35' of the hand tool 10' may be configured to pivot around a pivotable connection 39' defined by an axis (Z1) and the first and second handles 20', 30' may be configured to pivot around a pivotable connection 29' defined by an axis (Z2). In the depicted embodiment, the pivotable connection 39' of the first and second jaws 25', 35' is disposed forward of the pivotable connection 29' of the first and second handles 20', 30'.

Figure 31C:
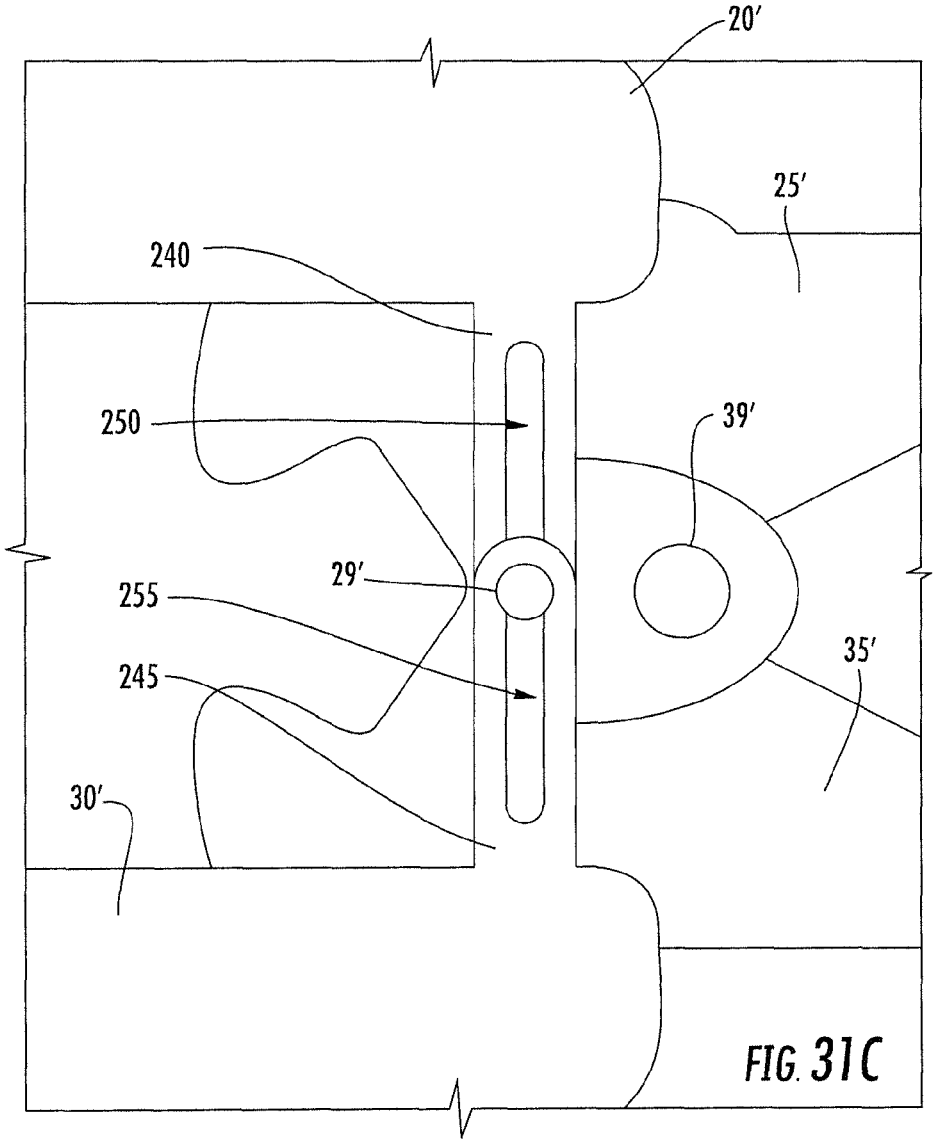
FIG. 31C shows a detailed view of the hand tool shown in FIG. 31B, wherein first and second jaws of the hand tool are shown in the extended position with the first and second jaws diverged, in accordance with some embodiments discussed herein.
Figure 31D:
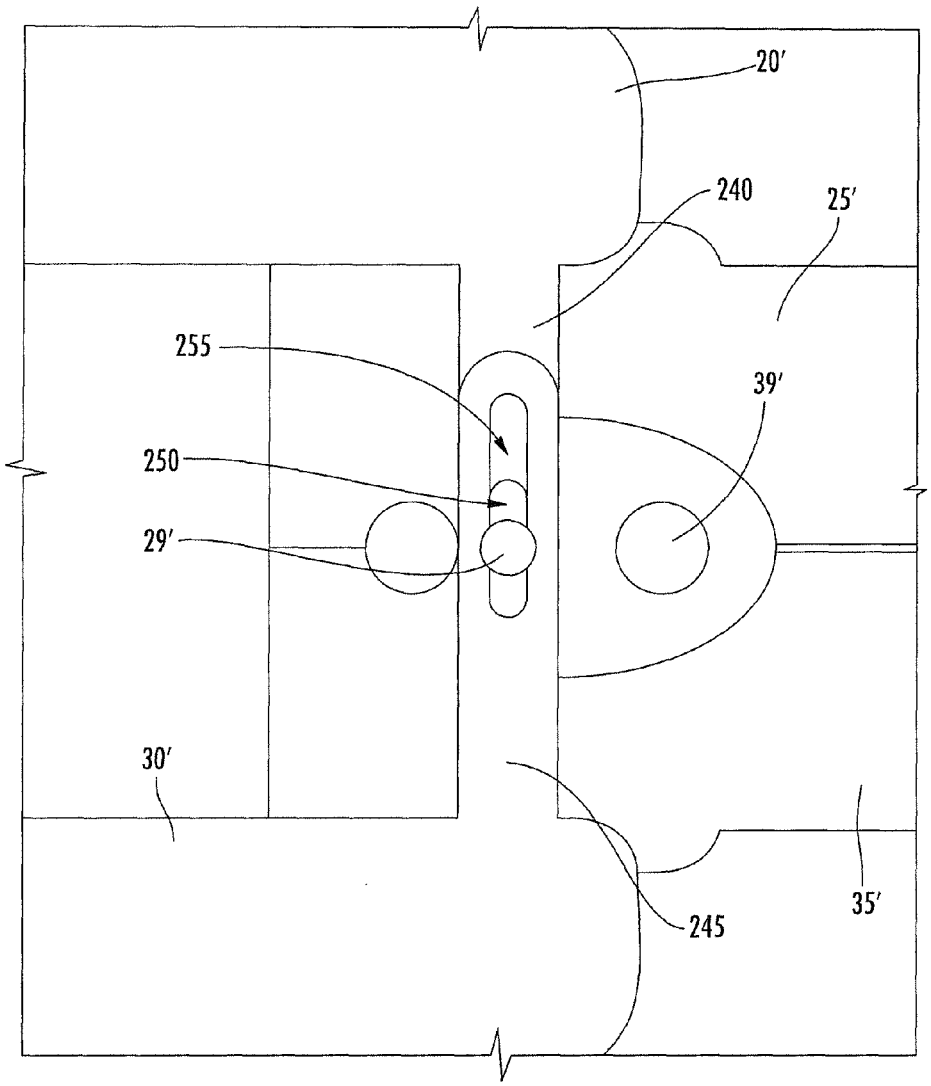
FIG. 31D shows a detailed view of the hand tool shown in FIG. 31A, wherein first and second jaws of the hand tool are shown in the extended position with the first and second jaws converged, in accordance with some embodiments discussed herein.

Extending the pivot connection of the first and second jaws beyond the pivot connection of the first and second handles (e.g., offsetting the axes of rotation), however, may provide some design difficulties. Thus, some embodiments of the present invention provide a hand tool that accounts for the offset in the axes of rotation to enable the first and second jaws to be capable of relative pivotal movement in response to convergence and divergence of the first and second handles when disposed in the extended position. With reference to FIG. 31C, the first handle 20' may defines a first extension 240 with a first elongated slot 250. Likewise, the second handle 30' may define a second extension 245 with a second elongated slot 255. The pivotable connection 29' of the first and second handles 20', 30' may be defined within the first and elongated slots 250, 255 such that the pivotable connection 29' may translate within each slot 250, 255 independently. This ability to translate enables the first and second handles 20', 30' to translate toward and away from each other as the first and second jaws 25', 35' converge and diverge. Said differently, the first and second elongated slots 250, 255 are configured to enable the first and second handles 20', 30' to converge inside the first and second elongated slots 250, 255 when the first and second jaws 25', 35' converge (shown in FIG. 31D) and diverge inside the first and second elongated slots 250, 255 when the first and second jaws 25', 35' diverge (shown in FIG. 31C). Thus, the distance between the first and second handles 20', 30' may offset depending on the pivotable orientation of the first and second jaws 25', 35', thereby accounting for the offset in rotational axes.

Figure 7:
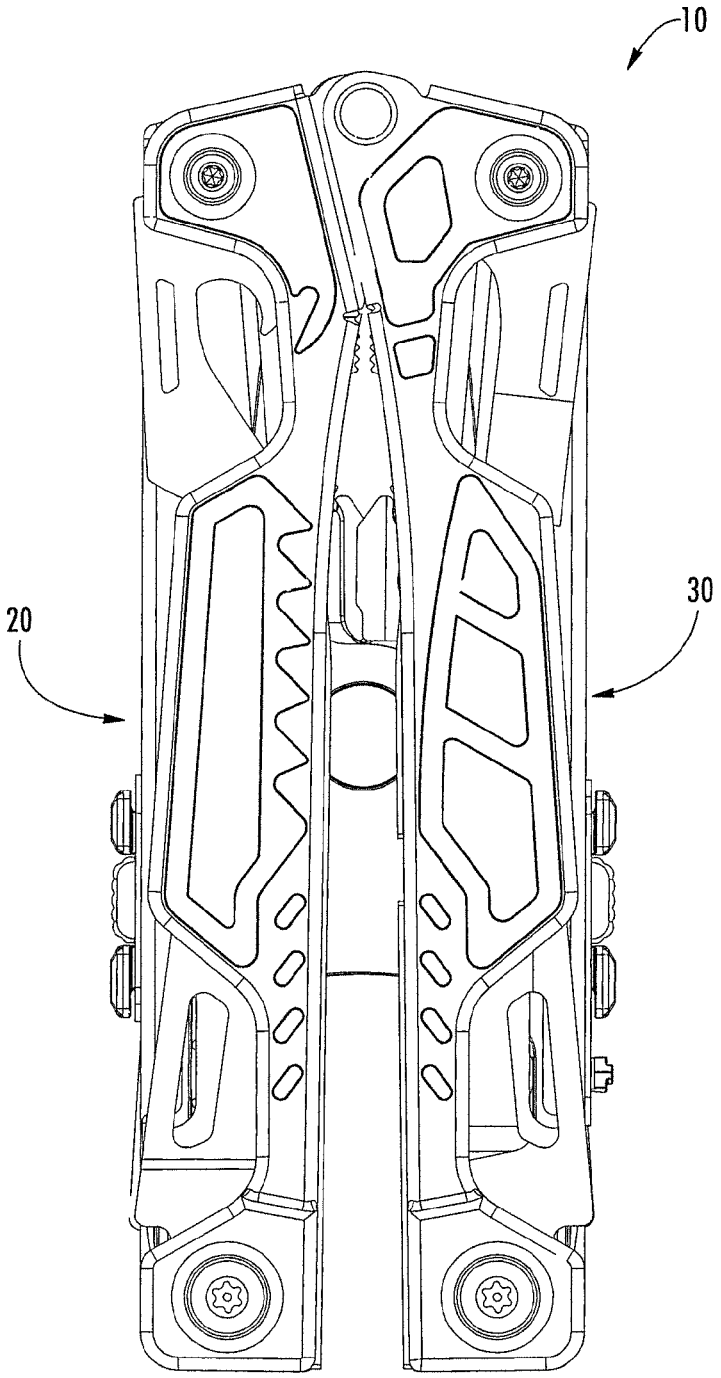
FIG. 7 is top view of the hand tool of FIG. 6, in accordance with some embodiments discussed herein.

FIGS. 6 and 7 illustrate the hand tool 10 with the first and second jaws 25, 35 disposed in the retracted position. In particular, the first and second jaws 25, 35 have been translated to the retracted position (e.g., the slide members 40 moved downward along the U-shaped channel 45 shown in FIG. 5). In some embodiments, the hand tool 10 may be configured such that the first and second jaws 25, 35 are fully disposed within the first and second handles 20, 30 in the retracted position. Thus, the first and second jaws 25, 35 will not protrude from the proximal ends 22, 32 of the first and second handles 20, 30. For example, in the depicted embodiment, the tips 28, 38 of the first and second jaws 25, 35, respectively, do not protrude from the pivotable connection 29 of the first and second handles 20, 30 (e.g., near the proximal ends 22, 32 of the first and second handles 20, 30). This full retraction of the first and second jaws 25, 35 within the first and second handles 20, 30 avoids an undesirable sharp protrusion.

Figure 32:
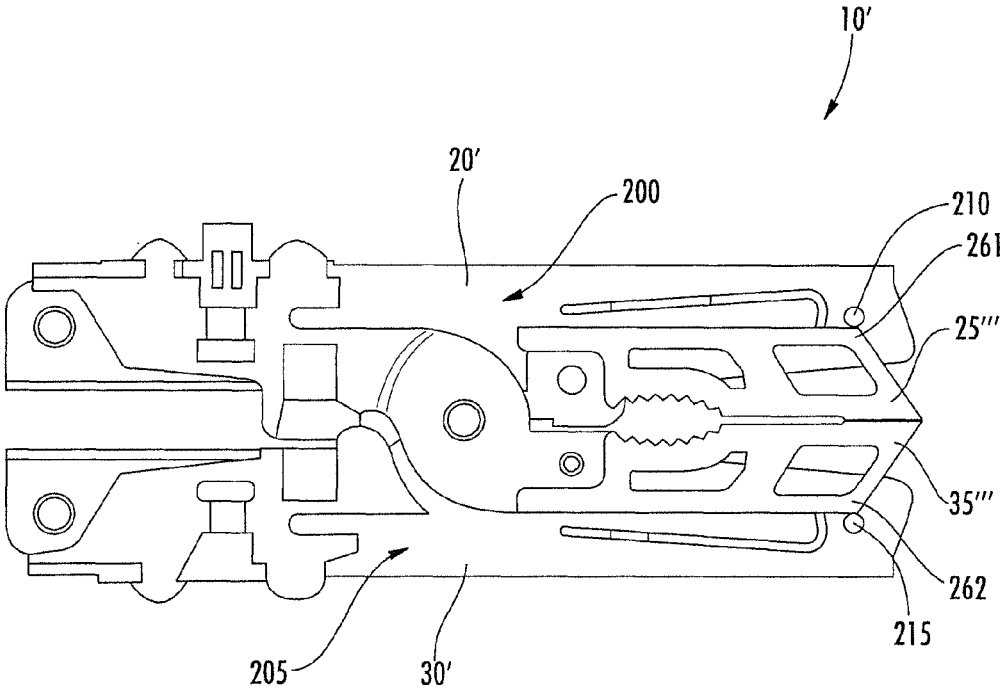
FIG. 32 shows a side view of another embodiment of a hand tool, wherein first and second jaws of the hand tool are shown in the retracted position, in accordance with some embodiments discussed herein.

As noted above, in some embodiments, a spring (shown in FIG. 2) may be configured to bias the first and second jaws to diverge. Also noted above, the spring may translate with the first and second jaws between a retracted position and an extended position. However, similar to being in the extended position, while the first and second jaws are disposed in the refracted position, the spring may still be biased to cause the first and second jaws to diverge. As such, some embodiments of the present invention seek to provide a way to prevent divergence of the first and second jaws while they are disposed in the refracted position. In some embodiments, the bars provided within the internal channels of the first and second handles may be configured to engage the first and second jaws in the refracted position to prevent divergence of the first and second jaws. For example, with reference to FIG. 32, the first and second bars 210, 215 (which may be disposed within the internal channels 200, 205 of the first and second handles 20', 30') may be configured to engage the first and second jaws 25', 35' to oppose the bias of the spring so as to prevent divergence of the first and second jaws 25', 35' when disposed in the retracted position. In the depicted embodiment, the first and second jaws 25''', 35''' comprise extended surfaces 261, 262 configured to engage the first and second bars 210, 215 when disposed in the retracted position.

Figure 33:
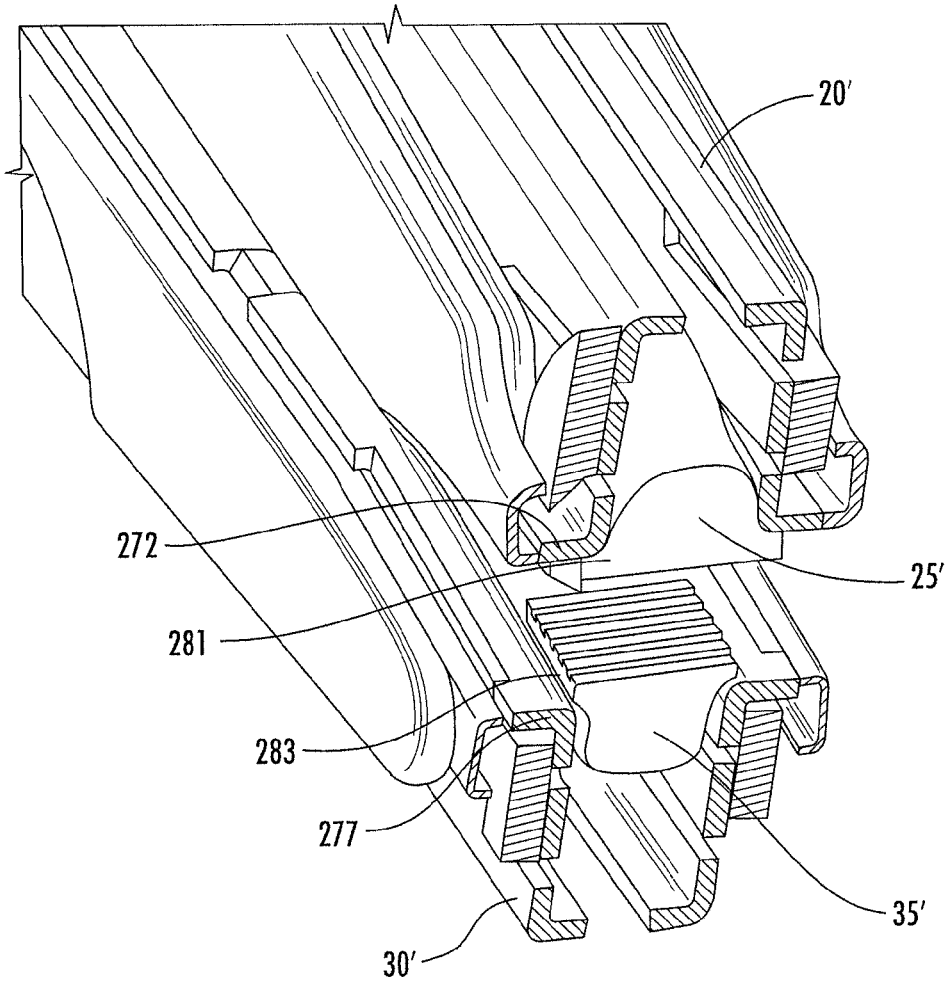
FIG. 33 shows a perspective view of another embodiment of a hand tool, wherein first and second jaws of the hand tool are shown in the refracted position, in accordance with some embodiments discussed herein.
Figure 33A:
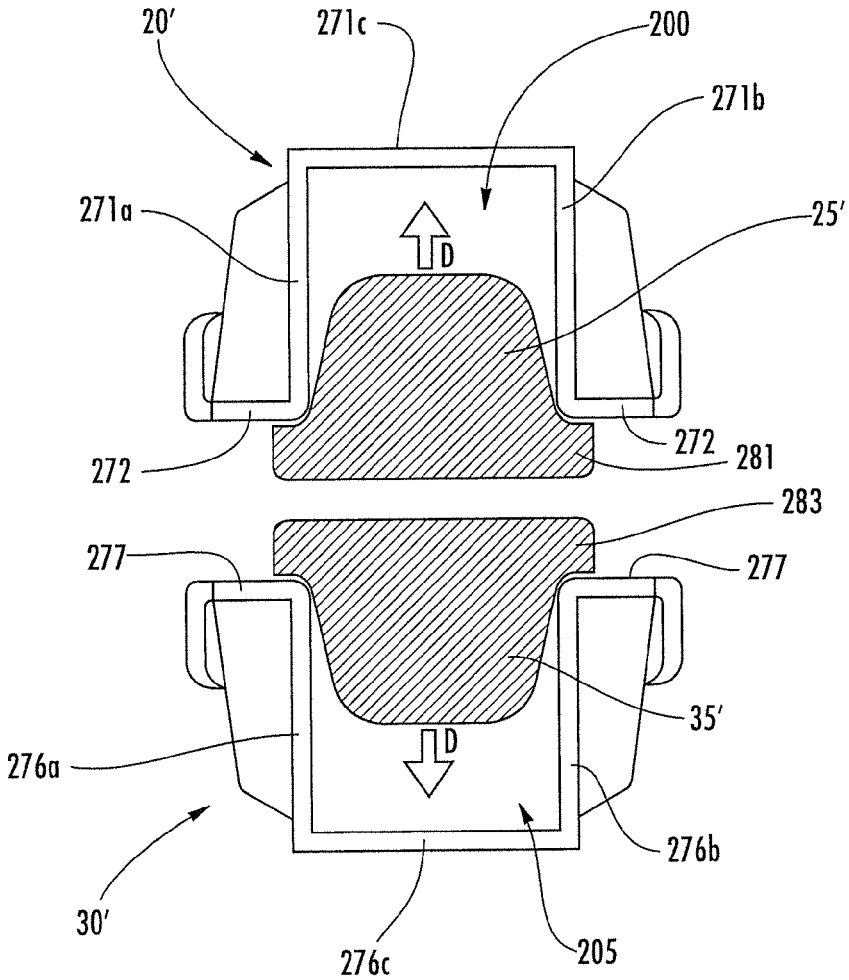
FIG. 33A shows a front view of the hand tool shown in FIG. 33, in accordance with some embodiments discussed herein.

Additionally or alternatively, the hand tool may define other configurations for opposing the divergence force created by the bias of the spring. In some embodiments, the hand tool may be configured with flanges disposed on the first and second handles that engage flared portions of the first and second jaws in the retracted position to prevent divergence of the first and second jaws. With reference to FIGS. 33 and 33A, the first and second handles 20', 30' may define an internal U-shaped channel 200, 205. The U-shaped channel 200, 205 may define opposing sidewalls 271*a*, 271*b*, 276*a*, 276*b*, and a floor 271*c*, 276*c*. To facilitate translation, the first and second jaws 25', 35' may be configured to translate within the U-shaped channels 200, 205 between the extended position and the retracted position. As noted above, however, the hand tool may comprise a spring that is biased to cause the first and second jaws 25', 35' to diverge (even in the retracted position), such as along arrow D. To counteract this force, prevent the divergence, and maintain the first and second jaws 25', 35' in the retracted position, some embodiments may provide opposing engagement surfaces between the first and second jaws 25', 35' and the channels 200, 205. For example, the first jaw 25' may define a first flared portion 281 that extends outwardly from the first jaw 25'. Likewise, the second jaw 35' may define a second flared portion 283 that extends outwardly from the second jaw 35'. The first internal channel 200 may define a first flange 272 that extends outwardly from both sidewalls 271*a*, 271*b*. The first flange 272 may be configured to engage the first flared portion 281 of the first jaw 25' in the retracted position. Likewise, the second internal channel 205 may define a second flange 277 that extends outwardly from both sidewalls 276*a*, 276*b*. The second flange 277 may be configured to engage the second flared portion 283 of the second jaw 35' in the retracted position. Thus, the first and second flanges 272, 277 may be configured to engage the first and second flared portions 281, 283 in the retracted position against the bias of the spring so as to prevent divergence of the first and second jaws 25', 35' when the first and second jaws 25', 35' are disposed in the refracted position.

As noted above, some embodiments of the present invention provide improved safety features for hand tools, such as hand tool 10. For example, some embodiments provide a lock feature for locking the first and second jaws 25, 35 in the retracted position within the first and second handles 20, 30. As such, in some embodiments, as illustrated by FIGS. 8-17A, the first and second jaws 25, 35 of the hand tool 10 may transition from the extended position to the retracted position and, ultimately, to a locked position.

Figure 8:
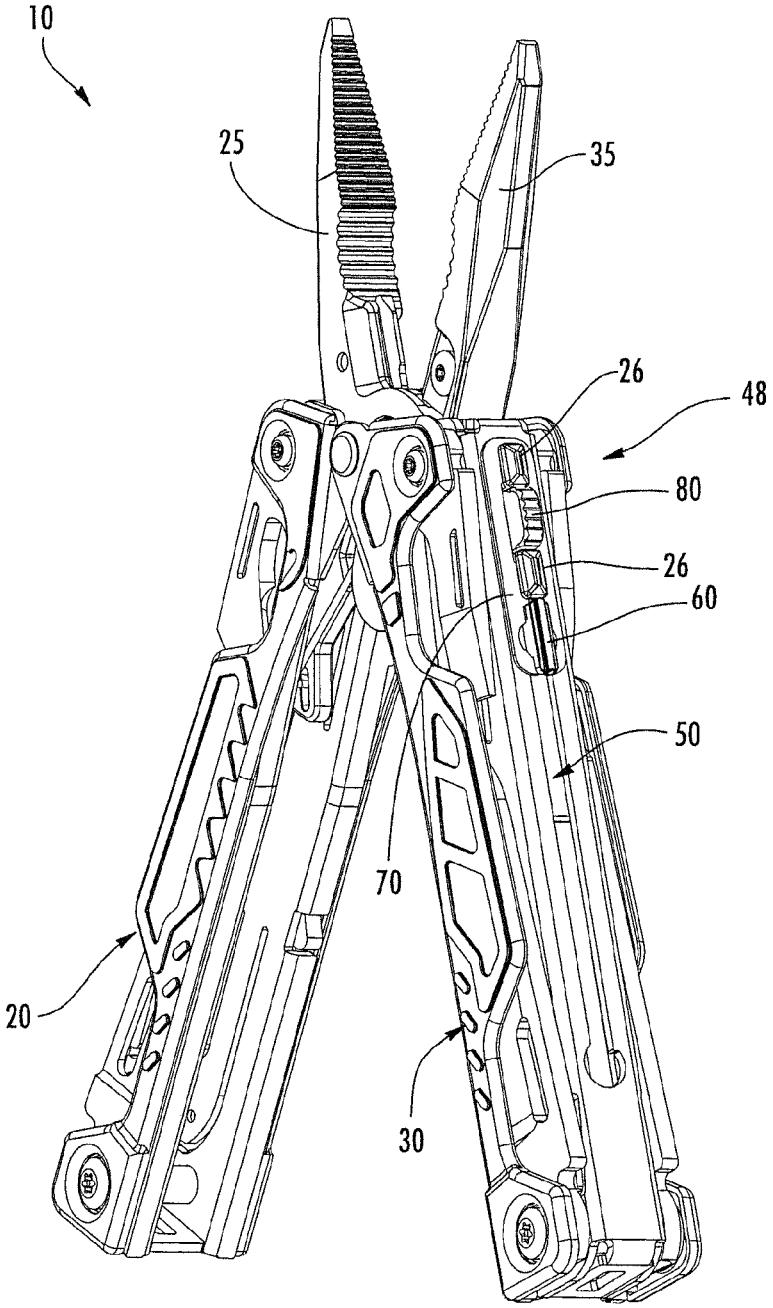
FIG. 8 shows a perspective view of the hand tool shown in FIG. 1, wherein first and second jaws of the hand tool are shown in the extended position, in accordance with some embodiments discussed herein.

With reference to FIG. 8, in some embodiments, the hand tool 10 may comprise a translation assembly 48. The translation assembly 48 may be configured to translate with the first and second jaws 25, 35 between the extended position and the retracted position. With reference to the depicted embodiment, in some embodiments, the translation assembly 48 may comprise at least one guide member 26, a pressing member 80, a locking member 60, and a clip 70. The translation assembly 48 may be configured to slide within a slot 50 defined in at least one of the first or second handles 20, 30. In the depicted embodiment, both first and second handles 20, 30 of the hand tool 10 each define a slot 50 and comprise a translation assembly 48 for each slot 50. In the depicted embodiment, the translation assembly for the first handle 20 does not include a locking member 60. As noted above, however, embodiments of the present invention are not meant to be limited to the depicted embodiment and, thus, contemplate many different variations of the translation assembly (e.g., the locking member 60 may be configured on the first handle 20).

Figure 9:
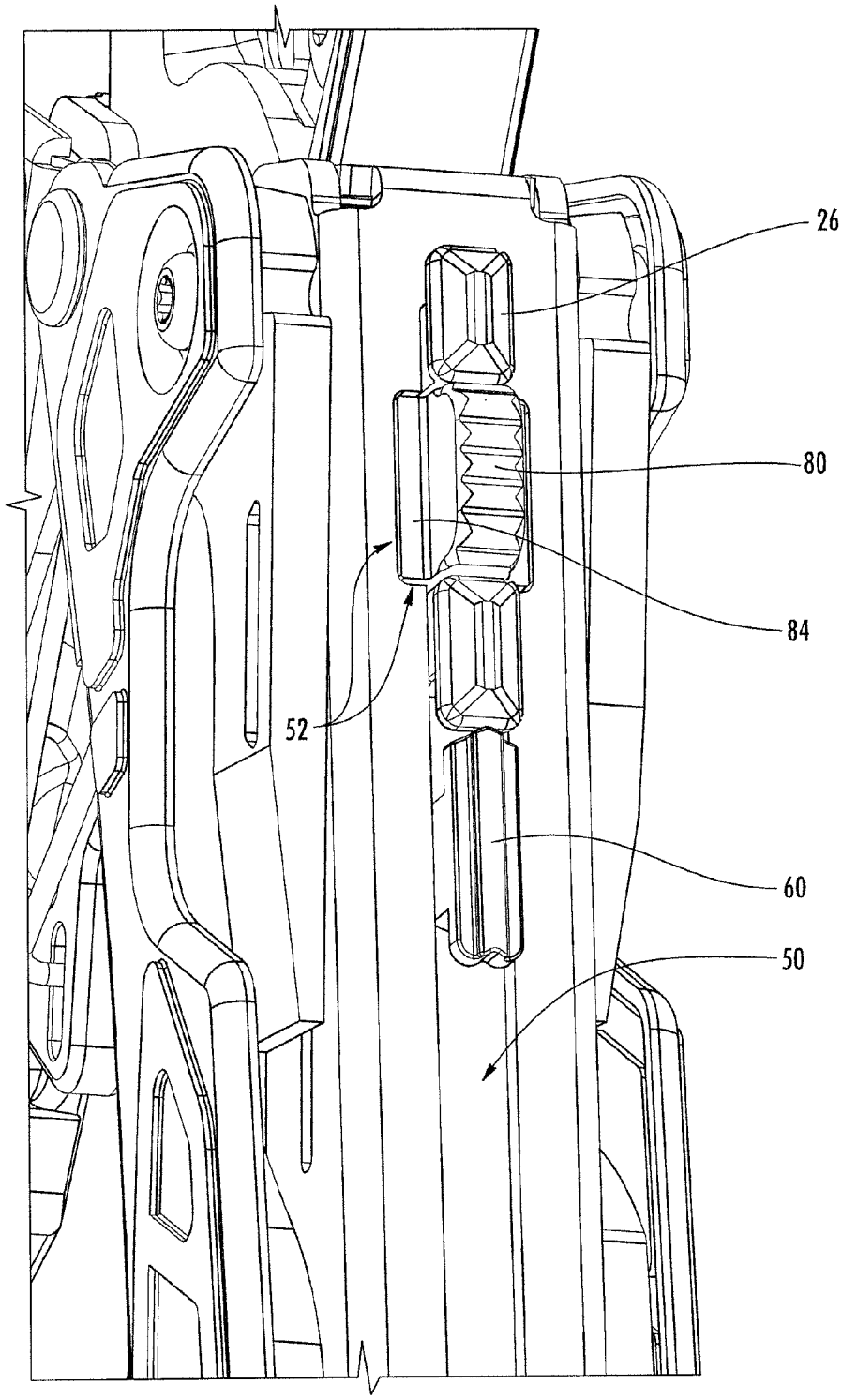
FIG. 9 shows a detail view of the translation assembly of the hand tool shown in FIG. 8A with a clip removed, in accordance with some embodiments discussed herein.
Figure 9A:
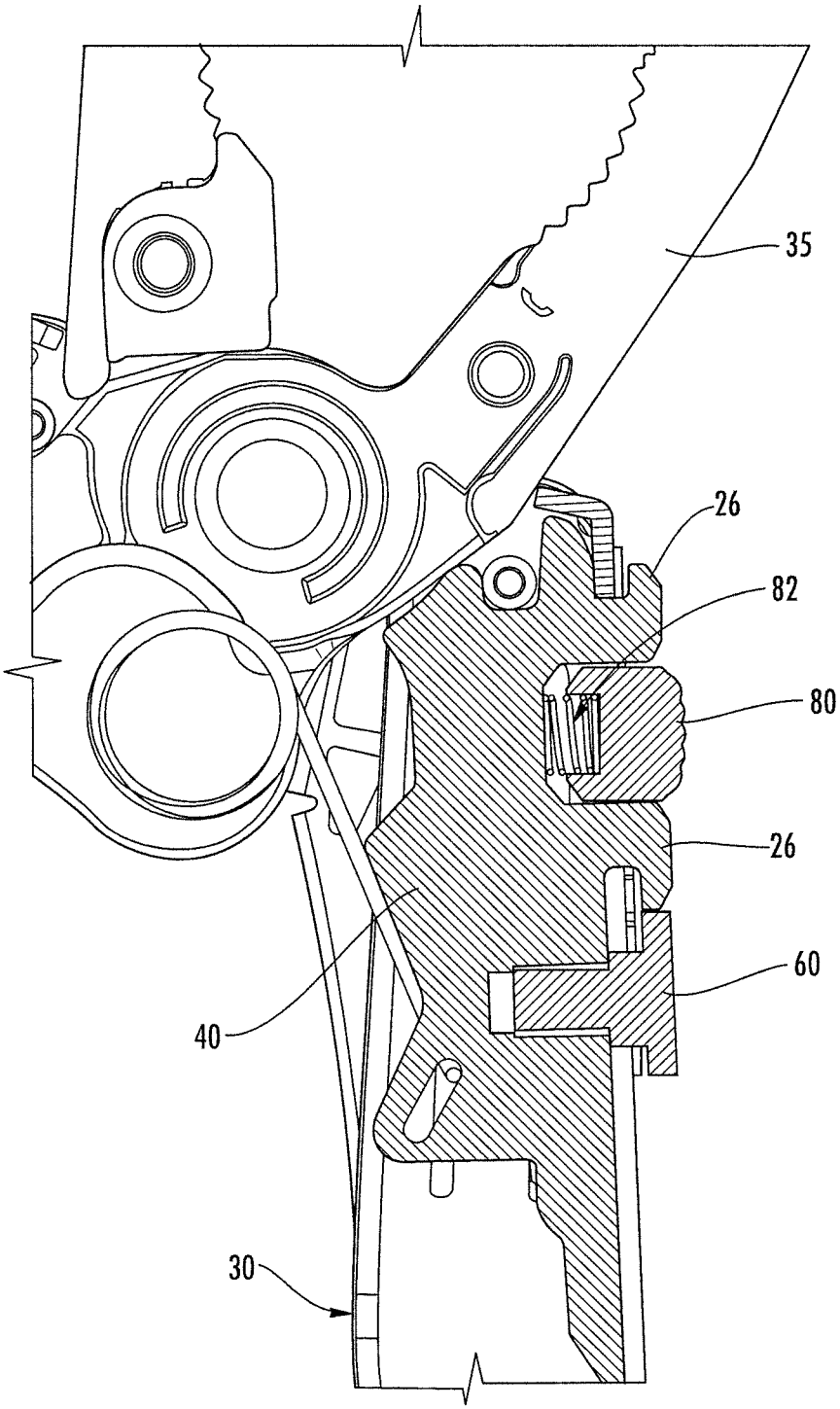
FIG. 9A is a cross-sectional view of the translation assembly of the hand tool shown in FIG. 9 taken along line 9A in FIG. 8, in accordance with some embodiments discussed herein.

With reference to FIG. 9A, the guide member 26 is attached to one of the first or second jaws 25, 35 such as through the slide member 40. In some embodiments, the guide member 26 may be configured to correspond to and fit within the slot 50 such that the guide feature 26 translates with the first or second jaw 25, 35 within the slot 50 between the extended position and the refracted position. For example, with reference to FIG. 12A, the guide member 26 may define a width ($G_W$) configured to fit within and correspond with the width ($S_W$) of the slot 50.

The pressing member 80 may also be configured to correspond to and fit within the slot 50 such that it translates with the first or second jaw 25, 35 within the slot 50 between the extended position and the retracted position. For example, with reference to FIG. 12A, the pressing member 80 may define a width ($PM_W$) configured to fit within and correspond with the width ($S_W$) of the slot 50. In some embodiments, the pressing member 80 may be configured to enable a user to control translation of the translation assembly 48 and, thus, the first and second jaws 25, 35. For example, the pressing member 80 may provide an interface (e.g., a grip) that a user may interact with to control translation of the first and second jaws 25, 35.

In some embodiments, the hand tool 10 may be configured to lock the first and second jaws 25, 35 in the extended position for operation by a user. For example, the hand tool 10 shown in FIGS. 8-9A may be configured to lock into an operation lock position when transitioned to an extended position.

In some embodiments, the pressing member 80 may be configured to facilitate locking of the translation assembly 48 and first and second jaws 25, 35 in the extended position. With reference to FIG. 9, the pressing member 80 may define a tab 84 that corresponds to a tab receiving portion 52 defined within the slot 50. When the tab 84 is received by the tab receiving portion 52 the pressing member 80 may be prevented from translation within the slot 50. In some embodiments, preventing translation of the pressing member 80 also prevents translation of the remaining components (e.g., guide members, locking member, clip) of the translation assembly 48 and, thus, the first and second jaws 25, 35.

Figure 8A:
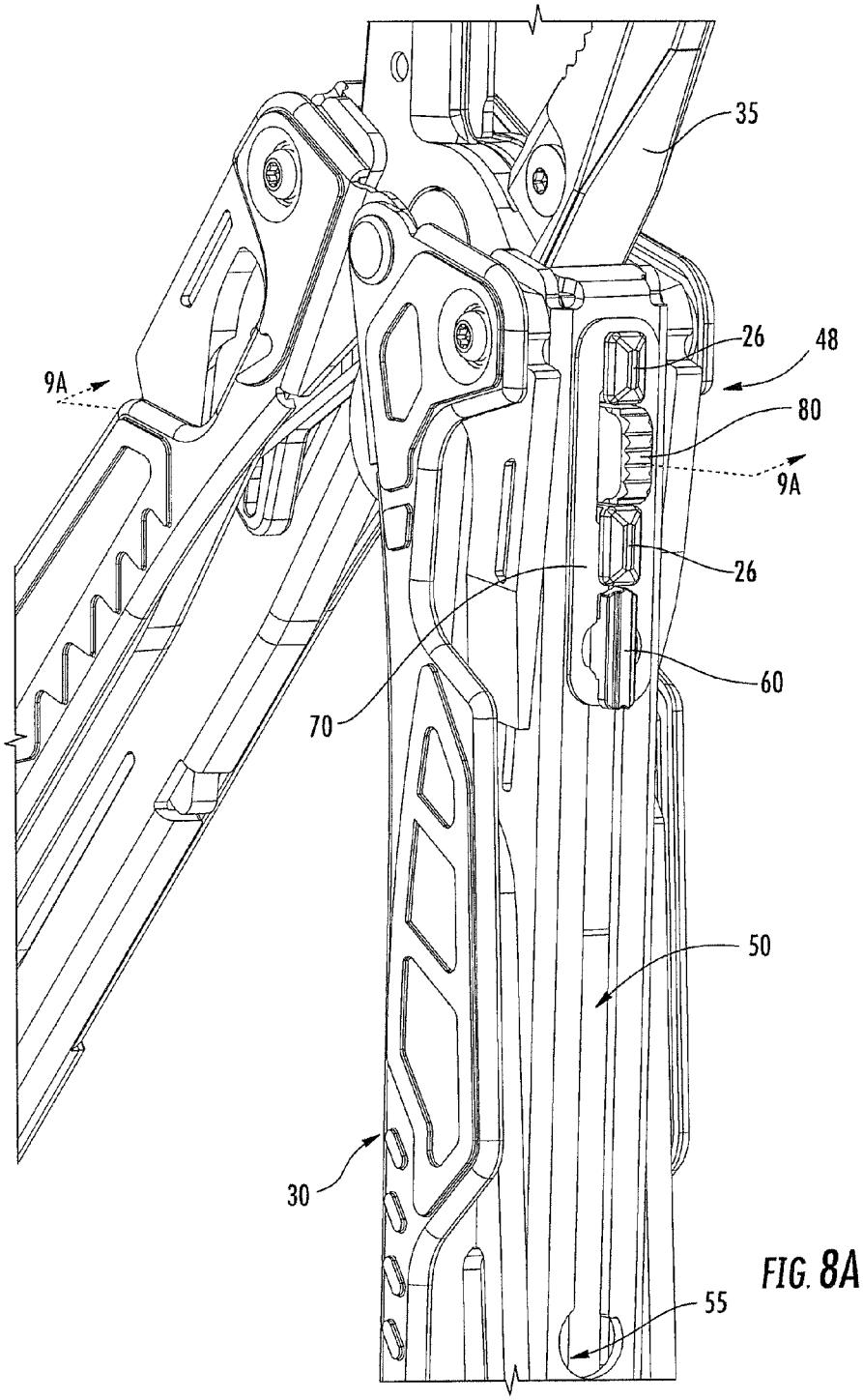
FIG. 8A shows a detail view of a translation assembly of the hand tool shown in FIG. 8, in accordance with some embodiments discussed herein.

With reference to FIG. 9A, in some embodiments, the pressing member 80 may be biased toward the operation lock position (e.g., the tab 84 is biased toward the tab receiving portion 52), such as with a spring 82. Thus, in such embodiments, once the pressing member 80 is moved proximate the tab receiving portion 52, such as in transitioning the first and second jaws 25, 35 to the extended position, the bias of the spring 82 is configured to cause the pressing member 80 to lock the first and second jaws 25, 35 in the operation lock position. As will be described in greater detail herein, the translation assembly 48 may also comprise a clip 70. As shown with reference to FIGS. 8A and 9, the clip 70 may be configured to cover the tab 84 of the pressing member 80 and prevent the bias of the spring 82 from extending the tab 84 upwardly out of the plane of the tab receiving portion 52.

In some embodiments, the pressing member 80 may be configured to enable a user to transition the first and second jaws 25, 35 out of the operation lock position. In particular, once the pressing member 80 is locked such that the tab 84 is received by the tab receiving portion 52, the pressing member 80 can be depressed. Depressing the pressing member 80 against the bias of the spring 82 may move the tab 84 out of the plane of the tab receiving portion 52 and enable free translation of the pressing member 80, translation assembly 48, and first and second jaws 25, 35.

Figure 10:
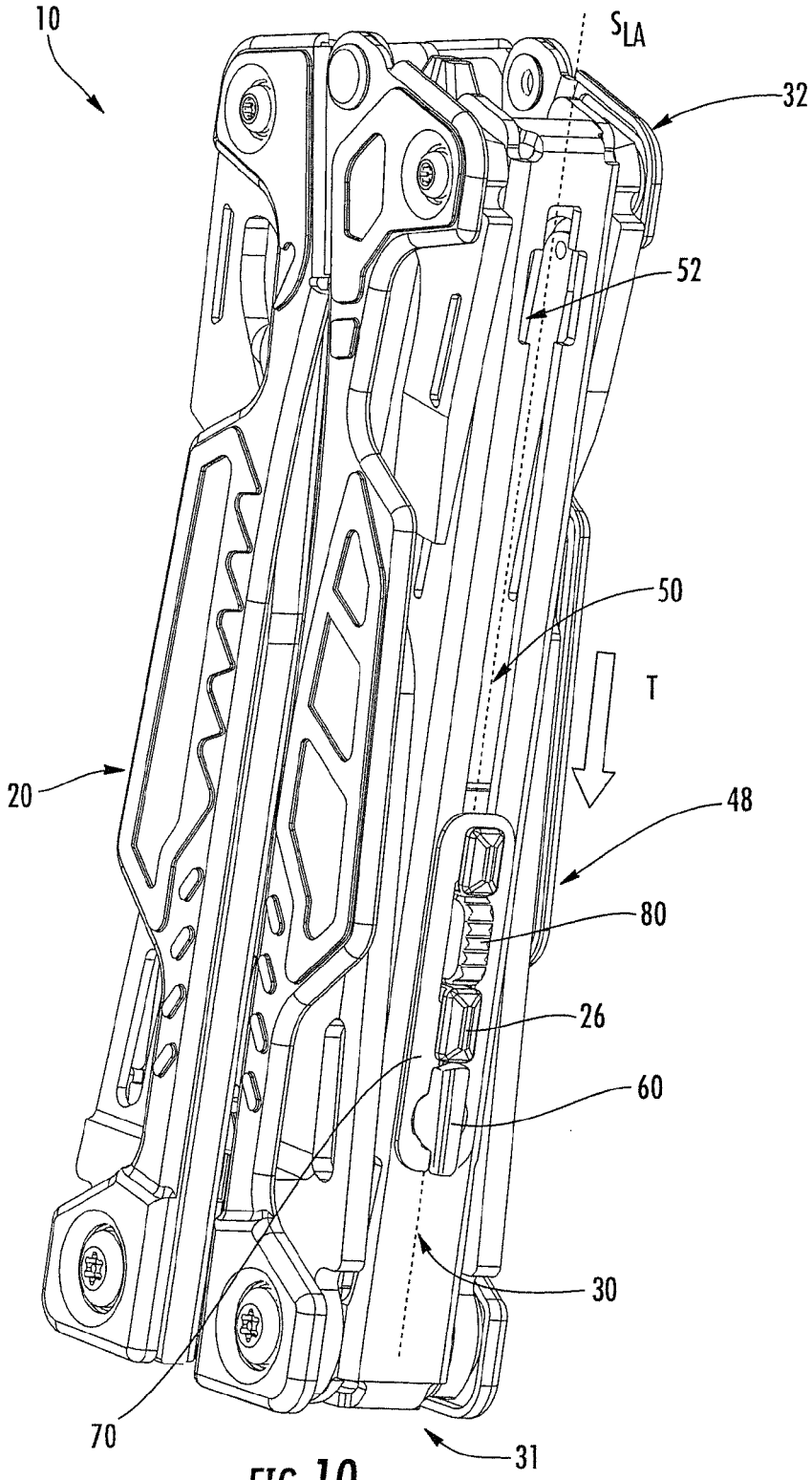
FIG. 10 shows a perspective view of the hand tool shown in FIG. 1, wherein first and second jaws of the hand tool are shown in the retracted position, in accordance with some embodiments discussed herein.

FIG. 10 illustrates transitioning of the first and second jaws 25, 35 from the extended position to the retracted position. To transition the first and second jaws 25, 35 of the hand tool 10 from the extended position to the retracted position, the translation assembly 48 may be translated (e.g., slid) from generally the proximal end 22, 32 of the first or second handle 20, 30 to generally the distal end 21, 31 of the first or second handle 20, 30, such as along the longitudinal axis ($S_{LA}$) of the slot 50 (e.g., along arrow T). In the depicted embodiment, the longitudinal axis ($S_{LA}$) of the slot 50 is parallel to the length of the second handle 30.

In some embodiments, the first and second jaws of the hand tool may be configured to transition to a locked position to prevent translation of the first and second jaws. In some embodiments, the first and second jaws 25, 35 may be configured to transition from the retracted position (shown in FIG. 10) to the locked position (shown in FIG. 15).

In some embodiments, the hand tool 10 may comprise a locking member 60 configured to translate with the first and second jaws 25, 35 within the slot 50. For example, in some embodiments, the locking member 60 may be connected to the first and second jaws 25, 35. Additionally, in some embodiments, the locking member 60 may be configured to translate with the translation assembly 48.

In some embodiments, the locking member 60 may be configured to transition to a locked position to prevent translation of the first and second jaws 25, 35. In some embodiments, the locking member 60 may be configured to rotate within the slot 50 to the locked position. For example, with reference to FIG. 15, when the first and second jaws 25, 35 and translation assembly 48 are disposed in the retracted position, the locking member 60 may be configured to rotate (e.g., along arrow R) within the slot 50 to the locked position.

Figure 12:
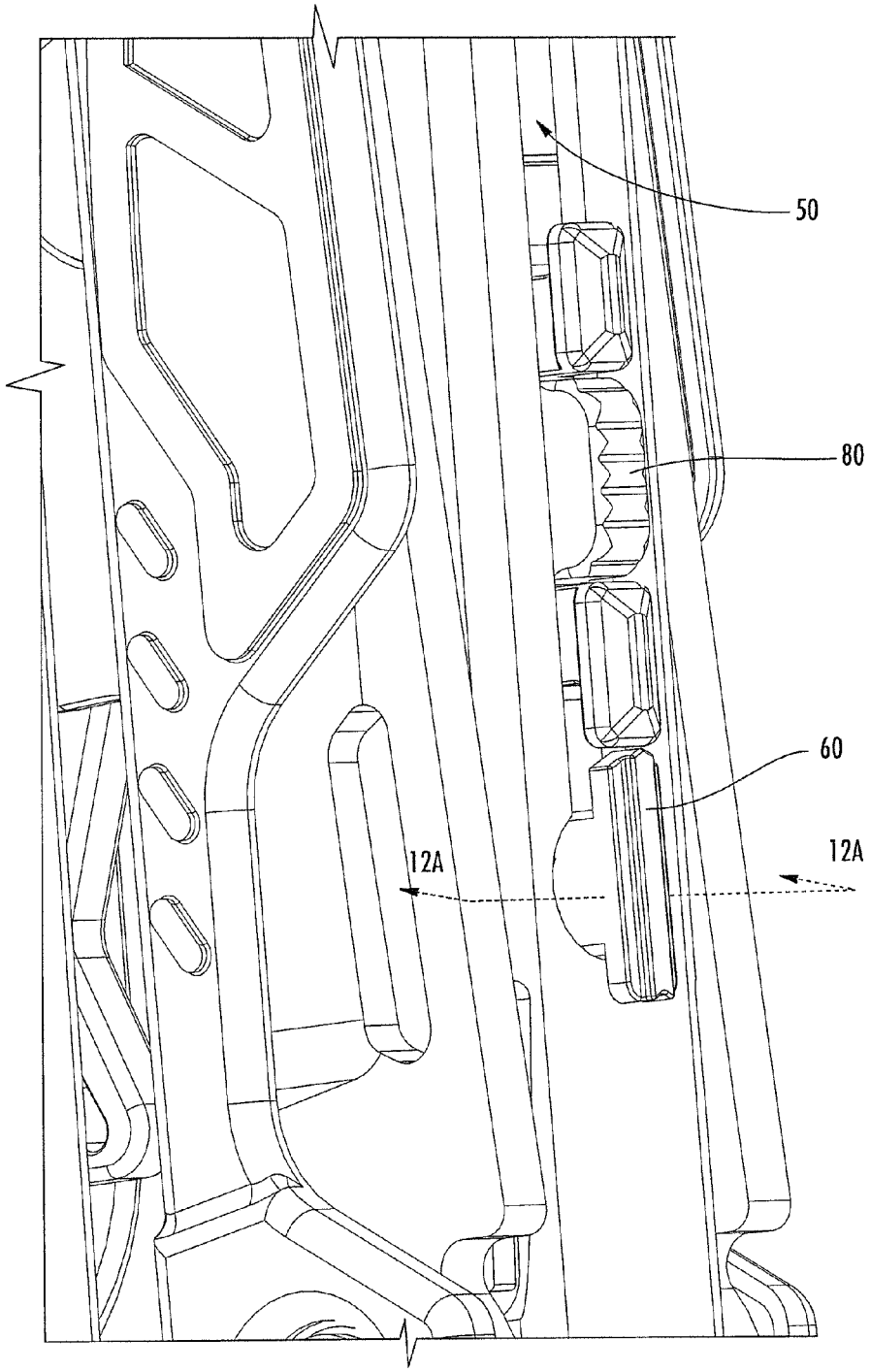
FIG. 12 shows a detail view of the translation assembly of the hand tool shown in FIG. 11 with the clip removed, in accordance with some embodiments discussed herein.
Figure 12A:
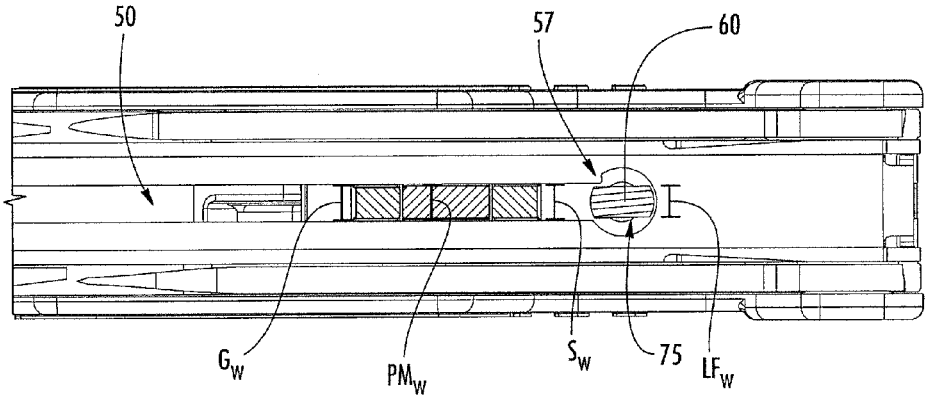
FIG. 12A is a cross-sectional view of the translation assembly of the hand tool shown in FIG. 12 taken along line 12A in FIG. 12, in accordance with some embodiments discussed herein.

To further elaborate, in some embodiments, with reference to FIG. 12A, the locking member 60 may define a width ($LF_W$), which may be configured to correspond with the width ($S_W$) of the slot 50. The locking member 60 may be disposed in an unlocked position when the width ($LF_W$) of the locking member 60 is perpendicular to the longitudinal axis ($S_{LA}$) of the slot 50. In particular, the width ($S_W$) of the slot 50 may be greater than the width ($LF_W$) of the locking member 60 to facilitate translation of the locking member 60 (and translation assembly 48 and first and second jaws 25, 35) when the locking member 60 is in the unlocked position (shown in FIG. 12A).

Figure 17:
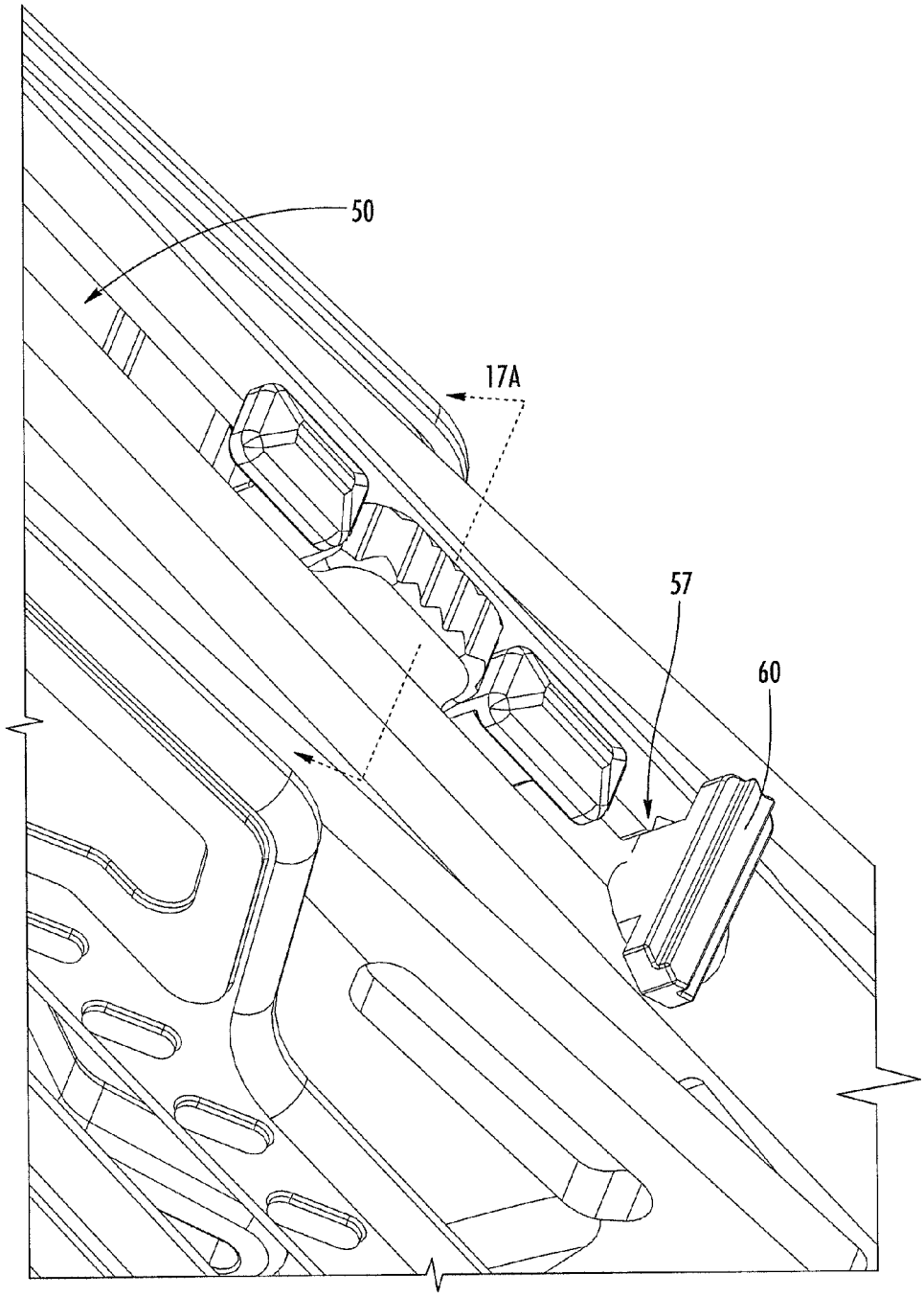
FIG. 17 shows a detail view of the translation assembly of the hand tool shown in FIG. 15 with the clip removed, in accordance with some embodiments discussed herein.
Figure 17A:
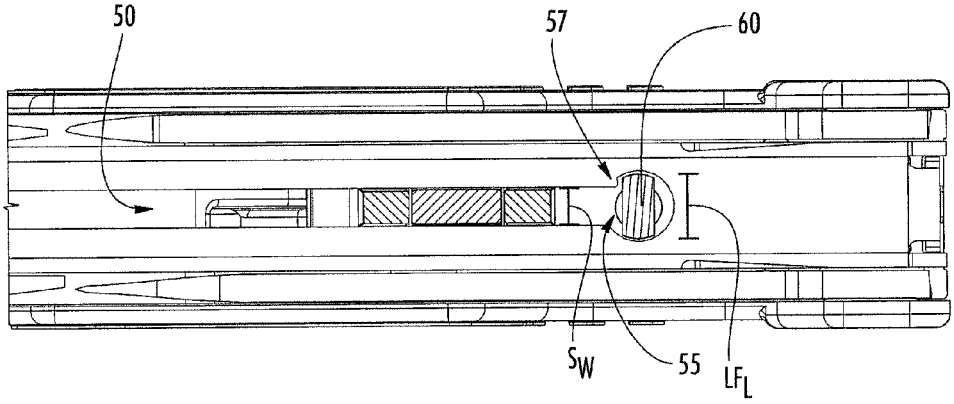
FIG. 17A is a cross-sectional view of the translation assembly of the hand tool shown in FIG. 17 taken along line 17A in FIG. 17, in accordance with some embodiments discussed herein.

Additionally, in some embodiments, with reference to FIG. 17A, the locking member 60 may define a length ($LF_L$). The locking member 60 may be disposed in the locked position when the length ($LF_L$) of the locking member 60 is perpendicular to the longitudinal axis ($S_{LA}$) of the slot 50. Further, the locking member 60 may define a length ($LF_L$) greater than the width ($S_W$) of the slot 50 such that translation of the locking member 60 (and translation assembly 48 and first and second jaws 25, 35) is prevented when the locking member 60 is in the locked position (shown in FIG. 17A).

Figure 14:
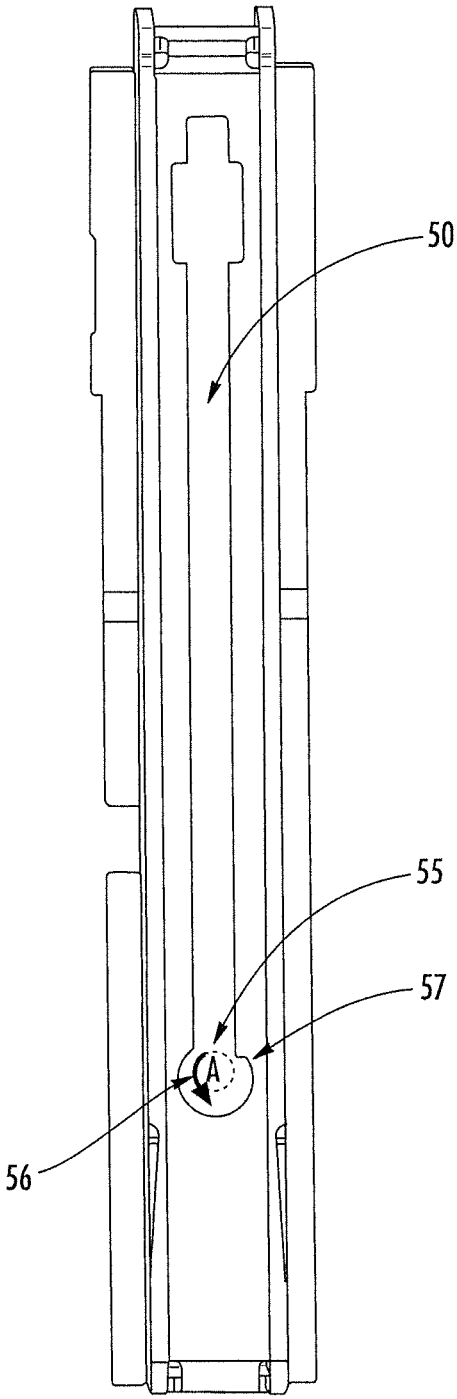
FIG. 14 shows a detail view of the slot of the hand tool shown in FIG. 10, in accordance with some embodiments discussed herein.
Figure 15:
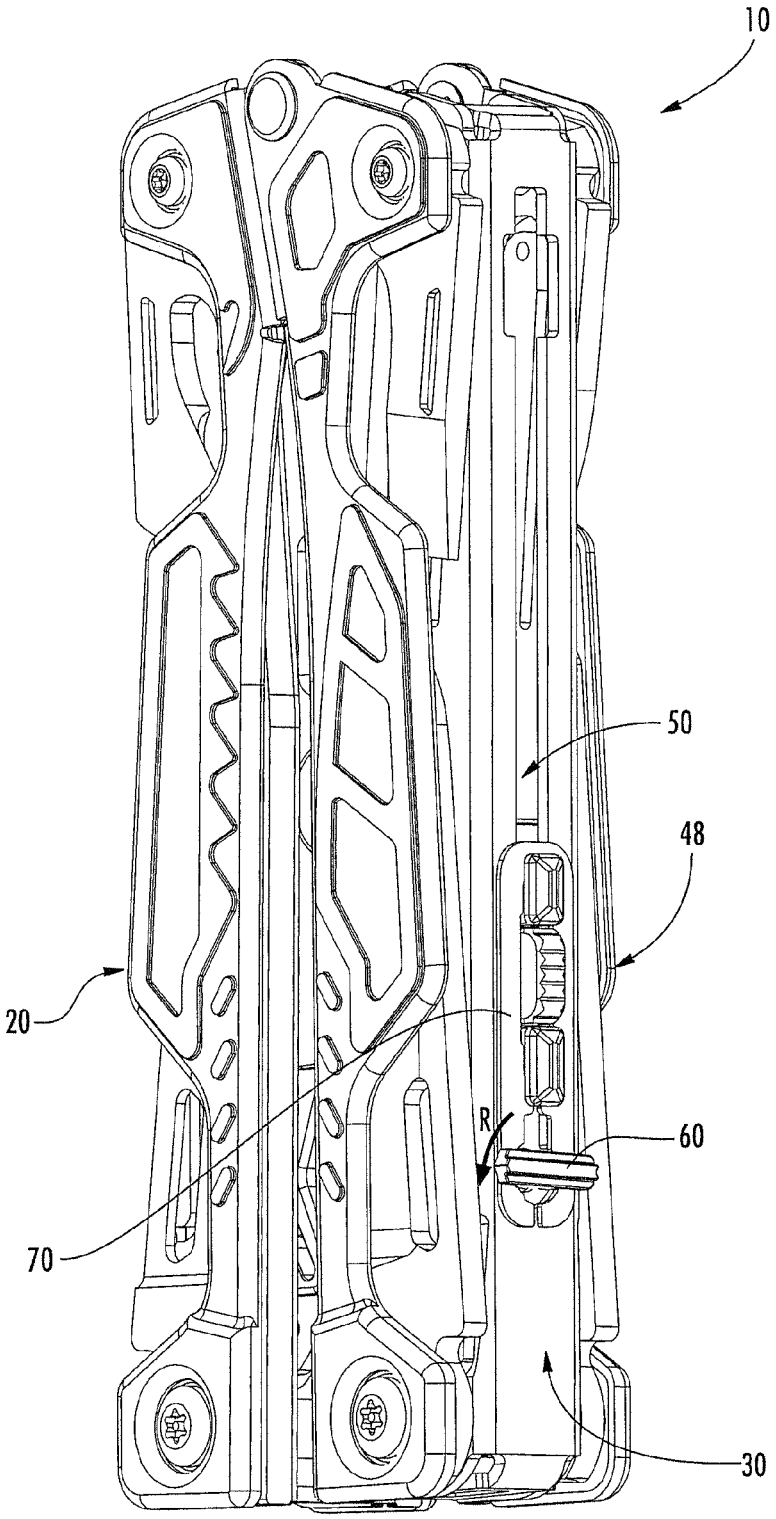
FIG. 15 shows a perspective view of the hand tool shown in FIG. 10, wherein a locking member of the hand tool has been rotated to a locked position, in accordance with some embodiments discussed herein.

With reference to FIG. 14, in some embodiments, to facilitate transition of the locking member 60 from the unlocked position to the locked position, the slot 50 may define a locking portion 55. The locking portion 55 may define a locking track 56 that facilitates rotation of the locking member 60. As shown in FIG. 14, the locking portion 55 may define an asymmetrical shape that enables one-way rotation of the locking member 60, such as along the locking track 56. For example, in the depicted embodiment, the locking portion 55 defines a locking track 56 that enables 90 degrees of rotation of the locking member 60 (e.g., along arrow A) from the unlocked position (FIG. 12A) to the locked position (FIG. 17A). Additionally, the asymmetrical shape of the locking portion 55 may define a notch 57 configured to define the locked position of the locking member 60 such that translation along the slot 50 is prevented when the locking member 60 is positioned in the locked position. For example, in some embodiments, the notch 57 may be configured to abut at least a portion of the length ($LF_L$) of the locking member 60 when the locking member 60 is disposed in the locked position (shown in FIG. 17). With the locking member 60 disposed in the locked position, with the length ($LF_L$) of the locking member 60 perpendicular to the longitudinal axis ($S_{LA}$) of the slot 50, translation of the locking member 60 (and, thus, translation assembly 48 and first and second jaws 25, 35) is prevented. Though the locking portion 55 of the slot 50 defines a locking track 56 that enables 90 degree rotation of the locking member 60, embodiments of the present invention contemplate other configurations for transitioning the locking member 60 to the locked position (e.g., 45 degrees, 180 degrees, 270 degrees, etc.).

In some embodiments, the hand tool 10 may comprise a clip 70 configured to at least partially surround the locking member 60. In some embodiments, with reference to FIG. 11, the clip 70 may be configured to at least partially surround the locking member 60, pressing member 80, and guide members 26. The clip 70 may be configured to translate with the locking member 60 (and translation assembly 48 and first and second jaws 25, 35) between the extended position and the refracted position.

Figure 13:
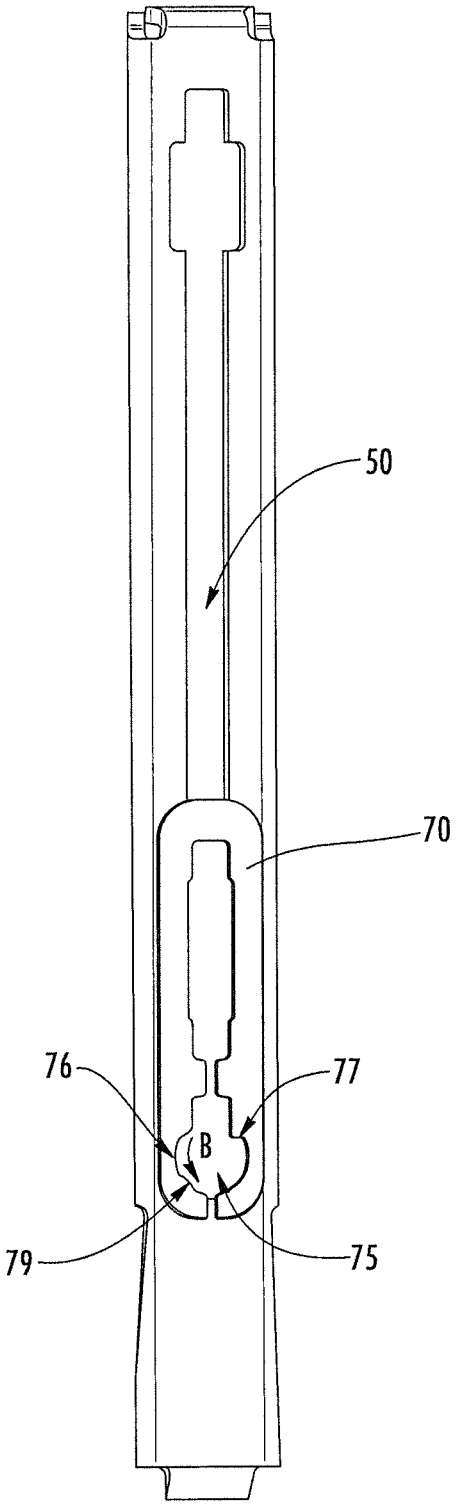
FIG. 13 shows a detail view of a slot and the clip of the hand tool shown in FIG. 10, in accordance with some embodiments discussed herein.
Figure 13A:
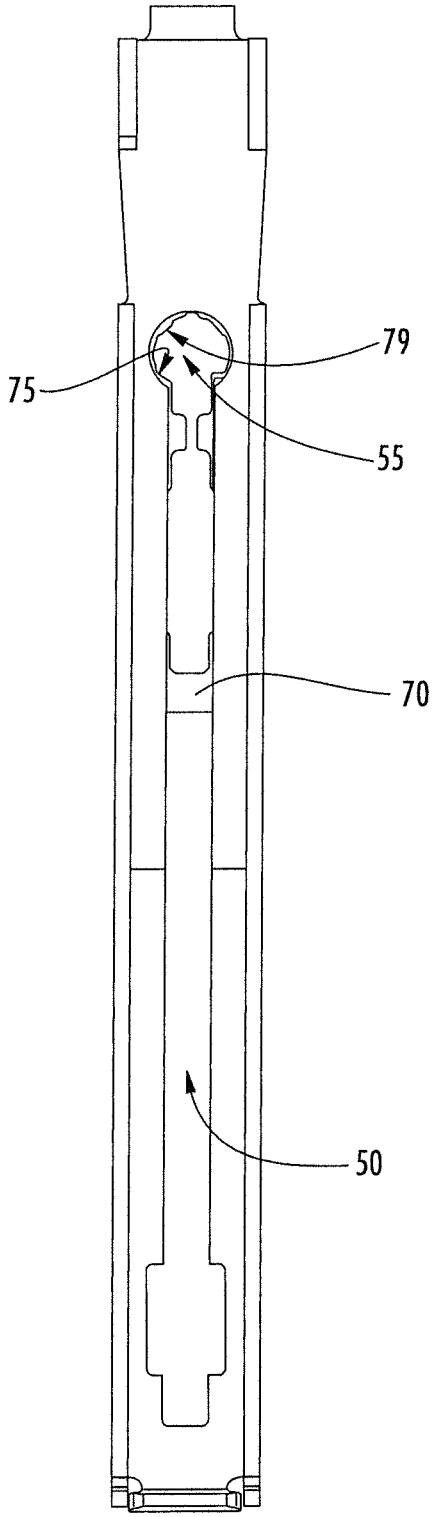
FIG. 13A shows a rear detail view of the slot and the clip shown in FIG. 13, in accordance with some embodiments discussed herein.
Figure 16:
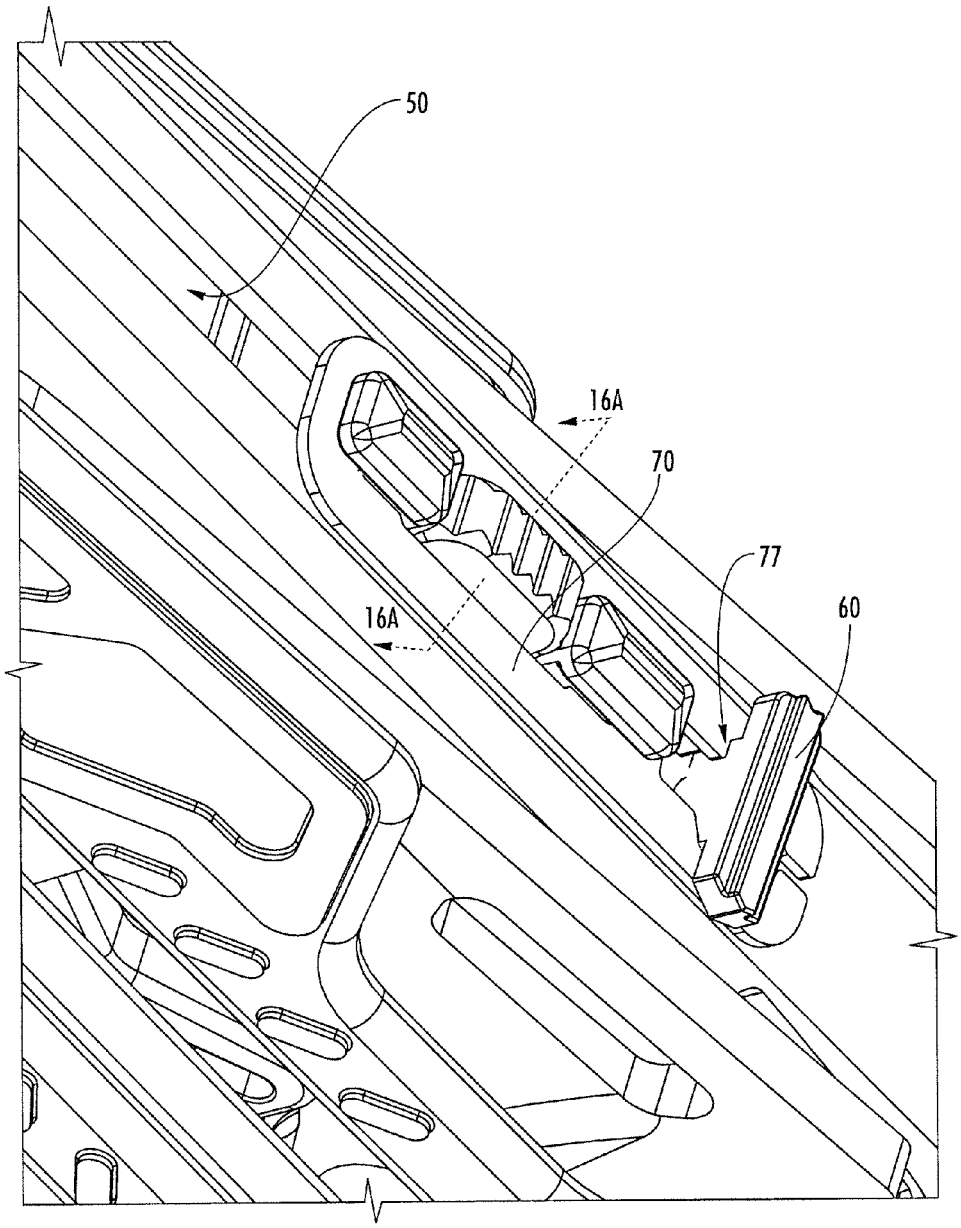
FIG. 16 shows a detail view of the translation assembly of the hand tool shown in FIG. 15, in accordance with some embodiments discussed herein.
Figure 16A:
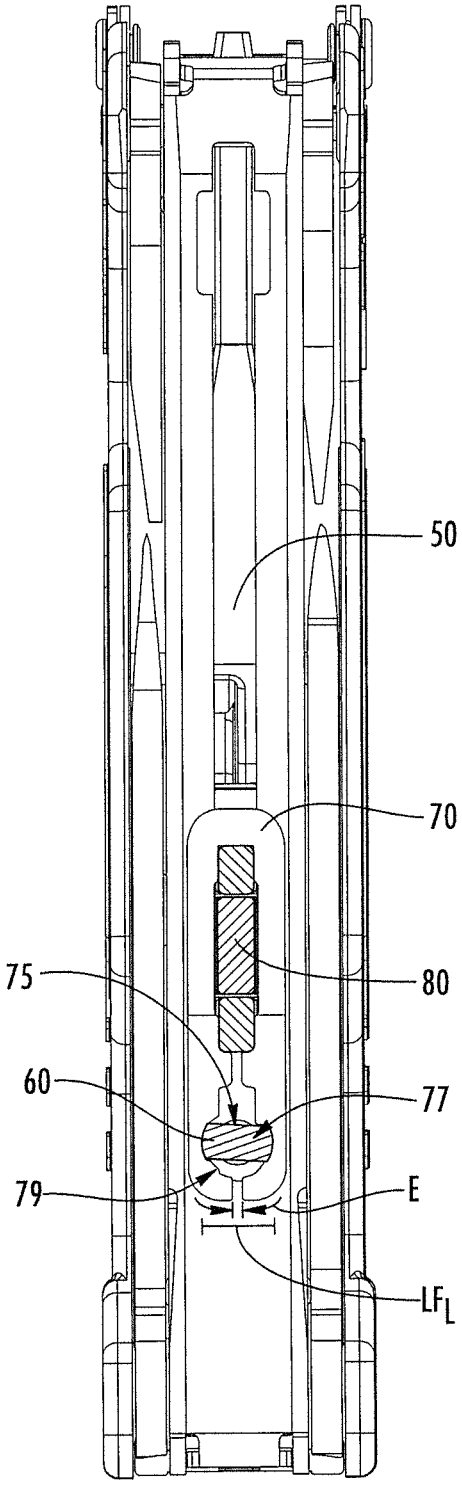
FIG. 16A is a cross-sectional view of the translation assembly of the hand tool shown in FIG. 16 taken along line 16A in FIG. 16, in accordance with some embodiments discussed herein.

With reference to FIG. 13, in some embodiments, to facilitate transition of the locking member 60 from the unlocked position to the locked position, the clip 70 may define a clip locking portion 75. In some embodiments, the clip locking portion 75 may be configured to align with the locking portion 55 of the slot 50 so as to allow rotation of the locking member 60 from the unlocked position to the locked position. The clip locking portion 75 may define a clip locking track 76 that facilitates rotation of the locking member 60. As shown in FIG. 13, the clip locking portion 75 may define an asymmetrical shape that enables one-way rotation of the locking member 60, such as along the clip locking track 76. For example, in the depicted embodiment, the clip locking portion 75 defines a clip locking track 76 that enables 90 degrees of rotation of the locking member 60 (e.g., along arrow B) from the unlocked position (FIG. 11A) to the locked position (FIG. 16A). Additionally, the asymmetrical shape of the clip locking portion 75 may define a notch 77 configured to define the locked position of the locking member 60 such that translation along the slot 50 is prevented when the locking member 60 is positioned in the locked position. For example, in some embodiments, the notch 77 may be configured to abut at least a portion of the length ($LF_L$) of the locking member 60 when the locking member 60 is disposed in the locked position (shown in FIG. 16). With the locking member 60 disposed in the locked position, with the length ($LF_L$) of the locking member 60 perpendicular to the longitudinal axis ($S_{LA}$) of the slot 50, translation of the locking member 60 (and, thus, translation assembly 48 and first and second jaws 25, 35) is prevented. Though the clip locking portion 75 of the clip 70 defines a clip locking track 76 that enables 90 degree rotation of the locking member 60, embodiments of the present invention contemplate other configurations for transitioning the locking member 60 to the locked position (e.g., 45 degrees, 180 degrees, 270 degrees, etc.).

Figure 11:
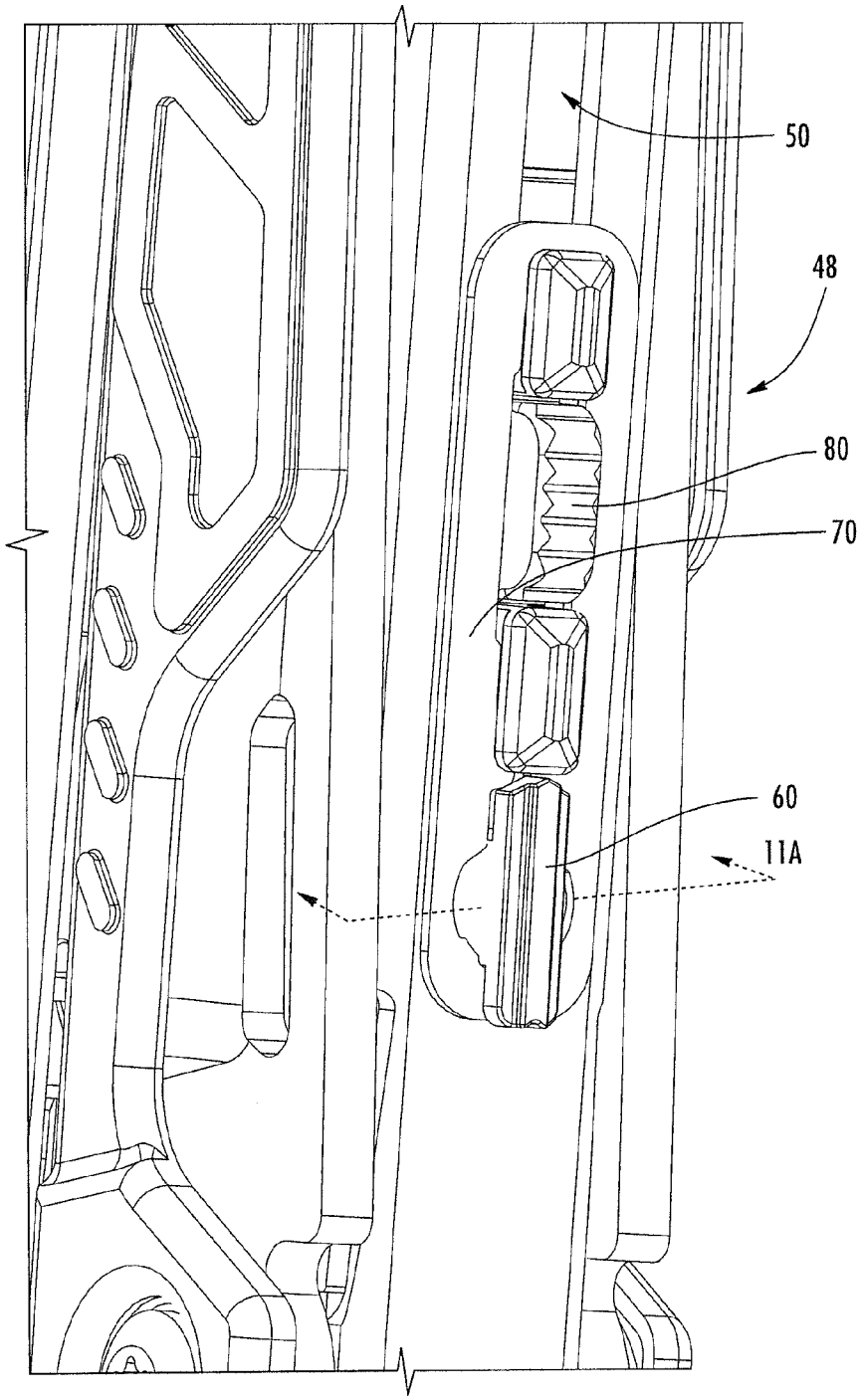
FIG. 11 shows a detail view of the translation assembly of the hand tool shown in FIG. 10, in accordance with some embodiments discussed herein.
Figure 11A:
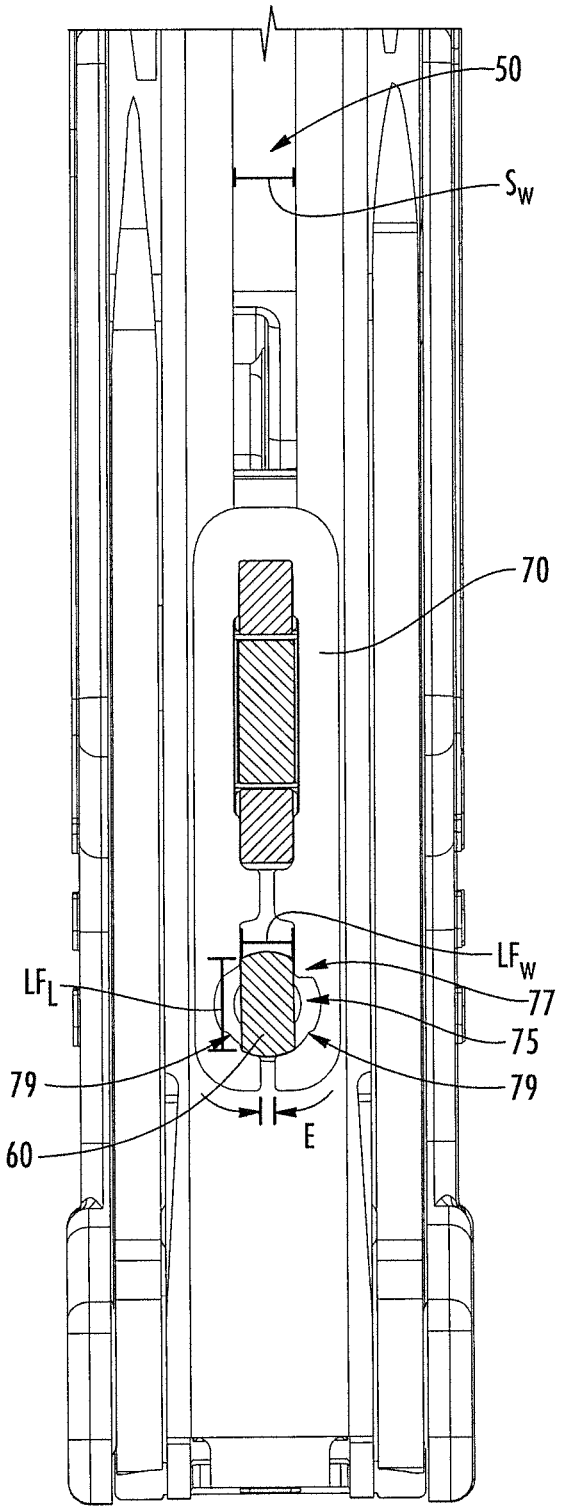
FIG. 11A is a cross-sectional view of the translation assembly of the hand tool shown in FIG. 11 taken along line 11A in FIG. 11, in accordance with some embodiments discussed herein.

In some embodiments, the clip 70 may be biased to surround the locking member 60 such that the locking member 60 is biased toward the locked position when disposed in the locked position (shown in FIG. 16A) and such that the locking member 60 is biased toward the unlocked position when disposed in the unlocked position (shown in FIG. 11A). Said differently, the clip 70 may be biased to resist rotation of the locking member 60 between the unlocked position and the locked position. For example, with reference to FIGS. 13 and 14, in some embodiments, the clip 70 may define a clip locking track 76 that is smaller in diameter than the locking track 56 of the slot 50. The clip locking track 76 may also define a diameter that is at least slightly smaller than the length ($LF_L$) of the locking member 60. Additionally, the clip 70 may also be configured to bias toward surrounding the locking member 60, such as shown by arrow E in FIG. 16A. In such a manner, the clip locking portion 75 may be configured to resist rotation of the locking member 60 out of the locked position or out of the unlocked position.

To further elaborate, with reference to FIG. 11A, the locking member 60 may be disposed in the unlocked position. The clip 70 may surround the locking member 60 and be defined such that the clip locking portion 55 defines the smallest diameter. As the locking member 60 is rotated (e.g., counterclockwise in FIG. 11A), the clip locking portion 55 will expand to make room for the length ($LF_L$) of the locking member 60. In particular, the clip 70 may diverge against its bias (e.g., opposite arrow E) causing the clip locking portion 75 to define a larger diameter. In some embodiments, the clip locking portion 75 may define its largest diameter when the locking member 60 has been rotated approximately 45 degrees (not shown) which is about half way between the unlocked position and locked position. Then, as the locking member 60 is further rotated past 45 degrees (e.g., toward the locked position shown in FIG. 16A), the clip 70 converges around the locking member 60 due to the bias. Thus, when the locking member 60 reaches the locked position, the clip locking portion 75 may define a similar diameter to the diameter defined by the clip locking portion 75 when the locking member 60 was disposed in the unlocked position (shown in FIG. 11A). As such, the clip 70 is biased to keep the locking member 60 in the locked position when the locking member 60 is disposed in the locked position and the clip 70 is also biased to keep the locking member 60 in the unlocked position when the locking member 60 is in the unlocked position.

Additionally or alternatively, with reference to FIG. 13, the clip locking portion 75 may define at least one indent 79 configured to at least partially abut a portion of the length ($LF_L$) of the locking member 60 to resist rotation. For example, when the locking member 60 is disposed in the unlocked position (shown in FIG. 11A), the indent 79 may slightly protrude from the clip locking track 76 and slightly abut a side of the locking member 60, thereby resisting rotation of the locking member 60 out of the unlocked position. Likewise, when the locking member 60 is disposed in the locked position (shown in FIG. 16A), the indent 79 may be configured to slightly protrude from the clip locking track 76 and slightly abut the opposite side of the locking member 60, thereby resisting rotation of the locking member 60 out of the locked position.

Figure 18:
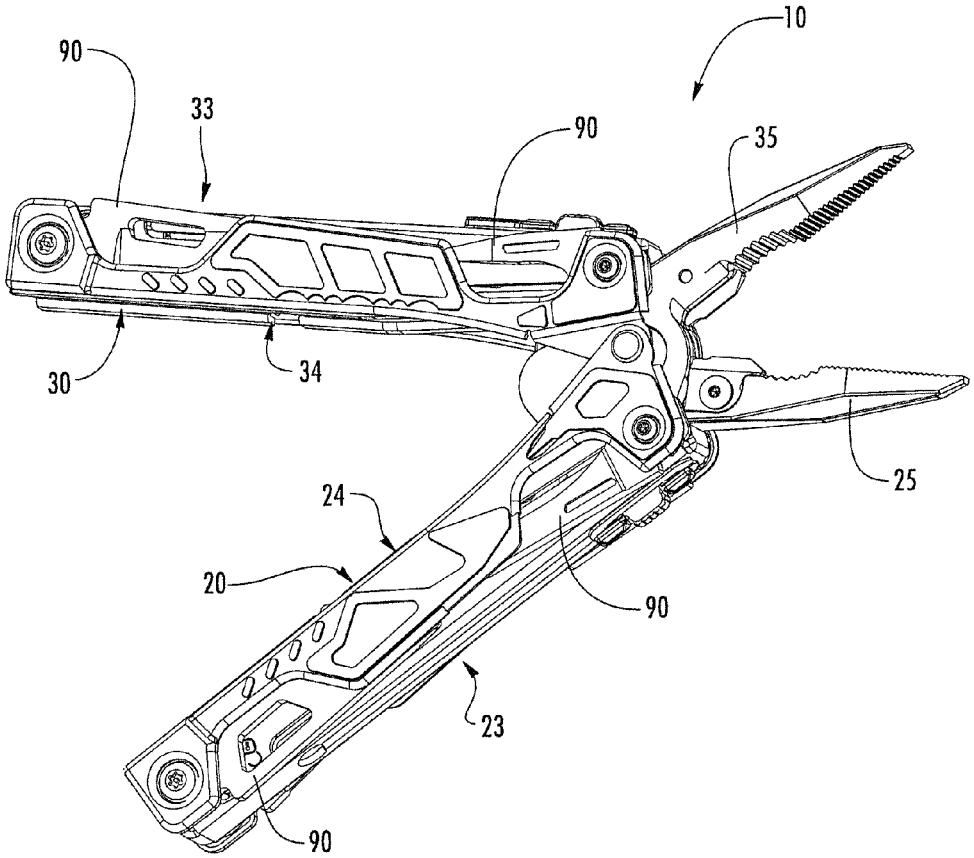
FIG. 18 shows a perspective view of the hand tool shown in FIG. 1, wherein first and second jaws of the hand tool are shown in the extended position, in accordance with some embodiments discussed herein.
Figure 19:
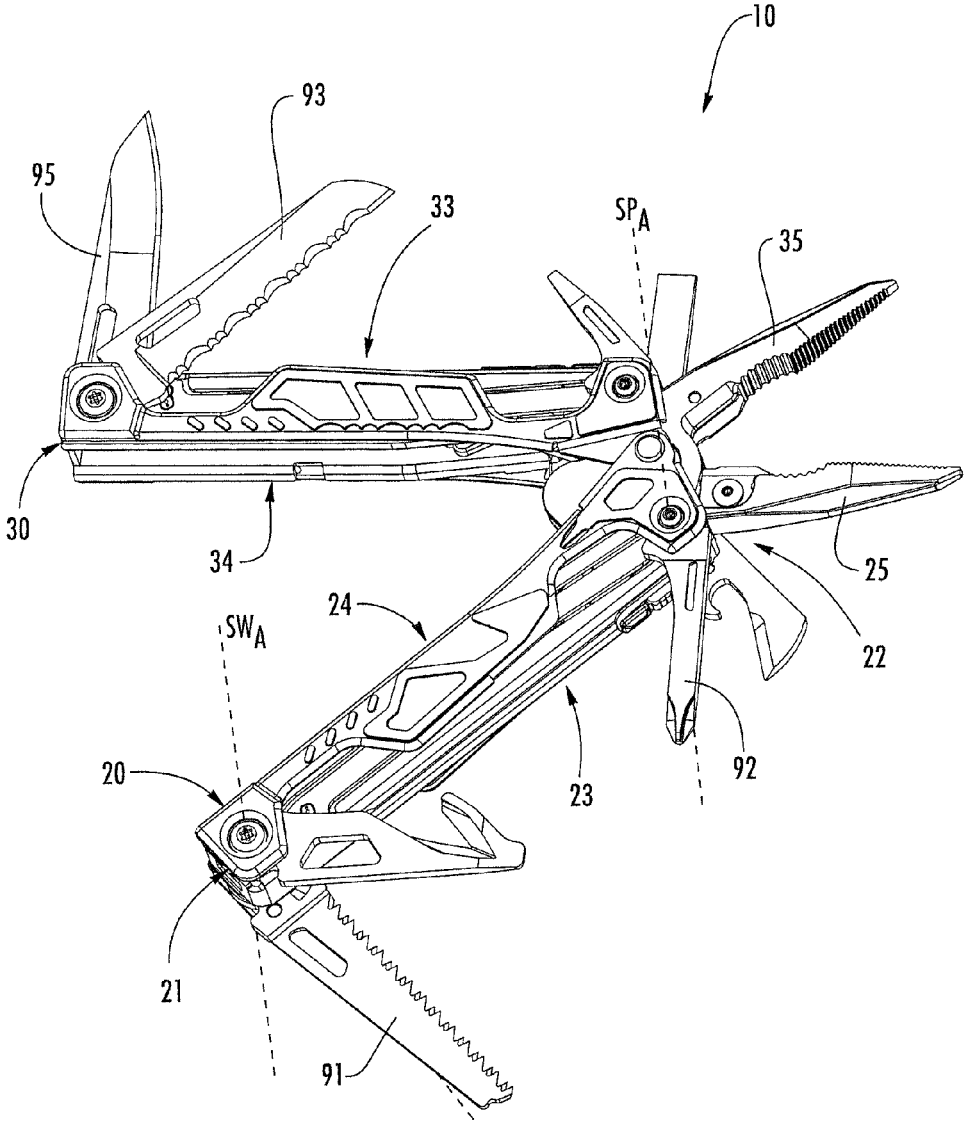
FIG. 19 shows a perspective view of the hand tool shown in FIG. 18, wherein a plurality of tool members are deployed, in accordance with some embodiments discussed herein.
Figure 20:
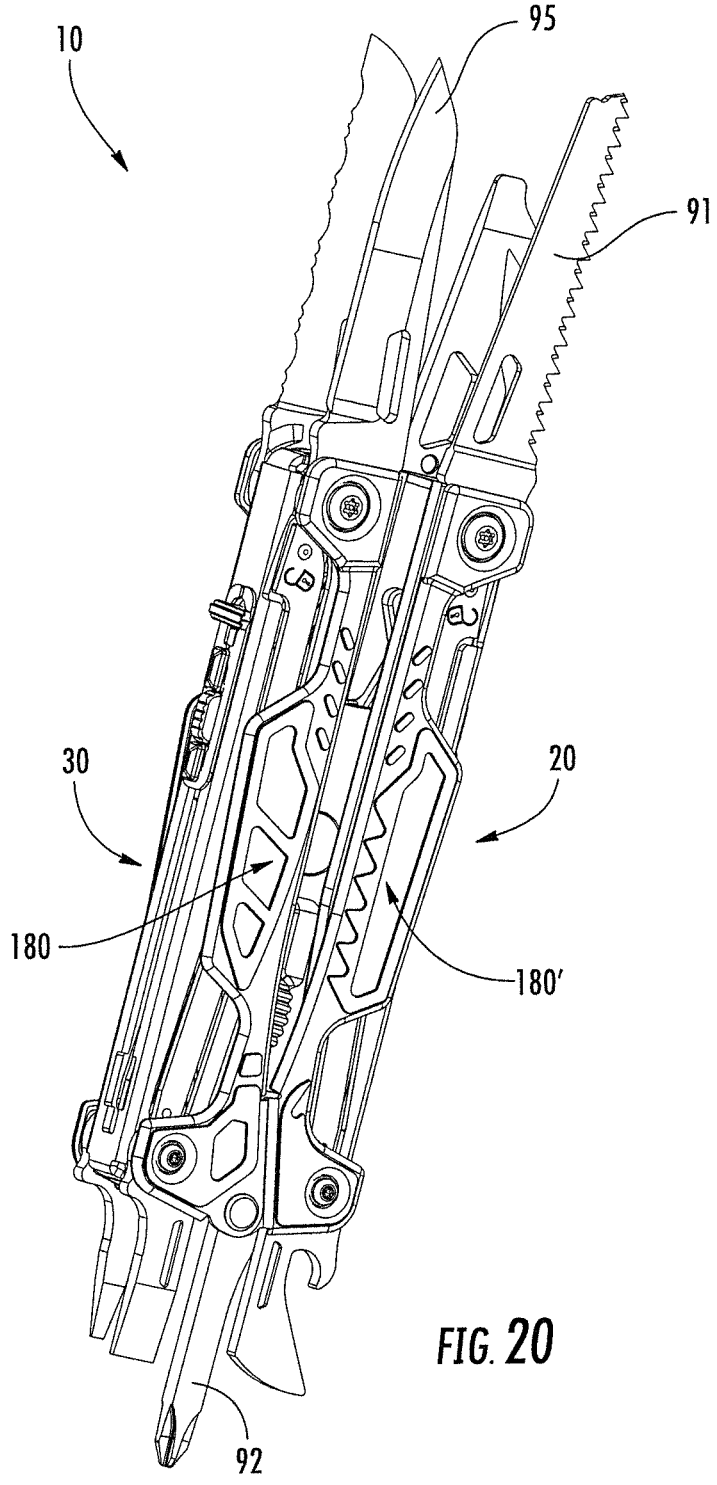
FIG. 20 shows a perspective view of the hand tool shown in FIG. 10, wherein first and second jaws of the hand tool are shown in the refracted position, wherein a plurality of tool members are deployed, in accordance with some embodiments discussed herein.

In some embodiments, the hand tool 10 may include a plurality of tool members (e.g., the hand tool may be a multipurpose tool). FIGS. 18-20 illustrate an example embodiment of a hand tool 10 with first and second jaws 25, 35 and a variety of other tool members 90 (e.g., saw 91, screw driver 92, serrated knife 93, knife 95, etc.). Each tool member 90 may be carried by one of the first or second handles 20, 30 and be configured to fold (e.g., rotate) into or out of the respective first or second handle 20, 30 to facilitate operation of the tool member 90. Additionally, in some embodiments, each of the tool members 90 may be deployed (e.g., in an open position) while the first and second jaws 25, 35 are in either the extended position (shown in FIG. 19) or the retracted position (shown in FIG. 20). Though the depicted embodiment of the hand tool 10 includes first and second jaws 25, 35 that are configured to translate between an extended position and a retracted position, embodiments of the present invention described herein with respect to foldable (or rotatable) tool members may be useable in any type of hand tool and are not limited to a hand tool with extendable and retractable first and second jaws. Likewise, embodiments of the present invention described herein with respect to foldable (or rotatable) tool members may be useable with a hand tool with any number of handles (e.g., one handle).

Some embodiments of the present invention may provide a hand tool with easier access to the variety of tool members. For example, with reference to FIG. 19, the first and second handles 20, 30 may each define an external side 23, 33 and an internal side 24, 34. Additionally, the internal side 24 of the first handle 20 may be configured to face the internal side 34 of the second handle 30. In some embodiments, each of the plurality of tool members 90 may be configured to fold into and out of the external side 23, 33 of the respective first or second handles 20, 30. Said differently, in some embodiments, none of the plurality of tool members may be disposed on either of the internal sides 24, 34 of the first or second handles 20, 30 so as to provide easy access each of the available tool members 90.

Some embodiments of the present invention may provide a hand tool with first and second jaws configured to extend and retract within the first and second handle and with a plurality of tool members that are configured to fold into and out of both ends (e.g., distal and proximal) of the first and second handles. In some embodiments, each of the plurality of tool members may be configured to rotate into and out of the respective one of the first or second handles. For example, with reference to FIG. 19, the saw 91 may be configured to rotate into and out of the first handle 20 around axis ($SW_A$), which is proximate to the distal end 21 of the first handle 20. Thus, in some embodiments, at least one of the tool members may be rotatable around an axis of the first or second handle defined proximate the distal end of the respective first or second handle. Additionally, in some embodiments, at least another one tool members may be rotatable around an axis of the first or second handle defined proximate the proximal end of the respective first or second handle. For example, the screw driver 92 may be configured to rotate into and out of the first handle 20 around axis ($SD_A$), which is proximate to the proximal end 22 of the first handle 20. As noted above, in some embodiments, some of the plurality of tool members may be configured to rotate into and out of the second handle 30, such as proximate the distal or proximal end 31, 32 of the second handle 30. To access a tool member 90 that is stored within a handle, a user may engage the tool member 90 and may unfold the tool member 90 such that the tool member 90 is operational. While the tool member 90 is stowed within the first or second handle 20, 30, it may be difficult for a user to determine which tool member 90 they intend to unfold and use. As such, with reference to FIG. 20, in some embodiments, each tool member may include a designation 180 on the first or second handle 20, 30 that identifies the respective tool member 90. For example, the designation 180 on the second handle 30 may indicate that a knife 95 is configured to be stowed underneath. Likewise, the designation 180' on the first handle 20 may indicate that a serrated knife 91 is configured to be stowed underneath. Although the icon or other designation may be applied in various manners, the icon or other designation may be molded, etched or otherwise formed into the tool member, such as along the spline of the tool.

As noted above, example embodiments of the present invention may provide a hand tool configured to facilitate access to at least one tool member. Additionally, some embodiments of the present invention provide improved features for securing at least one tool member. FIGS. 21-26A illustrate an example embodiment of a hand tool with at least one tool member configured with an improved storage feature. As is consistent with the disclosure herein, embodiments of the present invention contemplate use of the improved storage feature with other embodiments described herein (e.g., embodiments of the present invention as described with respect to FIGS. 1-20 and 27-29). Moreover, while the depicted embodiment includes features previously described, embodiments of the present invention contemplate use of the improved storage feature with other types of hand tools or tools with foldable tool members.

Some embodiments of the present invention provide a hand tool configured to carry and provide access to at least one tool member. In some embodiments, the hand tool may comprise at least one handle defining a pocket with opposing sidewalls and a floor. For example, with reference to FIG. 21, the second handle 30 of the hand tool 10 defines a pocket 110. The pocket 110 defines opposing sidewalls 110*a*, 110*b* and a floor 110*c*.

Figure 26:
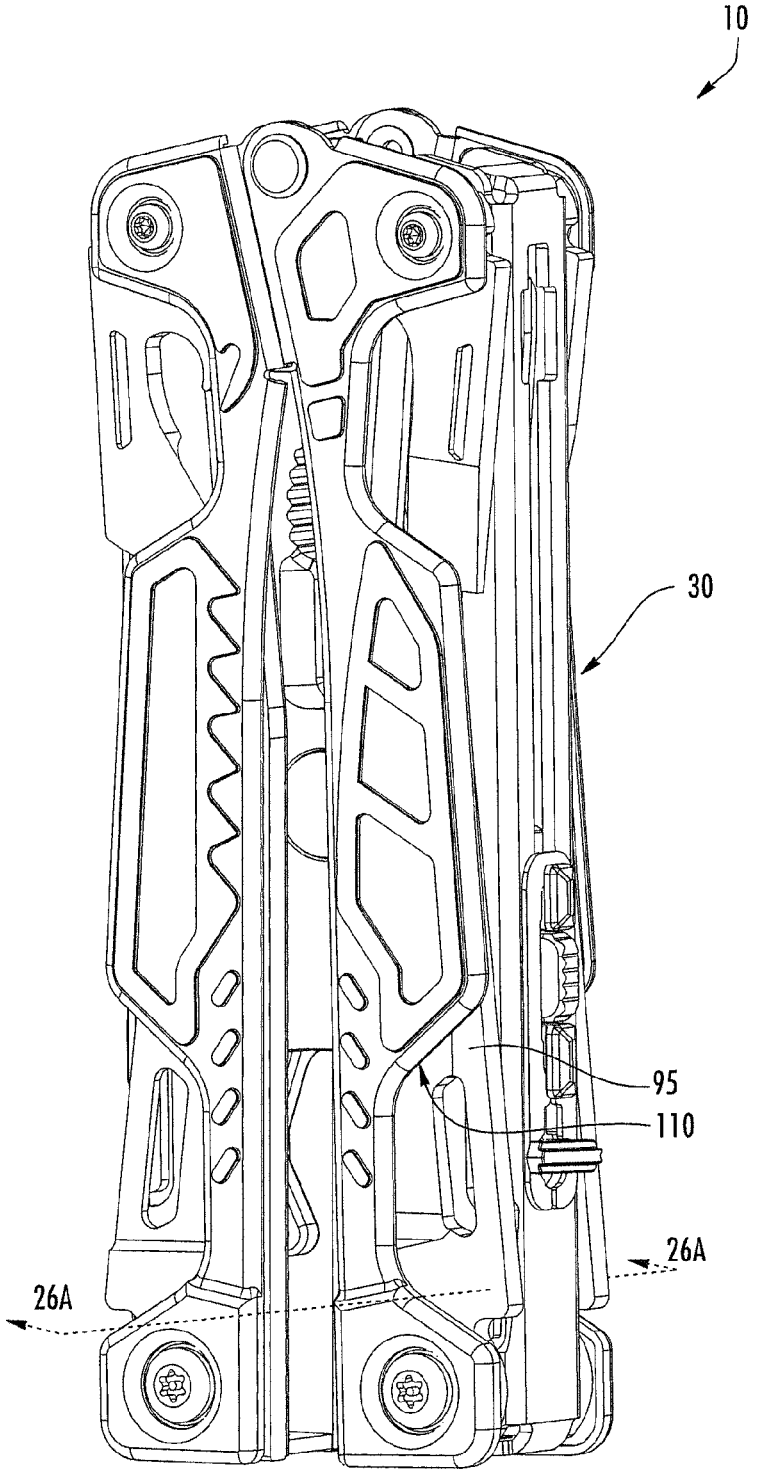
Figure 26A:
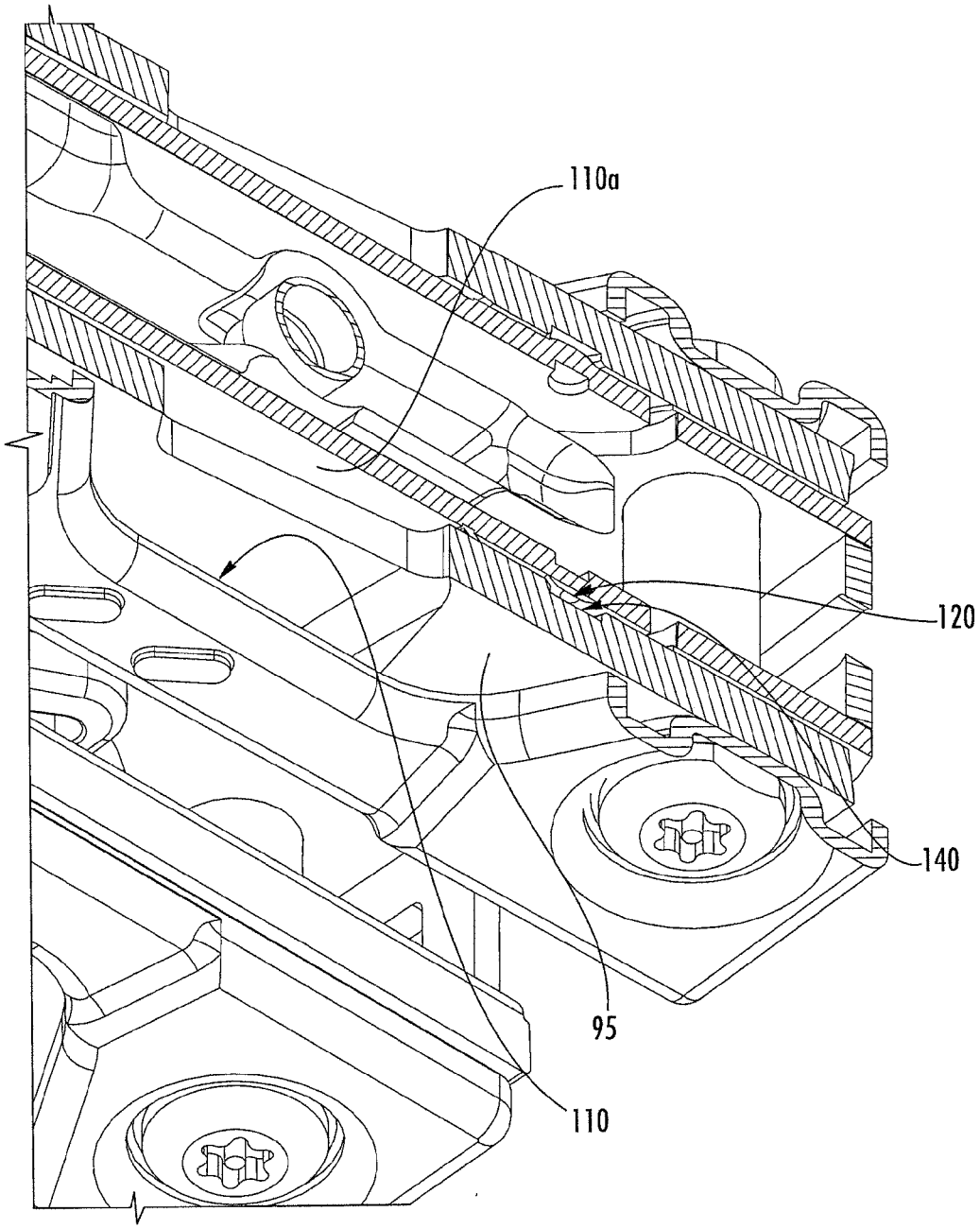

In some embodiments, the hand tool may also comprise at least one tool member carried by the at least one handle and configured to rotate between an open position and a stowed position. For example, the hand tool 10 comprises a knife 95 carried by the second handle 30 and configured to rotate along the axis ($R_A$) between an open position (FIG. 21) and a stowed position (FIG. 26). In some embodiments, the at least one tool member defines a first surface and a second surface, and the at least one tool member is configured to rotate into the pocket of the at least one handle with the second surface disposed proximate the floor of the pocket to define the stowed position. Thus, in the depicted embodiment, the knife 95 defines a first surface 108 and a second surface 105. The knife 95 is configured to rotate into the pocket 110 such that the second surface 105 rests proximate the floor 110*c* in the stowed position.

As safety is important for tools, it may be desirable to include a securing feature that resists rotation of the tool member from the stowed position to the open position. As such, in some embodiments, a protrusion may be provided on the tool member or one of the sidewalls of the pocket. The protrusion is configured to engage with a recess defined on the corresponding opposite surface (e.g., sidewall of the pocket or tool member, respectively) when the tool member is in the stowed position. Such engagement provides resistance when the tool member is rotated out of the stowed position to prevent accidental deployment of the tool member. Although the described sidewall may be depicted as an integral portion of the handle, embodiments of the present invention contemplate other surfaces, such as a non-integral surface (e.g., an insert), that may employ similar features (e.g., protrusion, recess, ramp, etc.).

Figure 21:
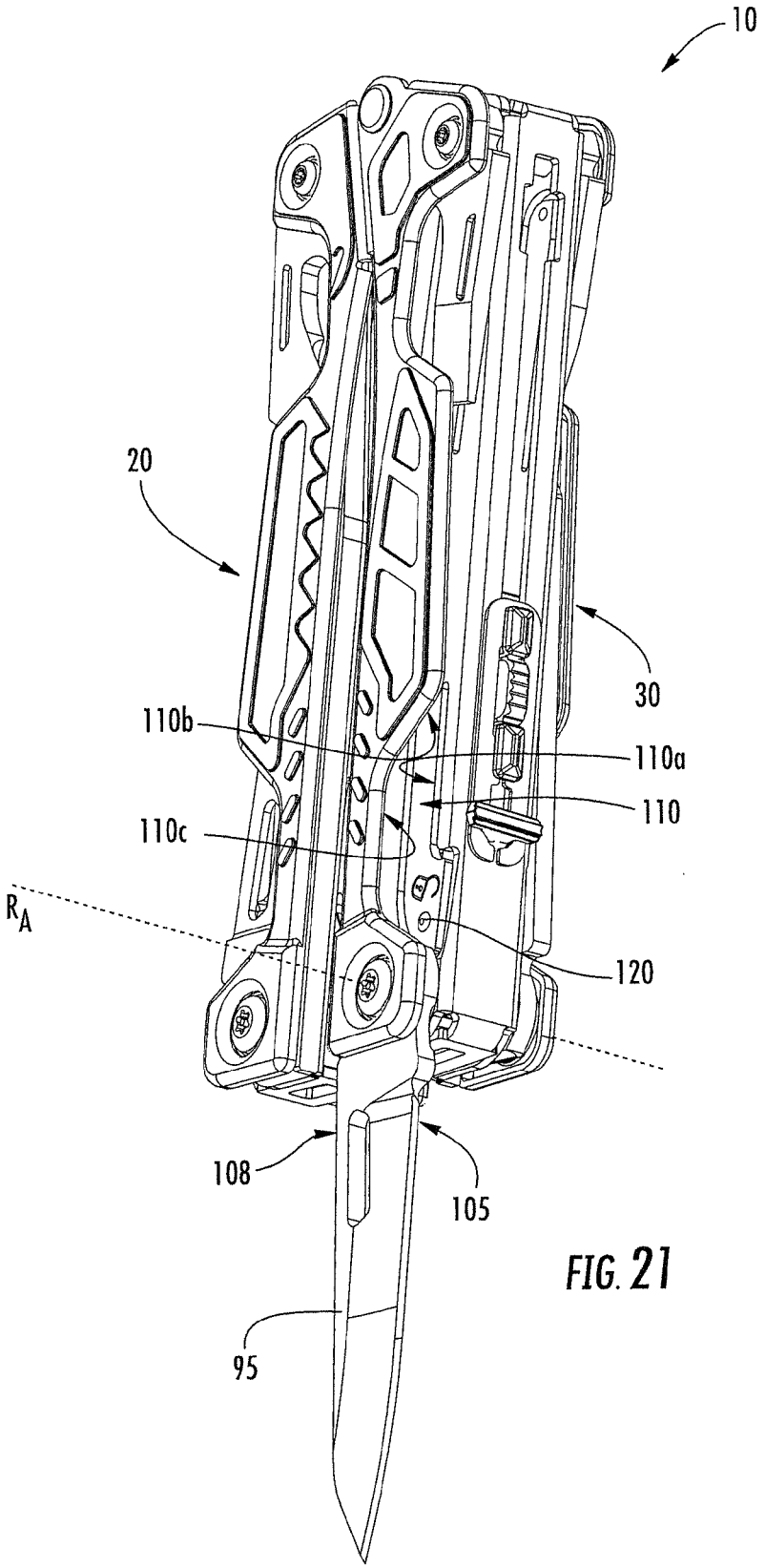
FIG. 21 shows a perspective view of the hand tool shown in FIG. 10, wherein a knife has been deployed to the open position, in accordance with some embodiments discussed herein.

With reference to FIG. 21, in some embodiments, a sidewall 110*a* of the pocket may define a protrusion 120. The protrusion 120 may be configured to engage with a recess 140 defined on the knife 95 (shown in FIG. 22) when the knife 95 is in the stowed position (shown in FIG. 26). As can be seen from the cross-sectional view of FIG. 26A, the protrusion 120 on the sidewall 110*a* may be configured to fit within the recess 140 of the knife 95 when the knife 95 is disposed in the stowed position.

In some embodiments, the protrusion may be biased toward the recess to resist rotation of the tool member from the stowed position to the open position when the protrusion is engaged with the recess. For example, with reference to FIG. 21, the sidewall 110*a* (and, thus, the protrusion 120) may be biased toward the opposing sidewall 110*b*. Therefore, with reference to FIG. 26A, once the protrusion 120 is engaged with the recess 140, the bias further resists rotation of the knife 95 out of the stowed position.

Rotating the tool member from the stowed position to the open position may require some additional force to overcome the engagement of the protrusion and recess, especially considering the potential bias of the protrusion toward the recess. This same bias may also effect rotating of the tool member back into the stowed position. For example, as the tool member is rotated into the stowed position, the leading surface (e.g., second surface 105) may hit the protrusion. Providing enough force overcomes the bias of the protrusion toward the tool member, thereby allowing the tool member to rotate fully into the stowed position. However, this interaction between the leading surface and the protrusion may lead to undesirable wear, particularly considering how often the tool member may be opened and closed. As such, embodiments of the present invention provide a storage feature for improved storage of the tool member. Such a storage feature may be configured to reduce friction between the protrusion and the tool member during rotation of the tool member into the stowed position.

To ease the rotation of the tool member into the stowed position, some embodiments of the present invention provide a ramp leading from the second surface toward the recess. In some embodiments, the ramp defines an upward slope leading from the second surface of the at least one tool member toward the recess. For example, with reference to FIG. 22, the knife 95 defines a ramp 130 leading from the second surface 105 toward the recess 140. With reference to FIG. 23, the ramp 130 defines an upward slope 132 leading from a point 134 on the second surface 105 to a point 136 on the knife 95 in a path leading toward the recess 140.

Figure 24:
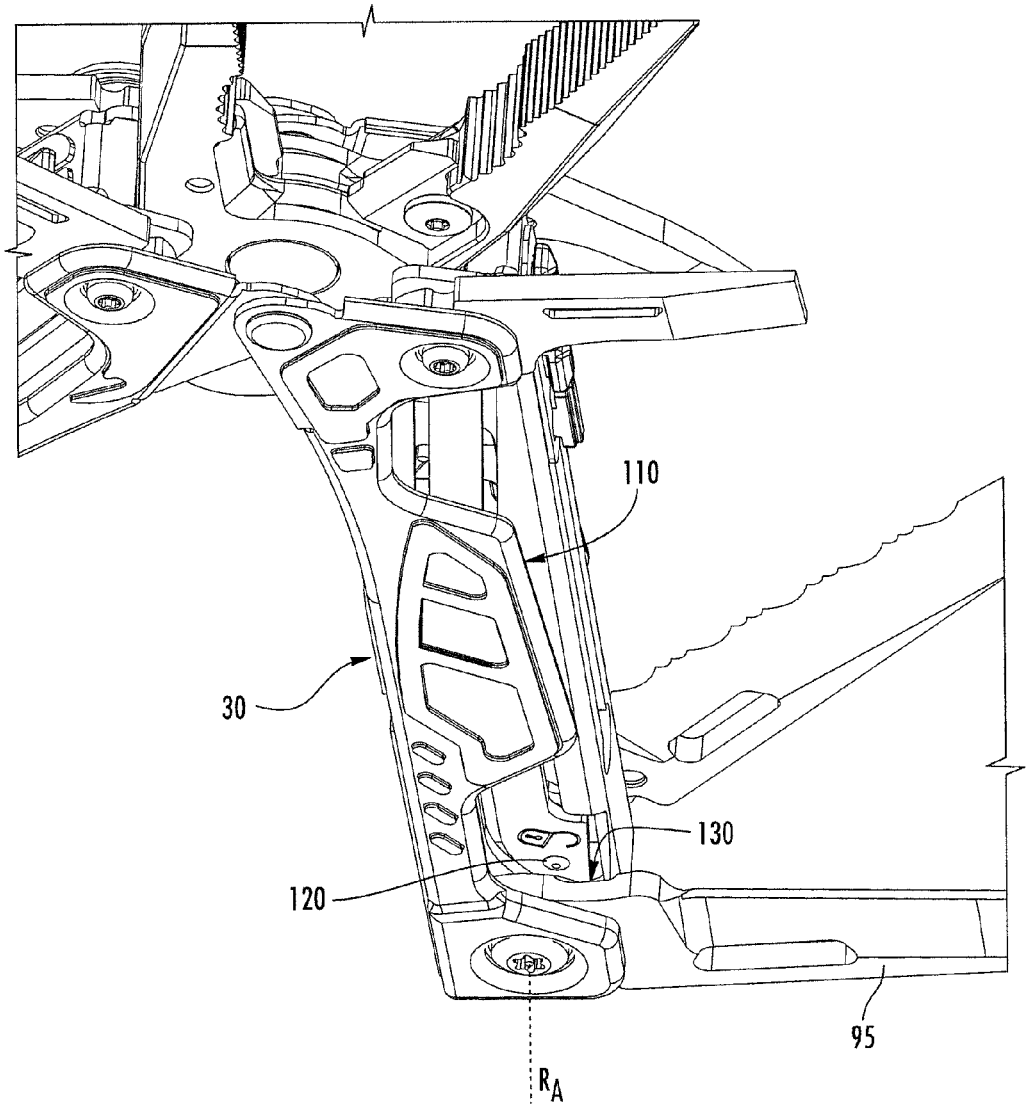
Figure 24A:
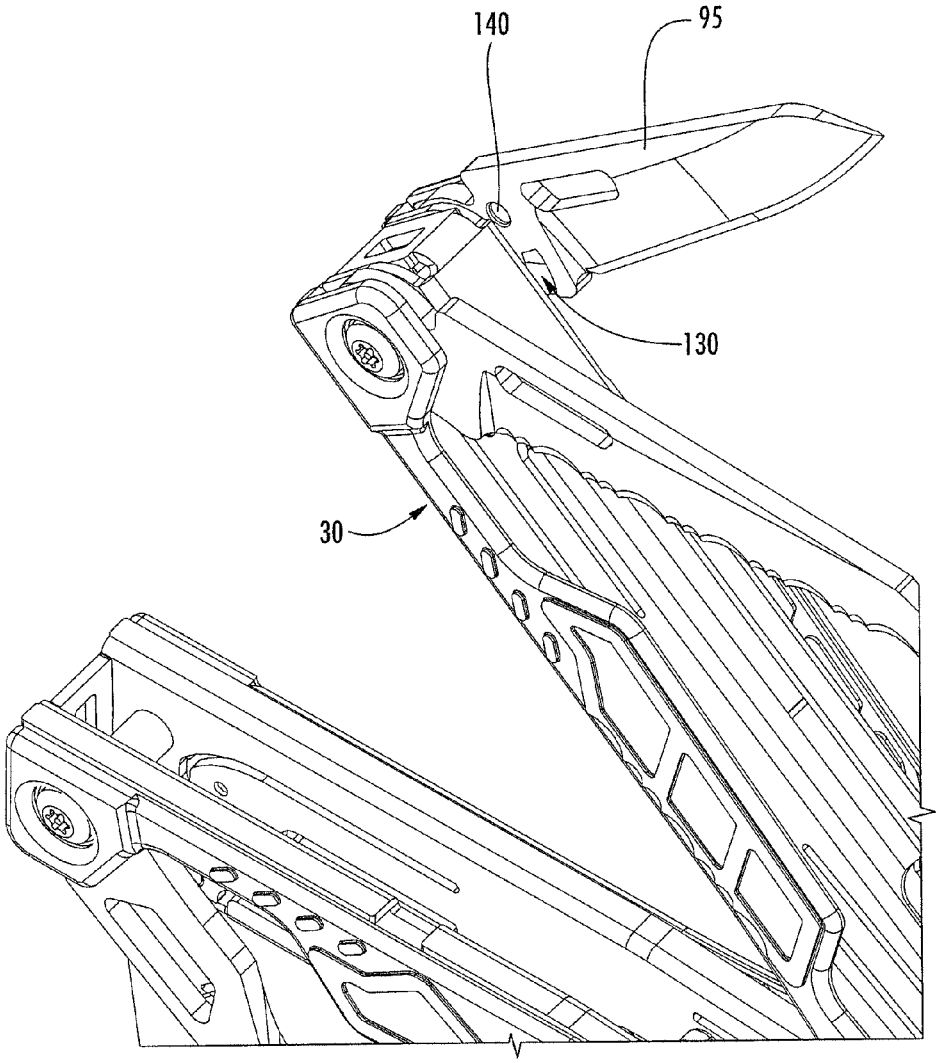
Figure 25:
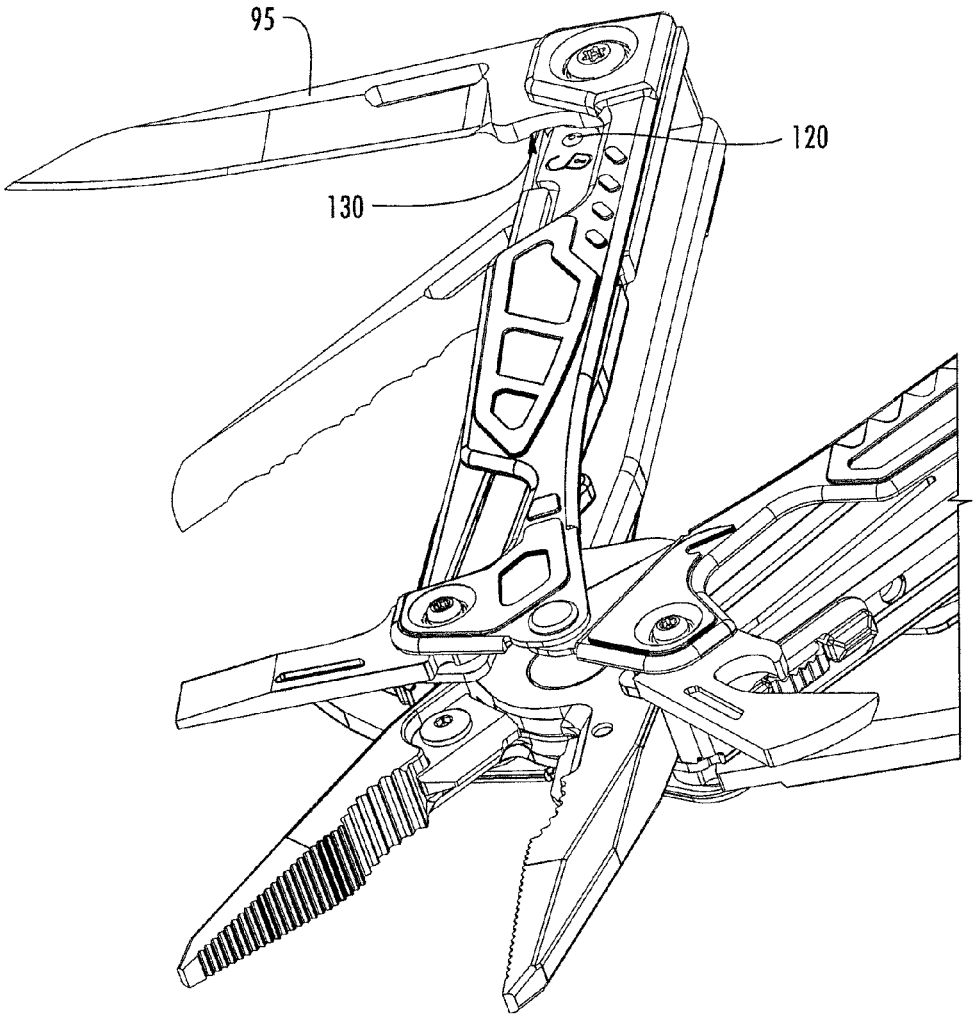
Figure 25A:
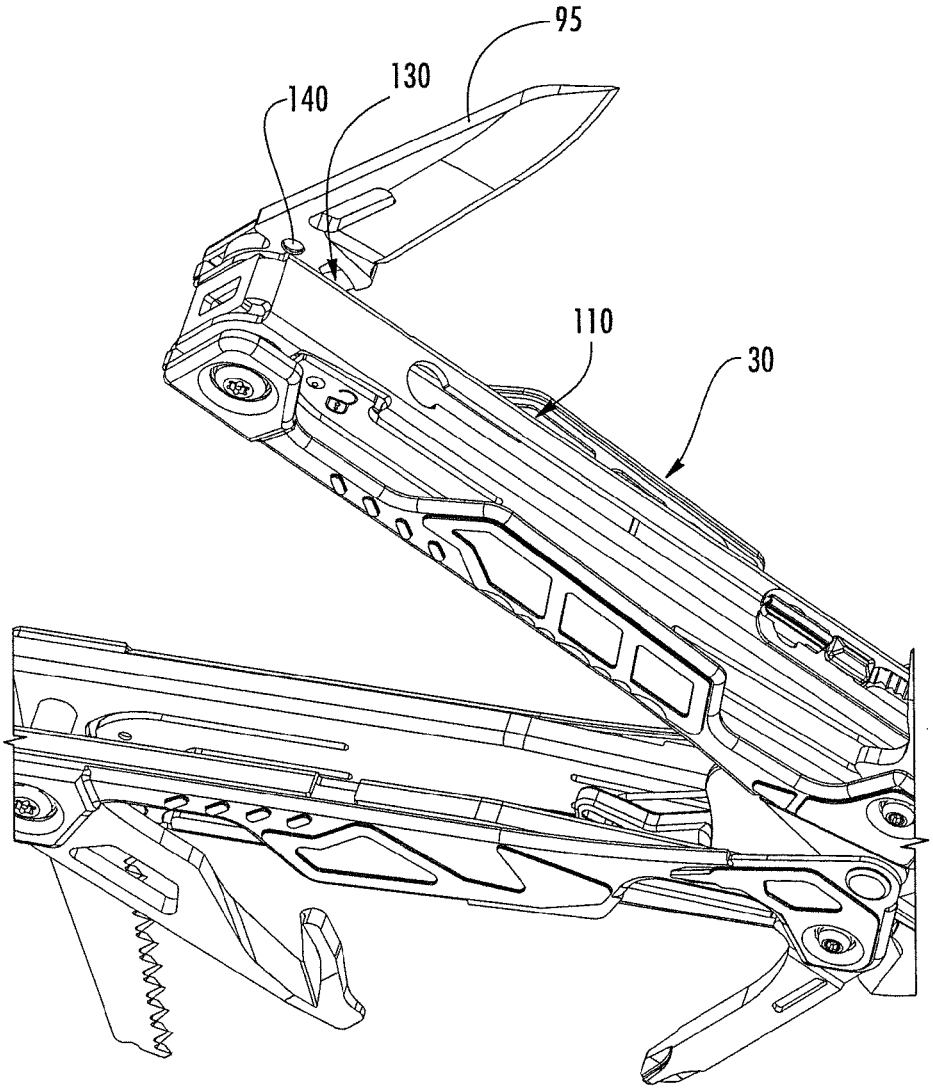

In some embodiments, the ramp is configured to engage the protrusion proximate the leading surface when the at least one tool member is rotated from the open position to the stowed position. In such a manner, the protrusion begins engaging the ramp at the deepest point near the leading surface. The slope of the ramp then forces against the bias of the protrusion in a gradual manner as the tool member rotates further into the pocket of the handle toward the stowed position. Such a configuration removes the sharp increase in friction (or torque) typically felt when the protrusion 120 hits the edge (e.g., the second surface 105) of the tool member when the tool member is moved from the open position to the stowed position (e.g., a smoother transition from the open position to the stowed position is felt by the user). FIGS. 24-25A illustrate an example gradual engagement between the protrusion 120 and the ramp 130 until the knife 95 is fully rotated into the stowed position (shown in FIG. 26).

In some embodiments, the ramp may be configured to not extend to the recess. For example, with reference to FIGS. 22 and 23, the point 136 at which the ramp 130 ceases is short of the recess 140. Such an embodiment enables the engagement of the protrusion and the recess to retain its value. In particular, the protrusion will still fit within the recess and provide resistance to rotation of the tool member out of the stowed position. This is in contrast to if the ramp extends fully up to the recess, as then the protrusion may be more easily removed from the recess during rotation of the tool member out of the stowed position (e.g., down the ramp). Thus, in some embodiments, the ramp may define a length that is a fraction (e.g., half, one-third, etc.) of the distance from the second surface to the recess. For example, with reference to FIG. 22, the ramp 130 defines a length ($RP_D$) approximately half of the distance ($RC_D$) between the second surface 105 and the recess 140.

In some embodiments, the ramp may be defined within a base portion of the tool member such that an operational portion (e.g., a blade) is not negatively affected by the change in structure. For example, with reference to FIG. 22, the knife 95 defines a blade portion 126 and a base portion 125. In the depicted embodiment, the ramp 130 is defined within the base portion 125.

The ramp 130 may define a depth near the second surface 105. In some embodiments, the depth of the ramp 130 may correspond to the depth of the protrusion 120 such that the protrusion fits smoothly within the ramp 130 as the tool member rotates toward the stowed position. Additionally, the base portion 125 (for which the ramp 130 may be defined in) may define a depth ($BP_D$). The difference between the depth ($BP_D$) of the base portion 125 and the depth of the ramp 130 may define a remaining depth ($BP_{RD}$) of the base portion 125. In some circumstances, it may be important to maintain a pre-determined tolerance remaining depth ($BP_{RD}$) for the base portion 125 so as to avoid breakage or wear. Thus, some embodiments may maintain a minimum remaining depth ($BP_{RD}$) greater than zero for the base portion 125.

As noted above, the at least one tool member may be rotatably connected to at least one handle of the hand tool. To account for this rotation, the ramp may define a radial path leading from the second surface toward the recess such that the radial path corresponds to the axis of rotation between the at least one tool member and the at least one handle. For example, with reference to FIG. 22, the ramp 130 may define a radial path 139 that corresponds to the axis of rotation ($R_A$) of the knife 95. In some embodiments, the ramp may define a rectangular path leading from the second surface toward the recess. Such a rectangular path may, in some embodiments, account for the projected radial path of the protrusion. For example, the ramp may define a rectangular path that is large enough to fit the radial path 139 within it.

Though the embodiments described above employ a protrusion on the sidewall of the pocket of the handle and a ramp and recess on the tool member, embodiments of the present invention contemplate employing the protrusion on the tool member and the ramp and recess on the sidewall of the pocket. For example, some embodiments may provide a hand tool comprising at least one handle defining a pocket with opposing sidewalls and a floor, such as the hand tool 10 with the second handle 30 defining the pocket 110 shown in FIG. 21. The hand tool may further comprise at least one tool member, such as the knife 95 shown in FIG. 21. Furthermore, as shown in FIG. 21, the at least one tool member may be carried by the at least one handle and configured to rotate between an open position and a stowed position. The at least one tool member may also be configured to rotate into the pocket of the at least one handle.

However, such an embodiment may differ from previously described embodiments by switching the locations of the protrusion and ramp and recess. For example, in some embodiments, the tool member (e.g., knife 95) may define a protrusion (similar to protrusion 120 shown in FIG. 21). Likewise, at least one of the sidewalls (e.g., sidewall 110*a*) may define a first surface facing outwardly from the floor (e.g., the top surface) and a recess (similar to recess 140) configured to engage with the protrusion of the at least one tool member in the stowed position to resist rotation of the at least one tool member from the stowed position to the open position.

Figure 22:
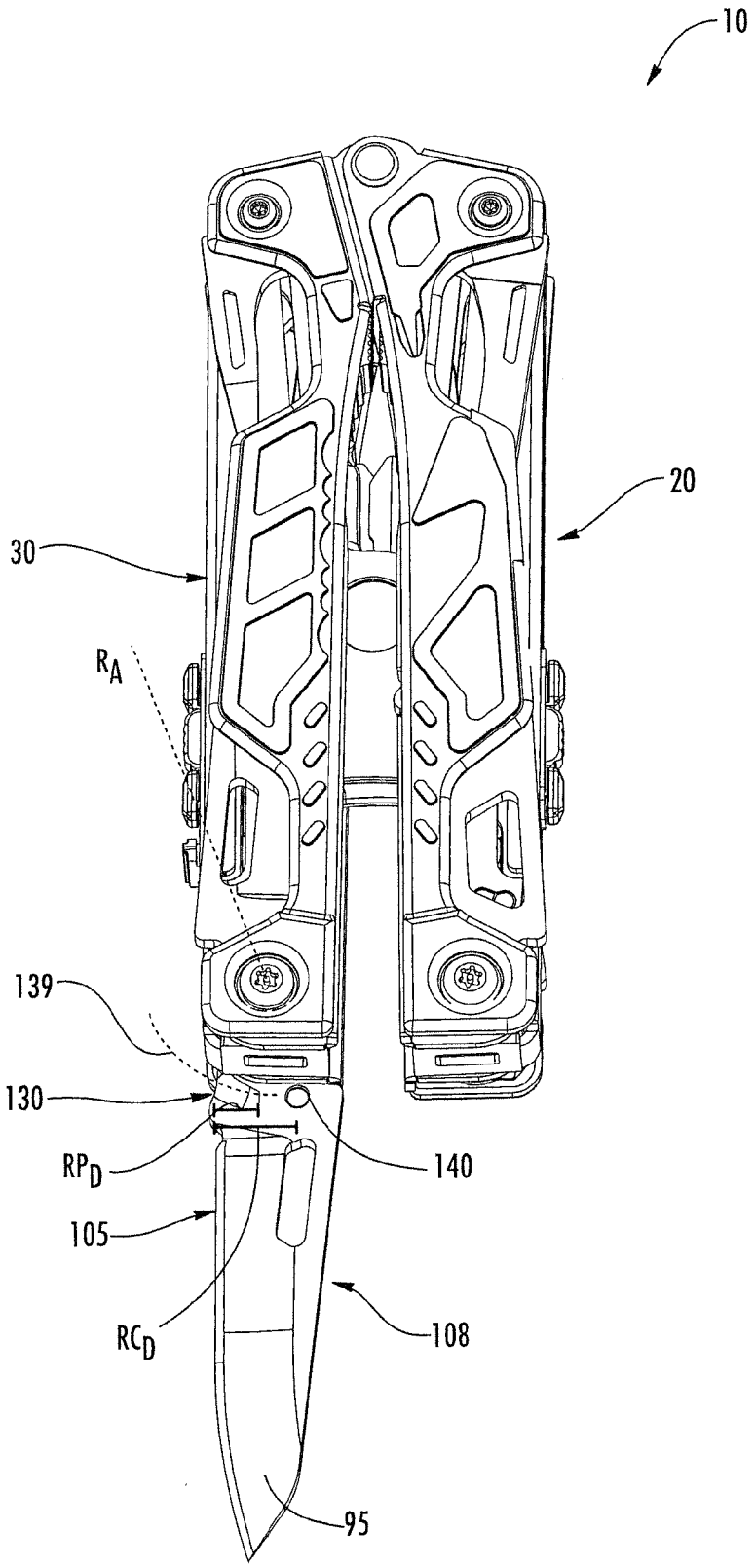
FIGS. 22-26A illustrate transitioning the knife from the open position to the stowed position, wherein the knife is secured in the stowed position, in accordance with some embodiments discussed herein.
Figure 23:
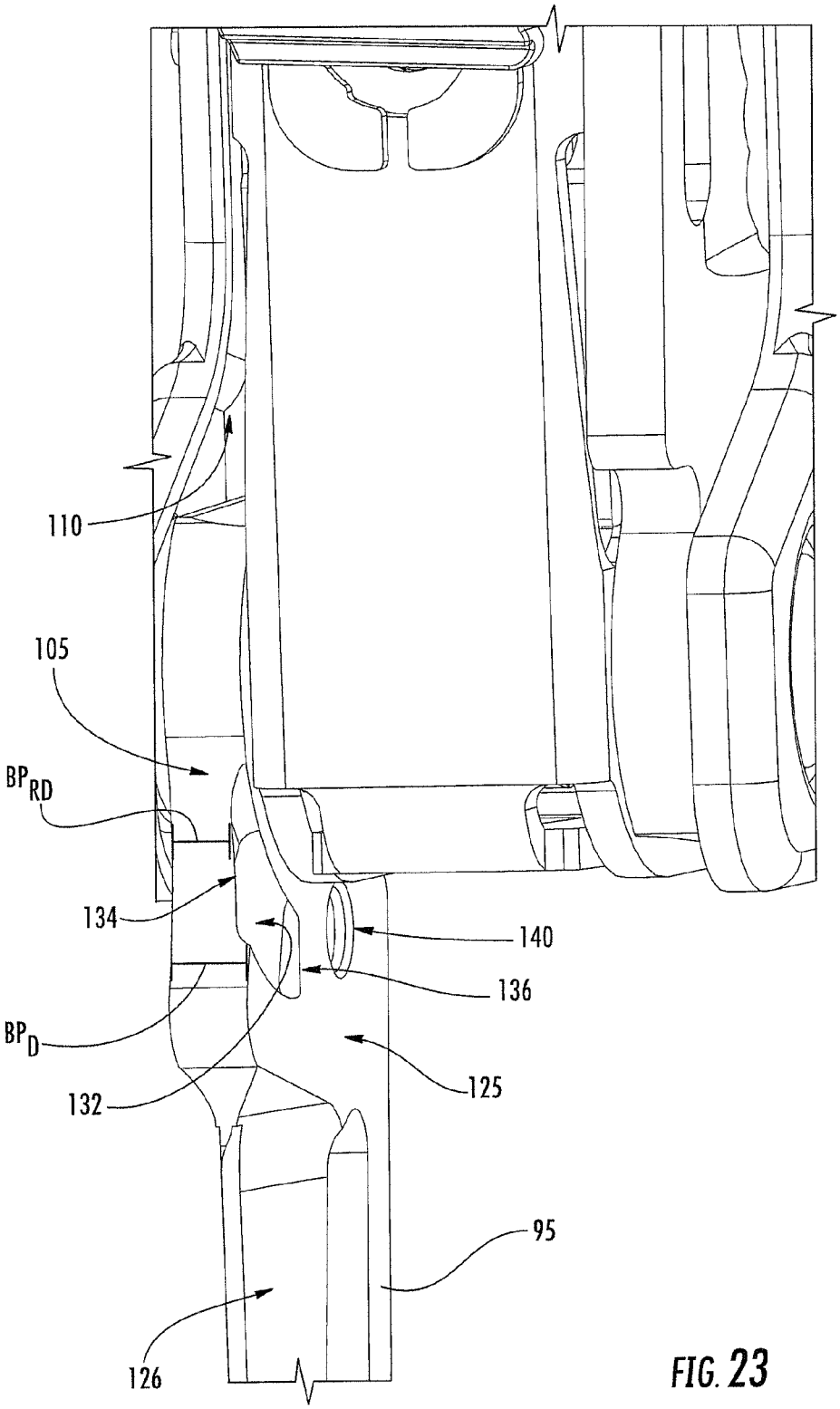

Additionally, the at least one sidewall may further define a ramp (similar to ramp 130 shown in FIG. 22). The ramp may define an upward slope leading from the first surface of the at least one sidewall toward the recess. The ramp may be configured to engage the protrusion proximate the first surface when the at least one tool member is rotated from the open position to the stowed position. In some embodiments, the ramp may not extend to the recess.

Though embodiments of the present invention describe the above improved storage features with respect to the knife 95, such a storage feature may be useful on any type of foldable tool member (e.g., the saw 91, screw driver 92, etc.).

Figure 27:
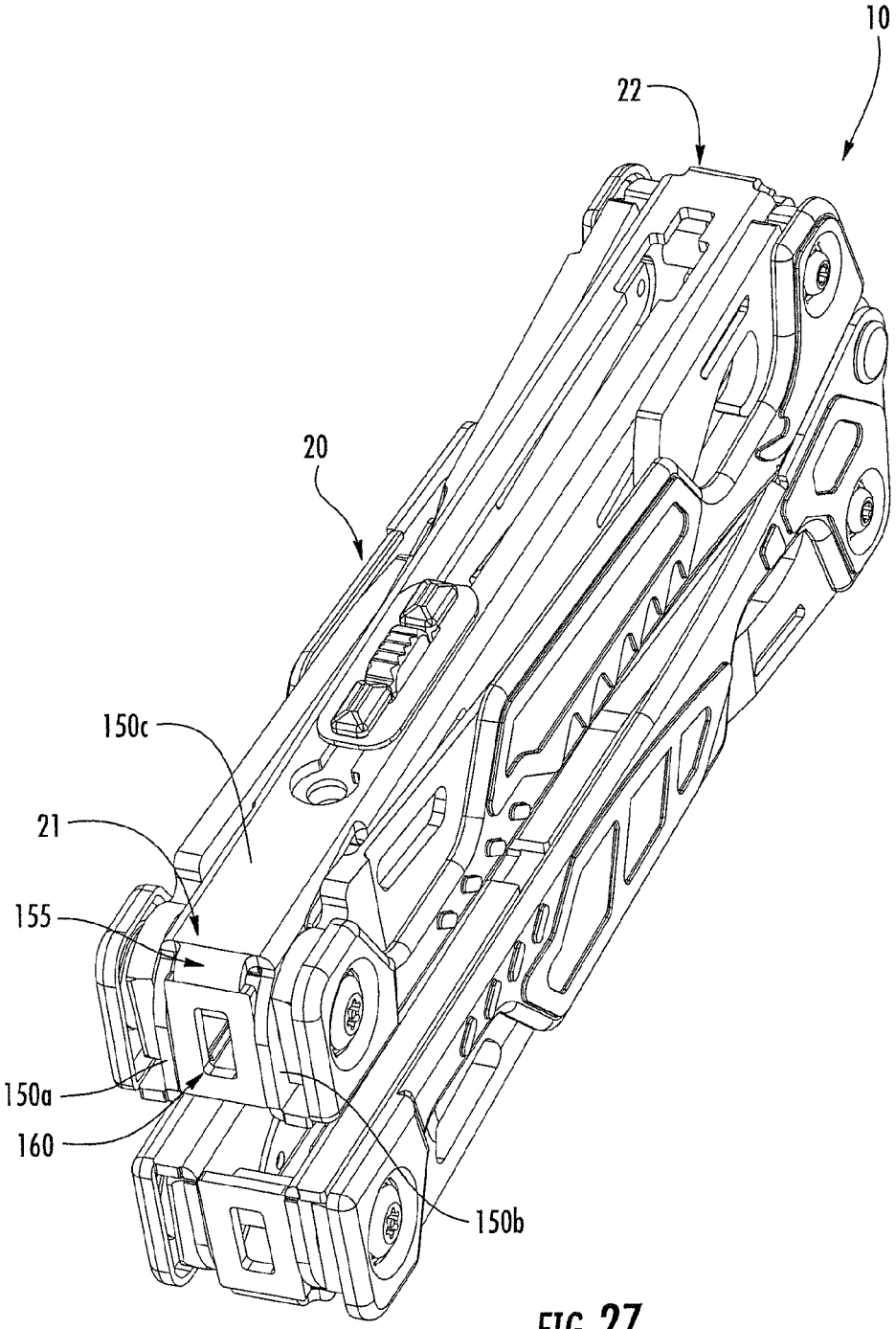
FIG. 27 shows a rear perspective view of the hand tool shown in FIG. 10, in accordance with some embodiments discussed herein.
Figure 28:
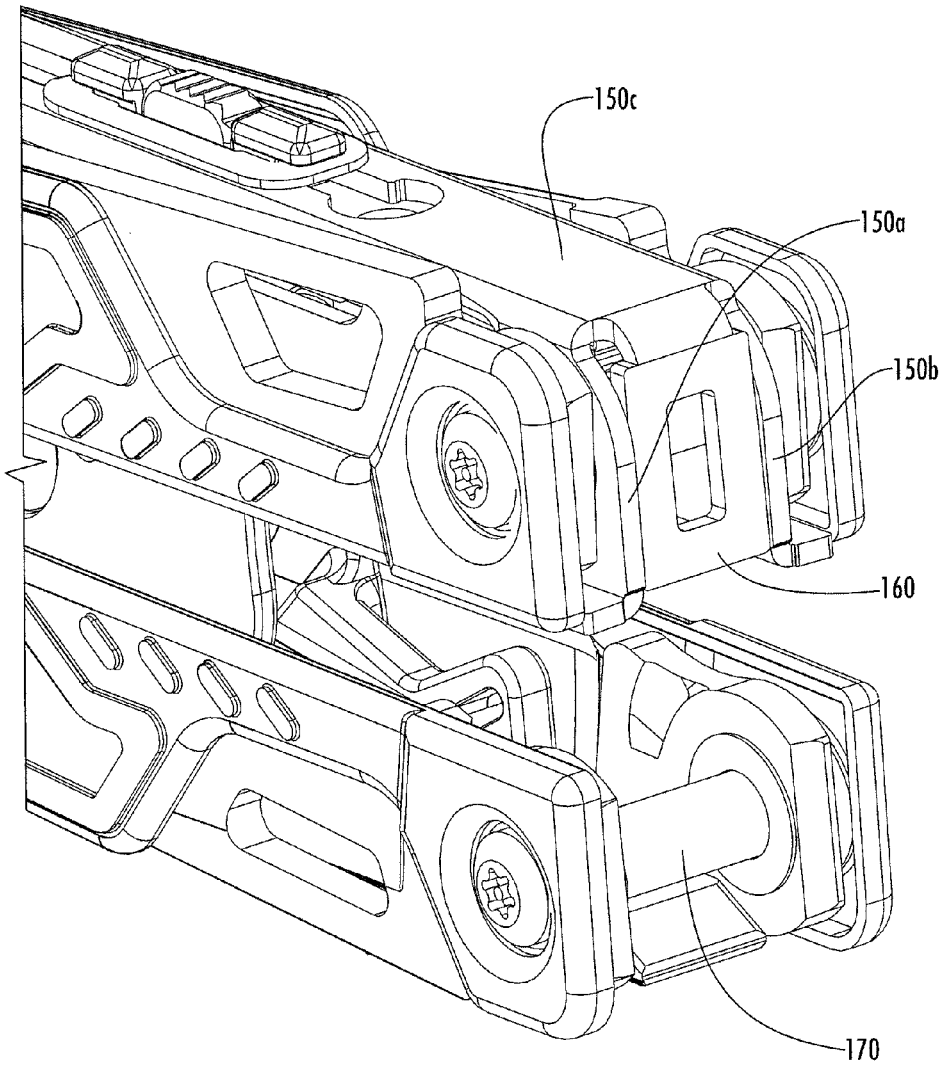
FIG. 28 shows a detail view of the hand tool shown in FIG. 27 with a portion of a handle removed, in accordance with some embodiments discussed herein.

Some embodiments of the present invention may provide a hand tool with at least one handle comprising an extended metal tab for increased protection of the handle. With reference to FIG. 27, an example hand tool 10 may comprise a first handle 20 with a distal end 21 and proximal end 22. The handle 20 may define a U-shape with opposing sidewalls 150*a*, 150*b* and a bottom wall 150*c* connecting the sidewalls 150*a*, 150*b*. The bottom wall 150*c* may define an extended portion 160 at the distal end 22. In the depicted embodiment, the extended portion 160 may be bent between the opposing sidewalls 150*a*, 150*b* to prevent the sidewalls 150*a*, 150*b* from being squeezed together. Likewise, in some embodiments, the extended portion may be positioned at an angle (e.g., 90 degrees) relative to another portion of the bottom wall 150*c* and be positioned between the opposing sidewalls 150*a*, 150*b* to prevent the sidewalls 150*a*, 150*b* from being squeezed together. Additionally, the extended portion 160 may provide protection for a screw 170 (shown in FIG. 28) connecting the opposing sidewalls 150*a*, 150*b*. Further, using the extended portion 160 reduces the number of parts needed for assembly of the hand tool 10.

Figure 29:
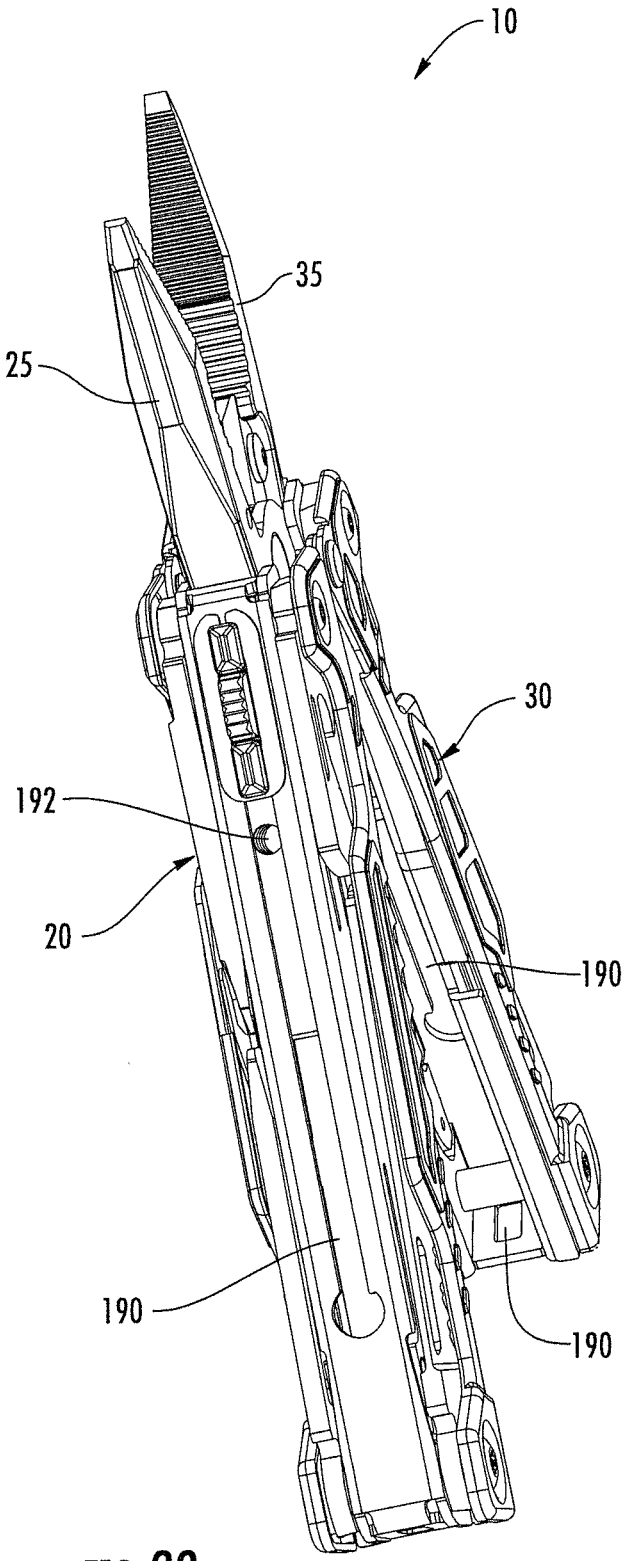
FIG. 29 shows a perspective view of the hand tool shown in FIG. 1, in accordance with some embodiments discussed herein.

Some embodiments of the present invention may provide a hand tool with a plurality of holes for easy cleaning. Hand tools, such as hand tool 10 shown in FIG. 29, are often used outside or in places which may cause mud, dirt, or other debris or liquid to get on the tool. Such dirt may be difficult to remove, especially considering the number of moving parts of the hand tool. Improper removal of the dirt may lead to malfunctioning or wear of the hand tool. As such, to aid in cleaning of the hand tool, some embodiments of the present invention provide a plurality of holes 190 throughout the hand tool 10 such that dirt removal is easier. Additionally, as noted above, some embodiments of the hand tool may not include any tool members on the internal sides of the handles, which may enable easier cleaning of the hand tool. In some embodiments, an aperture 192 may be provided for attaching a cleaning rod to the hand tool 10, such as may be used to clean other tools.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hand tool comprising:

first and second handles defining respective distal and proximal ends;

first and second jaws slidably connected to the first and second handles and configured to translate between a retracted position and an extended position, wherein the first and second jaws are disposed forward of the proximal end of the first and second handles in the extended position, wherein the first and second jaws are disposed within the first and second handles in the retracted position; and a locking member configured to translate with the first and second jaws within a slot defined in an external surface of at least one of the first or second handles that faces outwardly relative to the hand tool, wherein the locking member is configured to rotate within the slot to a locked position to prevent translation of the first and second jaws.

2. The hand tool according to claim 1, wherein the locking member is configured to rotate within the slot when the first and second jaws are disposed in the retracted position.

3. The hand tool according to claim 1, wherein the slot defines a longitudinal axis extending parallel to the length of the at least one first or second handle, wherein the slot defines a locking portion configured to enable the locking member to rotate between an unlocked position and the locked position, wherein the locking member defines a width and a length greater than the width, wherein the width of the locking member is perpendicular to the longitudinal axis of the slot when the locking member is in the unlocked position, wherein the length of the locking member is perpendicular to the longitudinal axis of the slot when the locking member is in the locked position, wherein the slot defines a width greater than the width of the locking member to facilitate translation of the locking member when the locking member is in the unlocked position, and wherein the width of the slot is less than the length of the locking member such that translation of the locking member is prevented when the locking member is the locked position.

4. The hand tool according to claim 3, wherein the locking portion defines a locking track and a notch, wherein the locking track enables the locking member to rotate approximately 90 degrees between the unlocked position and the locked position, and wherein the notch is configured to engage at least a portion of the locking member to prevent translation of the locking member when the locking member is in the locked position.

5. The hand tool according to claim 3 further comprising a clip configured to at least partially surround the locking member, wherein the clip is configured to translate with the locking member, wherein the clip comprises a clip locking portion that corresponds to the locking portion of the slot, wherein the clip is biased to surround the locking member such that the locking member is biased toward the locked position when disposed in the locked position and biased toward the unlocked position when disposed in the unlocked position.

6. The hand tool according to claim 1, wherein the first and second jaws are fully disposed within the first and second handles in the retracted position.

7. The hand tool according to claim 1, wherein the first and second handles are pivotably connected, wherein the first and second jaws are pivotably connected, and wherein the first and second jaws are configured for relative pivotal movement in response to convergence and divergence of the first and second handles when disposed in the extended position.

8. The hand tool according to claim 7 further comprising a spring biased to oppose convergence of the first and second handles, wherein the pivotable connection of the first and second jaws is distinct from the pivotable connection of the first and second handles such that force exerted on the first and second handles to overcome the bias of the spring transfers substantially through the pivotable connection of the first and second jaws without transferring substantially through the pivotable connection of the first and second handles.

9. The hand tool according to claim 1, wherein the first and second handles each define an internal U-shaped channel, wherein the first and second jaws each define a distal portion corresponding to at least a portion of the U-shaped channel and configured to fit within the U-shaped channel to reduce lateral movement of the first and second jaws within the U-shaped channel during movement of the hand tool.

10. The hand tool according to claim 1, wherein the first and second handles each define an external side and an internal side, wherein the internal side of the first handle faces the internal side of the second handle, wherein the hand tool further comprises a plurality of tool members, wherein each of the plurality of tool members are carried by one of the first or second handles, wherein each of the plurality of tools are disposed on the external side of the respective one of the first or second handles such that each tool member is configured to fold into and out of the external side of the respective one of the first or second handles, wherein none of the plurality of tool members are disposed on either of the internal sides of the first or second handles.

11. The hand tool according to claim 1, wherein at least one of the first or second handles defines a pocket with opposing sidewalls and a floor, wherein at least one of the sidewalls of the pocket defines a protrusion, wherein the hand tool further comprises at least one tool member carried by at least one of the first or second handle and rotatable between a stowed position and an open position, wherein the at least one tool member defines a first surface and a second surface, wherein the at least one tool member is configured to rotate into the pocket of the at least one first or second handle with the second surface disposed proximate to the floor of the pocket to define the stowed position, wherein the at least one tool member defines a recess configured to engage with the protrusion of the sidewall in the stowed position, wherein the at least one tool member further defines a ramp, wherein the ramp defines an upward slope leading from the second surface of the at least one tool member toward the recess, wherein the ramp is configured to engage the protrusion proximate the second surface when the at least one tool member is rotated from the open position to the stowed.

12. The hand tool according to claim 11, wherein the ramp does not extend to the recess.

13. The hand tool according to claim 1, wherein the first and second handles each define a U-shape with opposing sidewalls and a bottom wall connecting the sidewalls, wherein the bottom wall of first and second handles each defines an extended portion at the distal end of the first and second handles, wherein the extended portion is positioned at an angle relative to another portion of the bottom wall and is positioned between the opposing sidewalls to prevent the sidewalls from being squeezed together.

14. A hand tool comprising:

at least one handle defining a pocket with opposing sidewalls and a floor, wherein at least one of the sidewalls defines a protrusion; and at least one tool member defining a first surface and a second surface, wherein the at least one tool member is carried by the at least one handle and configured to rotate between an open position and a stowed position, wherein the at least one tool member is configured to rotate into the pocket of the at least one handle with the second surface disposed proximate to the floor of the pocket to define the stowed position, wherein the at least one tool member defines a recess configured to engage with the protrusion of the sidewall in the stowed position, wherein the at least one tool member further defines a ramp, wherein the ramp defines an upward slope leading from the second surface of the at least one tool member toward the recess, wherein the ramp is configured to engage the protrusion proximate the second surface when the at least one tool member is rotated from the open position to the stowed position.

15. The hand tool according to claim 14, wherein the ramp does not extend to the recess.

16. The hand tool according to claim 15, wherein the ramp defines a length of approximately half of the distance between the second surface and the recess.

17. The hand tool according to claim 15, wherein the at least one tool member is rotatably connected to the at least one handle, wherein the ramp defines a radial path leading from the second surface toward the recess, wherein the radial path corresponds to the axis of rotation between the at least one tool member and the at least one handle.

18. The hand tool according to claim 15, wherein the ramp defines a rectangular path leading from the second surface toward the recess.

19. The hand tool according to claim 15, wherein the sidewall with the protrusion is biased toward the recess to resist rotation of the at least one tool member from the stowed position to the open position when the protrusion is engaged with the recess.

20. The hand tool according to claim 14, wherein the at least one tool member is rotatably connected to the at least one handle and defines a base portion proximate the rotatable connection, wherein the ramp is defined within the base portion of the at least one tool member.

21. A hand tool comprising:

at least one handle defining a pocket with opposing sidewalls and a floor; and at least one tool member defining a protrusion, wherein the at least one tool member is carried by the at least one handle and configured to rotate between an open position and a stowed position, wherein the at least one tool member is configured to rotate into the pocket of the at least one handle, wherein the at least one of the sidewalls defines a first surface facing outwardly from the floor, wherein the at least one sidewall defines a recess configured to engage with the protrusion of the at least one tool member in the stowed position to resist rotation of the at least one tool member from the stowed position to the open position, wherein the at least one sidewall further defines a ramp, wherein the ramp defines an upward slope leading from the first surface of the at least one sidewall toward the recess, wherein the ramp is configured to engage the protrusion proximate the first surface when the at least one tool member is rotated from the open position to the stowed position.

22. A hand tool comprising:

first and second handles defining respective distal and proximal ends at opposed ends thereof;

first and second jaws slidably connected to the first and second handles and configured to translate between a retracted position and an extended position, wherein the first and second jaws are disposed forward of the proximal end of the first and second handles in the extended position, wherein the first and second jaws are disposed within the first and second handles in the retracted position; and a plurality of tool members, wherein each of the plurality of tool members is carried by one of the first or second handles, wherein each of the plurality of tool members is configured to rotate into and out of the respective one of the first or second handles, wherein at least one of the tool members is rotatable around an axis of the first or second handle defined proximate the distal end of the respective first or second handle, wherein at least another one of the tool members is rotatable around an axis of the first or second handle defined proximate the proximal end of the respective first or second handle.

23. A hand tool comprising:

first and second handles defining respective distal and proximal ends, wherein the first handle comprises a first internal channel, wherein the second handle comprises a second internal channel;

first and second bars positioned within the first and second internal channels respectively; and first and second jaws slidably connected to the first and second handles and configured to translate within the first and second internal channels between a retracted position and an extended position, wherein the first and second jaws are disposed forward of the proximal end of the first and second handles in the extended position, wherein the first and second jaws are disposed within the first and second handles in the retracted position, wherein the first and second jaws each define a slot configured to interact with the first or second bars in the extended position.

24. The hand tool according to claim 23 further comprising a plurality of tool members, wherein each of the plurality of tool members are carried by one of the first or second handles, wherein each of the plurality of tool members are configured to rotate into and out of the respective one of the first or second handles around an axis, wherein at least one of the tool members is rotatable around an axis defined by one of the first or second bars.

25. The hand tool according to claim 23, wherein the first and second handles are pivotably connected, wherein the first and second jaws are pivotably connected, and wherein the first and second jaws are configured for relative pivotal movement in response to convergence and divergence of the first and second handles when disposed in the extended position.

26. The hand tool according to claim 25 further comprising a spring biased to oppose convergence of the first and second handles, wherein the pivotable connection of the first and second jaws is distinct from the pivotable connection of the first and second handles such that force exerted on the first and second handles to overcome the bias of the spring transfers substantially through the first and second bars without transferring substantially through the pivotable connection of the first and second handles.

27. A hand tool comprising:

first and second handles defining respective distal and proximal ends, wherein the first and second jaws are pivotably connected; and first and second jaws slidably connected to the first and second handles and configured to translate between a retracted position and an extended position, wherein the first and second jaws are disposed forward of the proximal end of the first and second handles in the extended position, wherein the first and second jaws are disposed within the first and second handles in the retracted position;

wherein the first and second jaws are configured for relative pivotal movement in response to convergence and divergence of the first and second handles when disposed in the extended position, wherein the first and second handles are pivotably connected, and wherein the pivotable connection of the first and second jaws is disposed forward of the pivotable connection of the first and second handles.

28. The hand tool according to claim 27, wherein the first handle defines a first extension with a first elongated slot, wherein the second handle defines a second extension with a second elongated slot, wherein the pivotable connection of the first and second handles is defined by a connection between the first elongated slot and the second elongated slot, wherein the first and second elongated slots are configured to enable the first and second handles to converge inside the first and second elongated slots when the first and second jaws converge and diverge inside the first and second elongated slots when the first and second jaws diverge.

29. A hand tool comprising:

first and second handles defining respective distal and proximal ends, wherein the first handle comprises a first internal channel, wherein the second handle comprises a second internal channel;

first and second bars positioned within the first and second internal channels respectively;

first and second jaws slidably connected to the first and second handles and configured to translate within the first and second internal channels between a retracted position and an extended position, wherein the first and second jaws are disposed forward of the proximal end of the first and second handles in the extended position, wherein the first and second jaws are disposed within the first and second handles in the retracted position, wherein the first and second jaws are capable of relative pivotal movement in response to convergence and divergence of the first and second handles when disposed in the extended position; and a spring biased to oppose convergence of the first and second handles, wherein the first and second bars are configured to engage the first and second jaws in the retracted position against the bias of the spring so as to prevent divergence of the first and second jaws when the first and second jaws are disposed in the retracted position.

30. A hand tool comprising:

first and second handles defining respective distal and proximal ends, wherein the first handle comprises a first internal channel, wherein the second handle comprises a second internal channel;

first and second jaws slidably connected to the first and second handles and configured to translate within the first and second internal channels between a retracted position and an extended position, wherein the first and second jaws are disposed forward of the proximal end of the first and second handles in the extended position, wherein the first and second jaws are disposed within the first and second handles in the retracted position, wherein the first and second jaws are capable of relative pivotal movement in response to convergence and divergence of the first and second handles when disposed in the extended position; wherein the first jaw defines a first flared portion, wherein the second jaw defines a second flared portion, and a spring biased to oppose convergence of the first and second handles, wherein the first internal channel defines a first flange configured to engage the first flared portion of the first jaw in the retracted position, wherein the second internal channel defines a second flange configured to engage the second flared portion of the second jaw in the retracted position, wherein the first and second flanges are configured to engage the first and second flared portions in the retracted position against the bias of the spring so as to prevent divergence of the first and second jaws when the first and second jaws are disposed in the retracted position.

* * * * *